US011458375B2

(12) United States Patent
Higdon et al.

(10) Patent No.: US 11,458,375 B2
(45) Date of Patent: Oct. 4, 2022

(54) MULTI-COMPONENT PUTTER

(71) Applicant: KARSTEN MANUFACTURING CORPORATION, Phoenix, AZ (US)

(72) Inventors: David A. Higdon, Cave Creek, AZ (US); Jacob T. Clarke, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/243,338

(22) Filed: Apr. 28, 2021

(65) Prior Publication Data

US 2021/0245020 A1 Aug. 12, 2021

Related U.S. Application Data

(63) Continuation-in-part of application No. 29/720,679, filed on Jan. 15, 2020, now Pat. No. Des. 930,097, and a continuation of application No. 16/590,270, filed on Oct. 1, 2019, now Pat. No. 11,020,640.

(60) Provisional application No. 62/739,747, filed on Oct. 1, 2018.

(51) Int. Cl.
*A63B 53/04* (2015.01)

(52) U.S. Cl.
CPC ..... *A63B 53/0487* (2013.01); *A63B 53/0412* (2020.08); *A63B 53/0416* (2020.08); *A63B 53/0441* (2020.08); *A63B 2209/00* (2013.01)

(58) Field of Classification Search
CPC ..... A63B 53/065; A63B 53/0487; A63B 2209/00; A63B 2053/0412; A63B 2053/0433
USPC ..... 473/340, 349
See application file for complete search history.

(56) References Cited

U.S. PATENT DOCUMENTS

| | | | |
|---|---|---|---|
| 5,037,102 | A | 8/1991 | Fukayama et al. |
| 5,078,398 | A | 1/1992 | Reed et al. |
| 5,482,281 | A | 1/1996 | Anderson |
| 5,655,976 | A | 8/1997 | Rife |
| 5,676,606 | A | 10/1997 | Schaeffer et al. |
| 5,797,176 | A | 8/1998 | Rose et al. |
| 5,842,935 | A | 12/1998 | Nelson |
| 5,951,412 | A | 9/1999 | Rose et al. |
| 6,083,118 | A | 7/2000 | Martins et al. |
| 6,270,422 | B1 | 8/2001 | Fisher |
| 6,416,421 | B1 | 7/2002 | Sery |
| 6,471,600 | B2 | 10/2002 | Tang et al. |
| 6,692,378 | B2 | 2/2004 | Shmoldas et al. |
| 6,716,110 | B1 | 4/2004 | Ballow |
| 6,958,019 | B2 | 10/2005 | Rohrer |
| 6,984,181 | B2 | 1/2006 | Hettinger et al. |
| 6,988,955 | B2 | 1/2006 | Stoakes |
| 7,022,030 | B2 | 4/2006 | Best et al. |
| 7,077,758 | B2 | 7/2006 | Rohrer |

(Continued)

FOREIGN PATENT DOCUMENTS

| | | |
|---|---|---|
| GB | 2391484 | 2/2004 |
| JP | 2001062013 | 3/2001 |

OTHER PUBLICATIONS

International Search Report/Written Opinion for Int'l Patent Application No. PCT/US2019/054139, filed on Oct. 1, 2019.

*Primary Examiner* — Raeann Gorden

(57) ABSTRACT

An embodiment of a putter type golf club head with an upper and lower portion, made from two different materials, is enclosed herein. Other embodiments are described herein.

18 Claims, 21 Drawing Sheets

(56) References Cited

U.S. PATENT DOCUMENTS

| | | | |
|---|---|---|---|
| 7,083,525 | B2 | 8/2006 | Pond et al. |
| 7,160,203 | B2 | 1/2007 | Bonneau |
| 7,163,469 | B2 | 1/2007 | Bonneau |
| 7,351,162 | B2 | 4/2008 | Soracco et al. |
| 7,377,858 | B2 | 5/2008 | Kubota |
| 7,455,599 | B2 | 11/2008 | Jones |
| 7,485,051 | B2 | 2/2009 | Richard, Jr. |
| 7,491,131 | B2 | 2/2009 | Vinton |
| 7,491,135 | B1 | 2/2009 | Rollinson |
| 7,594,865 | B2 | 9/2009 | Ines |
| 7,601,076 | B2 | 10/2009 | Rollinson |
| 7,717,806 | B2 | 5/2010 | Kubota |
| 7,798,919 | B2 | 9/2010 | Kubota |
| 7,803,066 | B2 | 9/2010 | Solheim et al. |
| 7,815,519 | B2 | 10/2010 | Bryant et al. |
| 7,854,665 | B2 | 12/2010 | Dewhurst et al. |
| 7,918,745 | B2 | 4/2011 | Morris et al. |
| 7,993,215 | B1 | 8/2011 | Rentz |
| 8,100,779 | B2 | 1/2012 | Solheim et al. |
| 8,109,838 | B2 | 2/2012 | Solheim et al. |
| 8,308,583 | B2 | 11/2012 | Morris et al. |
| 8,328,654 | B2 | 12/2012 | Demkowski et al. |
| 8,758,154 | B2 | 6/2014 | Demkowski et al. |
| 8,961,334 | B2 | 2/2015 | Franklin et al. |
| 9,022,876 | B2 | 5/2015 | Snyder et al. |
| 9,044,062 | B2 | 6/2015 | Delaney |
| 9,072,948 | B2 | 7/2015 | Franklin et al. |
| 9,132,325 | B2 | 9/2015 | Witlam et al. |
| 9,220,960 | B2 | 12/2015 | Schartiger et al. |
| 9,827,479 | B2 | 11/2017 | Demkowski et al. |
| 9,901,792 | B2 | 2/2018 | Franklin et al. |
| 9,956,463 | B2 | 5/2018 | Franklin et al. |
| 10,046,211 | B2 | 8/2018 | Franklin et al. |
| 10,252,138 | B2 | 4/2019 | Demkowski et al. |
| 10,300,348 | B2 | 5/2019 | Morris |
| 2006/0234810 | A1 | 10/2006 | Chiodo et al. |
| 2007/0142122 | A1 | 6/2007 | Bonneau |
| 2007/0167253 | A1 | 7/2007 | Sizemore |
| 2008/0176672 | A1 | 7/2008 | Roach et al. |
| 2010/0227704 | A1 | 9/2010 | Souza et al. |
| 2011/0151996 | A1 | 6/2011 | Dewhurst et al. |
| 2012/0129620 | A1 | 5/2012 | Davis et al. |
| 2012/0244959 | A1 | 9/2012 | Dewhurst et al. |
| 2015/0335966 | A1* | 11/2015 | Cameron ..... A63B 53/0487 473/219 |

* cited by examiner

MULTI-COMPONENT PUTTER

CROSS-REFERENCE TO RELATED APPLICATIONS

This is a continuation in part of U.S. patent application Ser. No. 29/720,679, filed on Jan. 15, 2020, and this is a continuation of U.S. patent application Ser. No. 16/590,270, filed on Oct. 1, 2019, no U.S. Pat. No. 11,020,640, which claims the benefit of U.S. Provisional Patent Appl. No. 62/739,747, filed on Oct. 1, 2018, the contents all of which are incorporated fully herein by reference.

TECHNICAL FIELD

This disclosure relates generally to golf clubs and relates more particularly to a multi-component putter type golf club head.

BACKGROUND

In many putter-type golf club heads, there is a use of a weight distribution device, in order to vary the center of gravity or increase the moment of inertia (MOI) of the golf club head. Common weight distribution devices include removable weight ports in the heel and toe regions of the sole, weighted faceplate inserts, inserts for the back of portion of the face, and attachments for the outer perimeter of the toe and heel regions. In particular putter-type golf club heads, often use weight ports in the heel and toe regions that can be removable attached by a fastener, or permanently attached through a variety of epoxies, glues, or machining methods. The use of weight ports in the heel and toe regions, the increases the MOI in the putter head, thereby producing a straighter ball path after impact.

Although these weight ports in the heel and toe regions increase MOI, they increase the weight of the golf club head and can make the golf club head heavier than an ideal weight for a putter. In addition, installing weight ports into a golf club putter head requires a cavity or recess to place these weight ports into the putter head during manufacturing, thereby increasing the cost of that putter head. Additionally, the weight ports can cause vibrations within the cavity or recess during impact, when the golf club head contacts a golf ball. These cavities and recesses can cause the sound of the club head to change as well, creating a hollow sound within the club head. There is a need in the art to develop a putter having perimeter weighting and having an ideal weight for balanced putting without adding complicated structures such as weight ports.

Figure 1B:
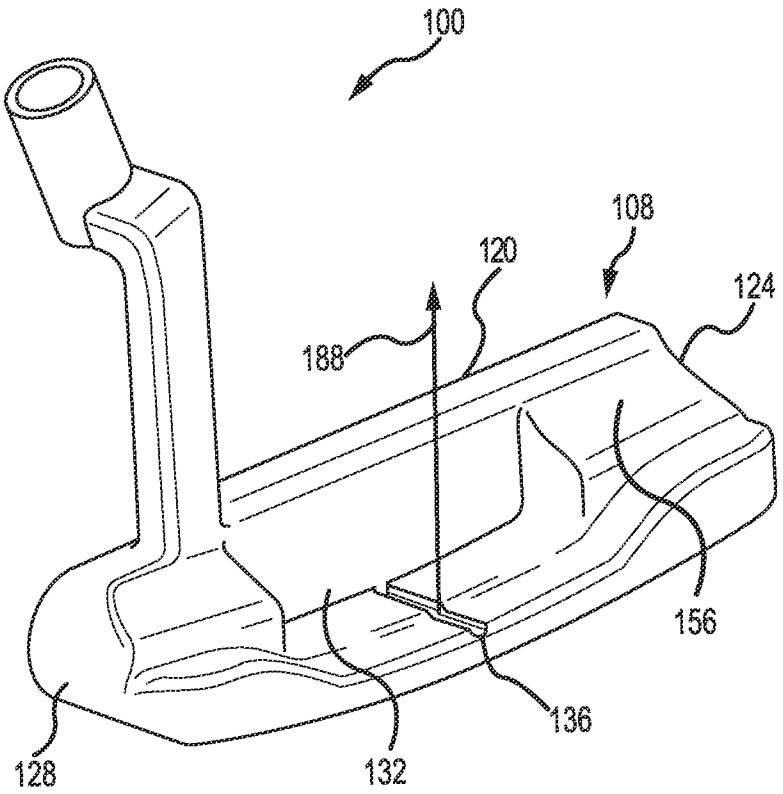
FIG. 1B illustrates an isometric view of the blade putter type golf club head of FIG. 1A.

Other aspects of the disclosure will become apparent by consideration of the detailed description and accompanying drawings.

DESCRIPTION

I. Putter Golf Club Head

Described herein is a two part putter having an upper portion made of a first material such as low density metal (i.e., aluminum, but not limited to) and a lower portion made of a second material, such as a high density metal (i.e., steel, but not limited to). The upper portion has crown that spans from a strike face to a back edge. This upper portion is affixed to the lower portion and is farther from a ground plane than the lower portion. The lower portion, in most embodiments, has less than 35% of the total solid volume of the putter head, but greater than 45% of the mass. The lower portion provides a peripheral construction and a sole. This combination of peripheral construction and high density lower portion, results in an increase in MOI of at least 30%, over a putter with the same volume, mass, and single material construction (i.e., a putter milled of a single material such as a steel putter or a putter investment cast of a single material).

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "upper," "lower," "over," "under," "top," "bottom," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

In many embodiments, the golf club head can comprise a putter-type golf club head (the putter type golf club head 100, 200, 300 400 . . . etc.). FIGS. 1-12B illustrate multiple embodiments of a putter-type golf club head having an upper portion and lower portion that are separately made of different materials and coupled together. The putter-type golf club head can be a mallet-type putter head, mid-mallet type putter head, a blade type putter head, a high MOI putter head, or any other type of putter-type golf club head.

In many embodiments, the putter-type golf club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

The putter-type golf club head comprises an upper portion and a lower portion. The golf club head can comprise a toe end and a heel end opposite the toe end. The putter-type golf club head can comprise a strike face. The putter-type golf club head can comprise a rear wall opposite the strike face. Further, the putter-type golf club head can comprise an alignment feature. Furthermore, the putter-type golf club head can comprise a hosel attached to the heel end of the golf club head. The hosel may be attached to the center of the putter-type golf club head. The hosel may be attached to the heel end of the putter-type golf club head. The hosel may be integrally formed with the upper portion of the putter-type golf club head. The hosel may be integrally formed with the lower portion of the putter-type golf club head.

The upper portion is made of a first material. The lower portion is made of a second material. The first material is different than the second material. The first material has a first density. The second material has a second density. The first density is not the same as the second density.

In many embodiments, the putter-type golf club head can have a mass that ranges between 340 and 385 grams. In other embodiments, the mass of the putter-type golf club head can range between 340 grams-345 grams, 345 grams-350 grams, 350 grams-355 grams, 355 grams-360 grams, 360 grams-365 grams, 365 grams-370 grams, 370 grams-375 grams, 375 grams-380 grams, or 380 grams-385 grams. In some embodiments, the mass of the putter-type golf club head can be 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, 365 grams, 366 grams, 367 grams, 368 grams, 369 grams, 370 grams, 371 grams, 372 grams, 373 grams, 374 grams, 375 grams, 376 grams, 377 grams, 378 grams, 379 grams, 380 grams, 381 grams, 382 grams, 383 grams, 384 grams, or 385 grams.

In many embodiments, the putter type golf club head can comprise a club head volume ranging between 25 cc and 125 cc. In some embodiments, the club head volume can range between 25 cc-30 cc, 30 cc-35 cc, 35 cc-40 cc, 40 cc-45 cc, 45 cc-50 cc, 50 cc-55 cc, 55 cc-60 cc, 60 cc-65 cc, 65 cc-70 cc, 70 cc-75 cc, 75 cc-80 cc, 80 cc-85 cc, 85 cc-90 cc, 90 cc-95 cc, 95 cc-100 cc, 100 cc-105 cc, 105 cc-110 cc, 110 cc-115 cc, 115 cc-120 cc, or 120 cc-125 cc. In one embodiment, the club head volume can range between 40 cc-110 cc. In some embodiments, the club head volume can be greater than 25 cc, greater than 50 cc, greater than 75 cc, or greater than 100 cc.

In some embodiments, the putter type golf club head can comprise a strike face made of the first material. In other embodiments, the strike face can be made of the second material. In these embodiments, the material of the strike face can be any one or combination of the following: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), aluminum (2.70 g/cc), aluminum alloy (2.64 g/cc-2.81 g/cc), ADC-12 (2.75 g/cc), or any metal suitable for creating a golf club head. In some embodiments, the strike face can be integrally formed to the upper portion. In other embodiments the strike face can be integrally formed to the lower portion. The strike face can be integrally formed to the club head by co-molding, injection molding, casting, additive manufacturing or other forming process.

Figure 11B:
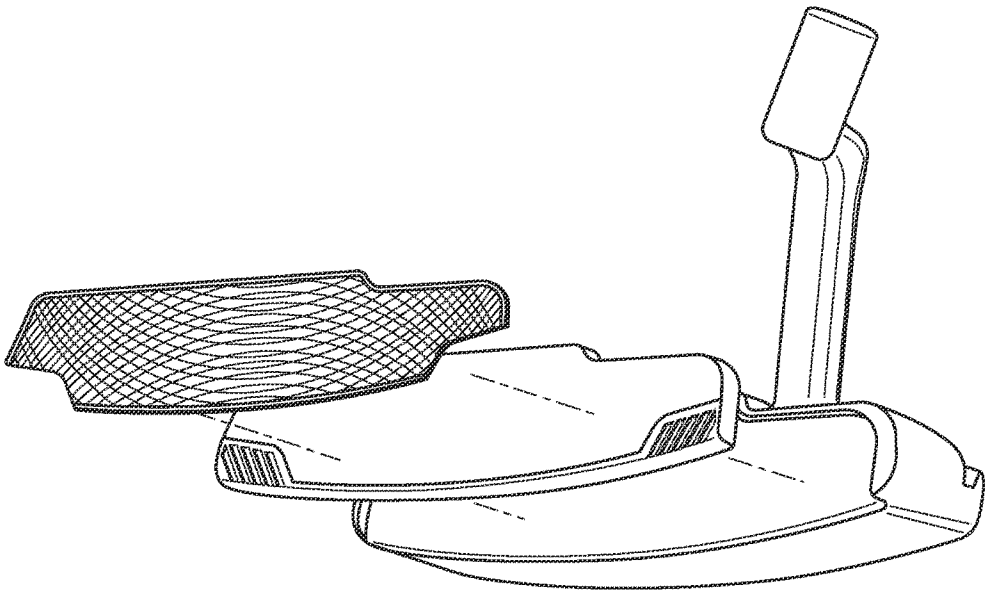
FIG. 11B illustrates an exploded view of another putter type golf club head with at least one strike face insert.
Figure 11A:
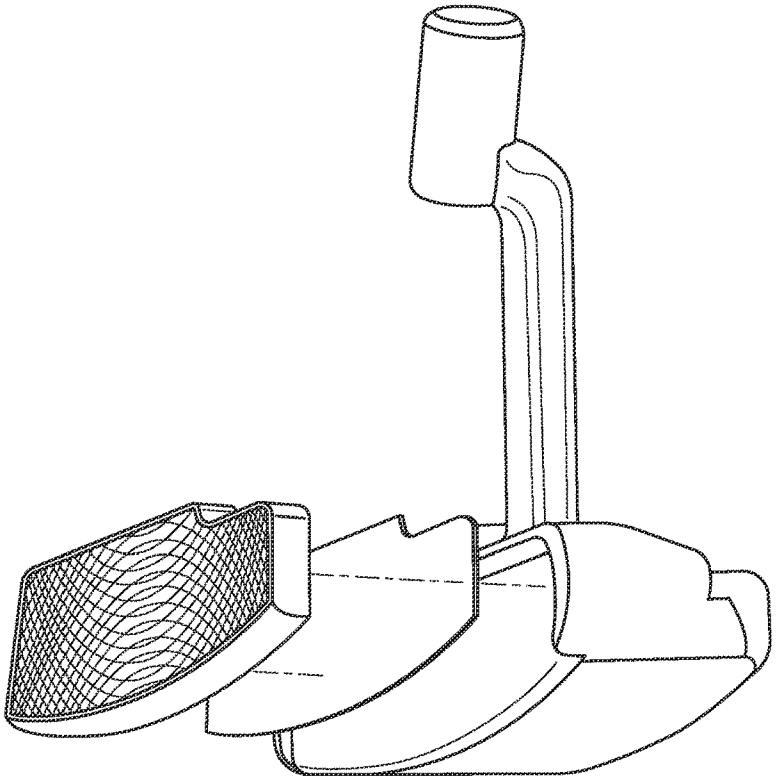
FIG. 11A illustrates an exploded view of a putter type golf club head with at least one strike face insert.

Referring to FIGS. 11A and 11B, in some embodiments, the putter type golf club head can comprise a strike face insert. In these embodiments, the strike face is independently formed prior to being coupled to the club head. The side of the strike face insert that will contact the club head can comprise geometry complementary to the geometry of the corresponding portion of the club head that will contact the strike face. In some embodiments, the strike face insert can be made of the first material or the second material. In other embodiments, the strike face insert can be made of a third material. In some embodiments, the strike face insert can be integrally formed with the upper portion or the lower portion. In other embodiments, the strike face insert can be separately formed from both the upper portion and the lower portion.

The strike face can be secured to the club head by being integrally formed to a portion of the club head or by a fastening means. In some embodiments, the strike face is secured to the upper portion. In these embodiments, the upper portion can comprise an insert cavity. The upper portion insert cavity functions to receive the strike face insert. Further, in these embodiments, when the insert is affixed to the upper portion, the upper portion encompasses and mates with the insert cavity. In other embodiments, the strike face is secured to the lower portion. In these embodiments, the lower portion can comprise an insert cavity. The lower portion insert cavity functions to receive the strike face insert. Further, in these embodiments, when the insert is affixed to the lower portion, the lower portion encompasses and mates with the insert cavity. The strike face can be secured by an adhesive such as glue, very high bond (VHB™) tape, epoxy or another adhesive. Alternately or additionally, the strike face can be secured by welding, soldering, screws, rivets, pins, mechanical interlock structure, or another fastening method.

The strike face insert of these embodiments can comprise any one or layered combination of the following: aluminum, stainless steel, copper, thermoplastic co-polyester elastomer (TPC), thermoplastic elastomer (TPE), thermoplastic urethane (TPU), steel, nickel, TPU/aluminum, TPE/aluminum, plastic/metal screen insert, polyethylene, polypropylene, polytetrafluoroethylene, polyisobutylene, polyvinyl chloride, PEBAX®, or any other desired material. PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. In some embodiments, the face insert can comprise a material such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

The PEBAX® can comprise a percentage of polyether by volume. In some embodiments, the PEBAX® can comprise 0% to 10%, 10% to 20%, 15% to 30%, 20% to 30%, 30% to 40%, 30% to 50%, 30% to 60%, 40% to 50%, 40% to 60%, 50% to 60%, or 60% to 70% polyether by volume. For example, the PEBAX® can comprise 0%, 5%, 10%, 15%, 20%, 25%, 30%, 35%, 40%, 45%, 50%, 55%, 60%, 65%, or 70% of polyether by volume. In some embodiments, the PEBAX® can comprise 0% to 10%, 10% to 20%, 15% to 30%, 20% to 30%, 30% to 40%, 40% to 50%, 40% to 60%, 50% to 60%, or 60% to 70% of polyamide by volume. For example, the PEBAX® can comprise 0%, 5%, 10%, 15%, 20%, 25%, 30%, 35%, 40%, 45%, 50%, 55%, 60%, 65%, or 70% of polyamide by volume. As the percentage of polyether percentage increases, the hardness of the PEBAX® decreases. As the percentage of polyamide percentage increases, the hardness of the PEBAX® increases. For example, the PEBAX® 4033 (Arkema, Paris France) can comprise 40% to 60% polyether by volume and 15% to 30% polyamide by volume. For example, the PEBAX® 6333 (Arkema, Paris France) can comprise 15% to 30% polyether by volume and 40% to 60% polyamide by volume.

In many embodiments, the PEBAX® can comprise a hardness ranging from Shore 25D to Shore 75D. In some embodiments, the hardness of the PEBAX can range from Shore 25D to Shore 35D, Shore 35D to Shore 45D, Shore 36D to Shore 44D, Shore 38D to Shore 42D, Shore 45D to Shore 55D, Shore 55D to Shore 65D, Shore 56D to Shore 64D, Shore 60D to Shore 65D, or Shore 65D to Shore 75D. For example, the hardness of the PEBAX can be Shore D 25, 30, 35, 40, 45, 50, 55, 60, 65, or 70.

In many embodiments, the PEBAX® 4033 (Arkema, Paris France) can comprise a lower hardness than the PEBAX® 6333 (Arkema, Paris France). In many embodiments, the PEBAX® 4033 (Arkema, Paris France) can comprise a hardness range of Shore 35D to Shore 55D. In some embodiments, the PEBAX® 4033 (Arkema, Paris France) can comprise a hardness range of Shore 38D to Shore 42D, or Shore 39D to Shore 41D. For example, the PEBAX® 4033 (Arkema, Paris France) can be comprise a Shore D hardness of 40. In many embodiments, the PEBAX® 6333 (Arkema, Paris France) can comprise a hardness range of Shore 50D to Shore 75D. In some embodiments, the PEBAX® 6333 (Arkema, Paris France) can comprise a hardness range of Shore 55D to Shore 70D, or Shore 60D to Shore 65D. For example, the PEBAX® 6333 (Arkema, Paris France) can comprise a Shore D hardness of 63.

In some embodiments, the face insert can comprise a two-component system. The two-component system can comprise a ball striking face plate and a face insert base. The ball striking face plate of the face insert can comprise a first insert material. The face insert base of the face insert can comprise a second insert material. In many embodiments, the first insert material of the ball striking face plate and the second material of the face insert base can be different. In some embodiments, the first insert material of the ball striking face plate and the second insert material of the face insert base can be similar. In many embodiments, the first insert material of the ball striking face plate can comprise a polymer type material. In some embodiments, the first insert material of the ball striking face plate can comprise a metallic material. In many embodiments, the second insert material of the face insert base can comprise a polymer type material.

The first insert material can comprise a metal such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

The first insert material or the second insert material can comprise a polymer type material. The polymer type material can comprise polyethylene, polypropylene, polytetrafluoroethylene, polyisobutylene, polyvinyl chloride, or any other polymer type material. In many embodiments, the face insert can comprise a PEBAX®. More specifically, the PEBAX® is a polyether block amide that is a thermoplastic elastomer made of a flexible polyether and rigid polyamide. The rigid polyamide can comprise Nylon. The PEBAX® can comprise different compounds that correspond to different Shore D hardness values, polyether percentages, and/or polyamide percentages. In many embodiments, the PEBAX® can comprise a PEBAX® 4033 (Arkema, Paris France) or a PEBAX® 6333 (Arkema, Paris France). The PEBAX® 4033 (Arkema, Paris France) comprises a tetramethylene oxide (53% wt) and a Nylon 12. The PEBAX® 6333 (Arkema, Paris France) comprises a Nylon 11. The first insert material and the second insert material can comprise similar polyether percentages, polyamide percentages, or Shore D hardness values as described above.

The ball striking face plate of the face insert can comprise a thickness. In many embodiments, the thickness of the ball striking face plate can range from 0.015 to 0.115 inch. In some embodiments, the thickness of the ball striking face plate can range from 0.015 to 0.045 inch, 0.020 to 0.050 inch, 0.025 to 0.055 inch, 0.050 to 0.100 inch, 0.055 to 0.105 inch, 0.060 to 0.110, or 0.065 to 0.115 inch. In some embodiments, the thickness of the ball striking face plate can be at least 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate can be greater than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate can be less than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. For example, the thickness of the ball striking face plate can be 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch.

In other embodiments, the thickness of the ball striking face plate can range from 0.115 to 0.40 inch. In some embodiments, the thickness of the ball striking face plate can range from 0.115 to 0.20 inch, 0.15 to 0.30 inch, 0.20 to 0.30 inch, 0.25 to 0.35 inch, or 0.30 to 0.40 inch. In some embodiments, the thickness of the ball striking face plate can be at least 0.15, 0.20, 0.25, 0.30, 0.35, or 0.40 inch. In some embodiments, the thickness of the ball striking face plate can be greater than or equal to 0.15, 0.20, 0.25, 0.30, 0.35, or 0.40. In some embodiments, the thickness of the ball striking face plate can be less than or equal to 0.15, 0.20, 0.25, 0.30, 0.35, or 0.40 inch. For example, the thickness of the ball striking face plate can be 0.15, 0.20, 0.25, 0.30, 0.35, or 0.40 inch.

The face insert base of the face insert can comprise a thickness. In many embodiments, the thickness of the face insert base can range from 0.05 to 0.20 inch. In some embodiment, the thickness of the face insert base can range from 0.05 to 0.10 inch, or 0.10 to 0.20 inch. In some embodiments, the thickness of the face insert base can be at least 0.05, 0.10, 0.15, or 0.20 inch. In some embodiments, the thickness of the face insert base can be greater than or equal to 0.05, 0.10, 0.15, or 0.20 inch. In some embodiments, the thickness of the face insert base can be less than or equal to 0.05, 0.10, 0.15, or 0.20 inch. For example, the thickness of the face insert base can be 0.05, 0.10, 0.15, or 0.20 inch.

In other embodiments, the thickness of the face insert base can range from 0.20 to 0.80 inch. In some embodiments, the thickness of the face insert base can range from 0.20 to 0.50 inch, 0.30 to 0.60 inch, 0.40 to 0.70 inch, or 0.50 to 0.80 inch. In some embodiment, the thickness of the face insert base can range from 0.20 to 0.40 inch, 0.30 to 0.50 inch, 0.40 to 0.60 inch, 0.50 to 0.70 inch, or 0.60 to 0.80 inch. In some embodiments, the face insert base of the face insert can be at least 0.20, 0.25, 0.30, 0.35, 0.40, 0.45, 0.50, 0.55, 0.60, 0.65, 0.70, 0.75, or 0.80 inch. In some embodiments, the face insert base of the face insert can be greater than or equal to 0.20, 0.25, 0.30, 0.35, 0.40, 0.45, 0.50, 0.55, 0.60, 0.65, 0.70, 0.75, or 0.80 inch. In some embodiments, the face insert base of the face insert can be less than or equal to 0.20, 0.25, 0.30, 0.35, 0.40, 0.45, 0.50, 0.55, 0.60, 0.65, 0.70, 0.75, or 0.80 inch. For example, the thickness of the face insert base can be 0.20, 0.25, 0.30, 0.35, 0.40, 0.45, 0.50, 0.55, 0.60, 0.65, 0.70, 0.75, or 0.80 inch.

The face insert can be formed by a number of different processes. The different forming processes include the following: injection molding, casting, blow molding, compression molding, co-molding, laser forming, film insert molding, gas assist molding, rotational molding, thermoforming, laser cutting, 3-D printing, forging, stamping, electroforming, machining, molding, or any combination thereof. Further, the face insert can have any combination of hardness, volume, thickness, and forming processes described above.

In many embodiments, the upper portion of the putter-type golf club head having the first material comprises a first density ranging between 1.0 g/cc and 6.0 g/cc. The first density can range between 2.0 g/cc to 5.0 g/cc. In some embodiments, the first density can range between 1.0-1.25 g/cc, 1.25-1.5 g/cc, 1.5-1.75 g/cc, 1.75-2.0 g/cc, 2.0-2.25 g/cc, 2.25-2.5 g/cc, 2.5-2.75 g/cc, 2.75-3.0 g/cc, 3.25-3.5 g/cc, 3.5-3.75 g/cc, 3.75-4.0 g/cc, 4.0-4.25 g/cc, 4.25-4.5 g/cc, 4.5-4.75 g/cc, 4.75-5.0 g/cc, 5.0-5.25 g/cc, 5.0-5.25 g/cc, 5.25-5.5 g/cc, 5.5-5.75 g/cc, or 5.75-6.0 g/cc. In one embodiment, the first density of the lower portion can range between 2.0-3.0 g/cc. In some embodiments, the first density can be less 6.0 g/cc, less than 5.0 g/cc, less than 4.0 g/cc, less than 3.0 g/cc, or less than 2.0 g/cc. In some embodiments, the first density can be 1.25 g/cc, 1.50 g/cc, 1.75 g/cc, 2.0 g/cc, 2.25 g/cc, 2.50 g/cc, 2.75 g/cc, 3.0 g/cc, 3.25 g/cc, 3.50 g/cc, 3.75 g/cc, 4.0 g/cc, 4.25 g/cc, 4.50 g/cc, 4.75 g/cc, 5.0 g/cc, 5.25 g/cc, 5.50 g/cc, 5.75 g/cc, or 6.0 g/cc.

In many embodiments, the lower portion of the putter-type golf club head having the second material. The second material can comprise a density. The density is a second density to the first density of the first material in the upper portion. The second density of the second material of the lower portion can range between 7.0 g/cc and 20.0 g/cc. In some embodiments, the second density can range between 7.0-7.5 g/cc, 7.5-8.0 g/cc, 8.0-8.5 g/cc, 8.5-9.0 g/cc, 9.0-9.5 g/cc, 9.5-10.0 g/cc, 10.0-10.5 g/cc, 10.5-11.0 g/cc, 11.0-11.5 g/cc, 11.5-12.0 g/cc, 12.0-12.5 g/cc, 12.5-13.0 g/cc, 13.0-13.5 g/cc, 13.5-14.0 g/cc, 14.0-14.5 g/cc, 14.5-15.0 g/cc, 15.0-15.5 g/cc, 15.5-16.0 g/cc, 16.0-16.5 g/cc, 16.5-17.0 g/cc, 17.0-17.5 g/cc, 17.5-18.0 g/cc, 18.0-18.5 g/cc, 18.5-19.0 g/cc, or 19.0-19.5 g/cc, or 19.5-20.0 g/cc. In one embodiment, the second density of the second material in the lower portion can range between 8.0-9.0 g/cc. In some embodiments, the second density can be 7.0 g/cc, 7.5 g/cc, 8.0 g/cc, 8.5 g/cc, 9.0 g/cc, 9.5 g/cc, 10.0 g/cc, 10.5 g/cc, 11.0 g/cc, 11.5 g/cc, 12.0 g/cc, 12.5 g/cc, 13.0 g/cc, 13.5 g/cc, 14.0 g/cc, 14.5 g/cc, 15.0 g/cc, 15.5 g/cc, 16.0 g/cc, 16.5 g/cc, 17.0 g/cc, 17.5 g/cc, 18.0 g/cc, 18.5 g/cc, 19.0 g/cc, 19.5 g/cc, or 20.0 g/cc. In some embodiments, the second density of the lower portion can be at least 2 times greater than the first density, at least 3 times greater than the first density, at least 4 times greater than the first density, or at least 5 times greater than the first density. In some embodiments, the second density can be greater than 7.0 g/cc, greater than 9.0 g/cc, greater than 10.0 g/cc, greater than 11.0 g/cc, or greater than 12.0 g/cc.

The upper portion of the putter-type golf club having the first material can be made from any one or combination of the following: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), aluminum (2.70 g/cc), aluminum alloy (2.64 g/cc-2.81 g/cc), ADC-12 (2.75 g/cc), or any metal suitable for creating a golf club head. In many embodiments, the upper portion is made of aluminum alloy or ADC-12.

The lower portion of the putter-type golf club having the second material can be made from any one or combination of the following: 8620 alloy steel (7.83 g/cc), S25C steel (7.85 g/cc), carbon steel (7.85 g/cc), maraging steel (8.00 g/cc), 17-4 stainless steel (7.81 g/cc), 303 stainless steel (8.03 g/cc), 304 stainless steel (8.00 g/cc), stainless steel alloy (7.75 g/cc-8.05 g/cc), tungsten (19.25 g/cc), aluminum (2.70 g/cc), aluminum alloy (2.64 g/cc-2.81 g/cc), ADC-12 (2.75 g/cc), or any metal suitable for creating a golf club head. In many embodiments, the lower portion is made of 304 stainless steel, 8620 alloy steel, 17-4 stainless steel, or 1380 stainless steel. However, the lower and upper portion are not made from the same one material or the same combination of materials.

Furthermore, the upper and lower portion of the putter-type golf club head can be joined in any one or combination of the following methods: welding, soldering, brazing, swedging, adhesion, epoxy, or mechanical fastening. In some embodiments, the upper and lower portion can be joined by adhesion with epoxy, polyurethanes, resins, hot melts, or any other adhesive.

A. Benefits

The putter-type golf club head provides MOI, CG, feel, and weighting benefits, in a putter-type golf club head with an upper and lower portion having different densities and/or without using mechanically fastened weights or weight ports. By creating an upper portion and lower portion of a putter-type golf club head from two different material, the weighting of the club head shifts towards the peripheries of the putter-type golf club head, without any weight ports or attachments to the heel end and toe end of the putter-type golf club head. This shift in weight, towards the peripheries of the putter-type golf club head, raises the MOI of the club head about the y-axis (Iyy), therefore preventing the rotation about the y-axis and assuring the strike face is square to a golf ball during impact. The increase in MOI about the y-axis helps achieve a straighter ball path and improve the outcome of off-centered hits (impact at the heel end or toe end).

By creating the putter-type golf club head from two portions of two different materials, the putter-type golf club head can be optimized to improve the MOI, while keeping the golf club head at a desirable overall weight. In some embodiments, the moment of inertia of the golf club head about the y-axis center of gravity is between 3500 $g \cdot cm^2$-6500 $g \cdot in^2$. In other embodiments the moment of inertia of the golf club head about the y-axis center of gravity can be between 3500 $g \cdot cm^2$-4000 $g \cdot cm^2$, 4000 $g \cdot cm^2$-4500 $g \cdot cm^2$, 4500 $g \cdot cm^2$-5000 $g \cdot cm^2$, 5000 $g \cdot cm^2$-5500 $g \cdot cm^2$, 5500 $g \cdot cm^2$-6000 $g \cdot cm^2$, or 6000 $g \cdot cm^2$-6500 $g \cdot cm^2$.

The putter-type golf club head with upper and lower portions of two different materials, increases the MOI about the y-axis center of gravity by at least 30% over a putter with the same volume, mass, and single material construction (i.e., a putter milled of a single material such as a steel putter or a putter investment cast of a single material). In some embodiments, the putter-type golf club head with upper and lower portions of two different materials, increases the MOI about the y-axis center of gravity by at least 35%, by at least 40%, by at least 45%, by at least 50%, by at least 55%, by at least 60%, by at least 65%, by at least 70%, by at least 75%, by at least 80%, by at least 85%, by at least 90%, by at least 95%, by at least 95%, by at least 100%, or by at least 105%, over a putter with the same volume, mass, and single material construction.

II. Embodiments a. Blade Embodiment

Figure 1A:
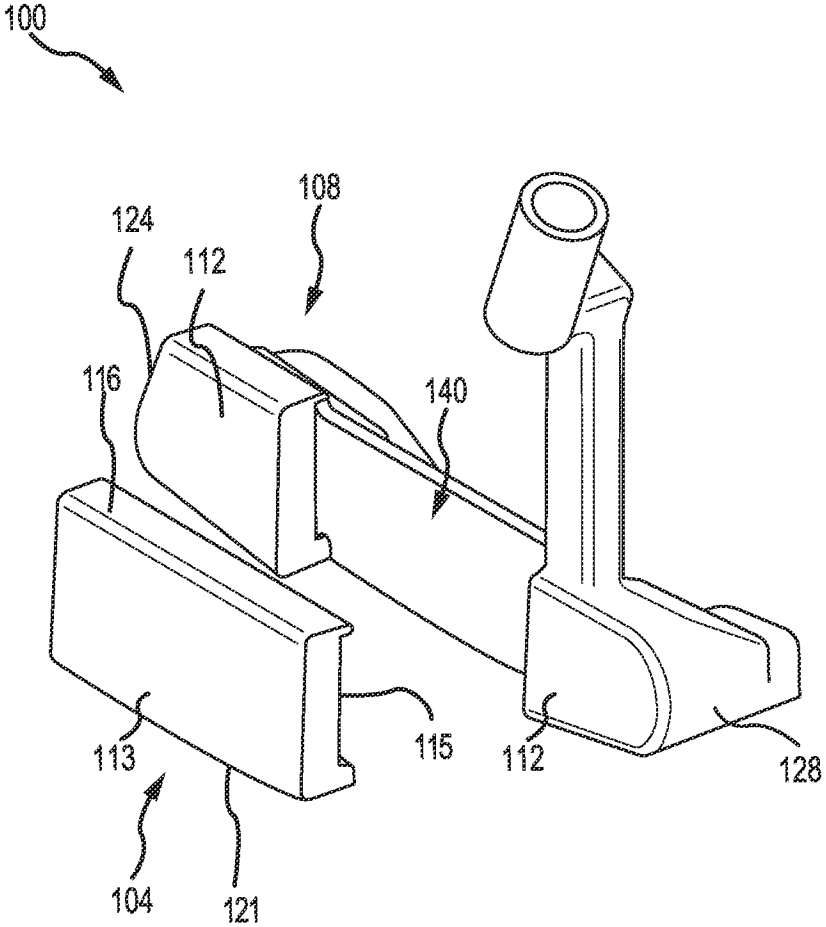
FIG. 1A illustrates an exploded view of a blade putter type golf club head.

In one embodiment, the putter-type golf club head can be a blade type putter head 100. Referring to FIGS. 1A and 1B, the blade type putter head 100 has an upper portion 104 and a lower portion 108. The upper portion 104 is made from a first material having a first density and the lower portion 108 is made from a second material having a second density. The first density is less than the second density. The upper portion 104 and lower portion 108 combine to create a balanced putter head 100, while maintaining a desirable volume and mass.

The lower portion 108 comprises a toe end 124, a heel end 128 opposite the toe end 124, a rear wall 132 opposite a front surface 112, a rear portion 156, and an under surface (not shown). The under surface and the upper portion 104 form a sole 168. The rear wall 132 is opposite and approximately parallel to the front surface 112. The toe end 124 is opposite the heel end 128, while adjacent to the strike face 112 and the rear portion 156. The rear portion 156 spans from the heel end 128 to the toe end 124, while also extending away from the rear wall 132 and the front surface face 112. The rear portion 156 is adjacent the sole. The under surface spans from the heel end 128 to the toe end 124 and is adjacent the rear portion 156 and the front surface 112.

Further, the toe end 124, heel end 128, and front surface 112 of the lower portion 108 forms a recess 140, wherein the recess extends inwards from the front surface 112, towards the rear wall 132. The recess functions to receive the upper portion 104. In most embodiments, the recess 140 comprises a corresponding geometry similar or identical to that of the upper portion 104. When the upper portion 104 is affixed to the lower portion 108, the upper portion 104 encompasses and mates with the lower portion 108 to fit within the recess 140.

Figure 2B:
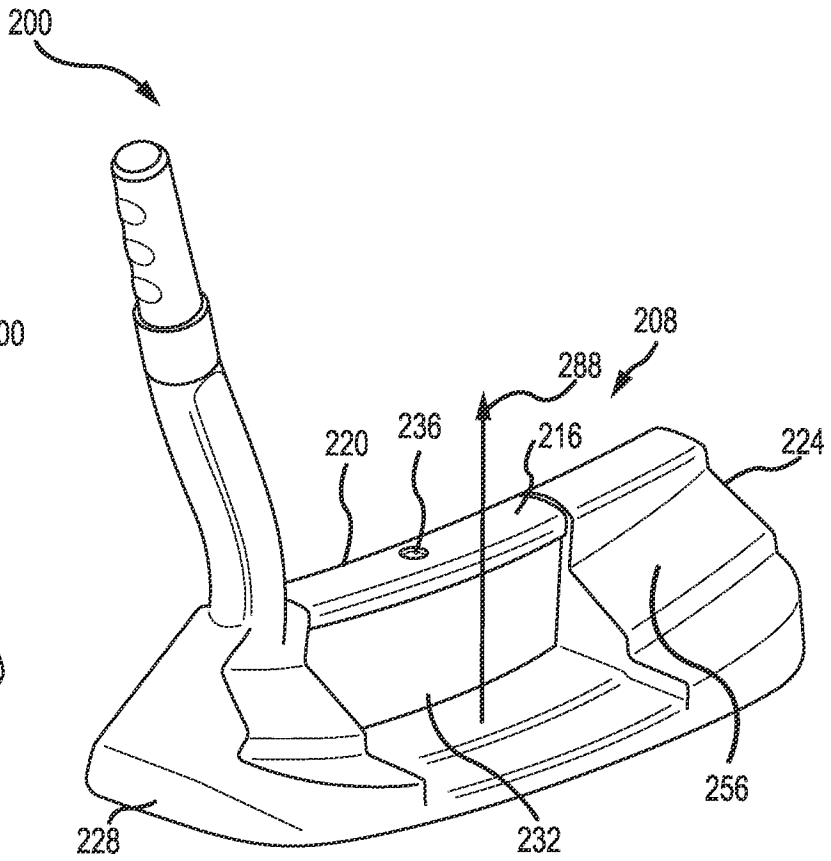
FIG. 2B illustrates an isometric view of the blade putter type golf club head of FIG. 2A.
Figure 2A:
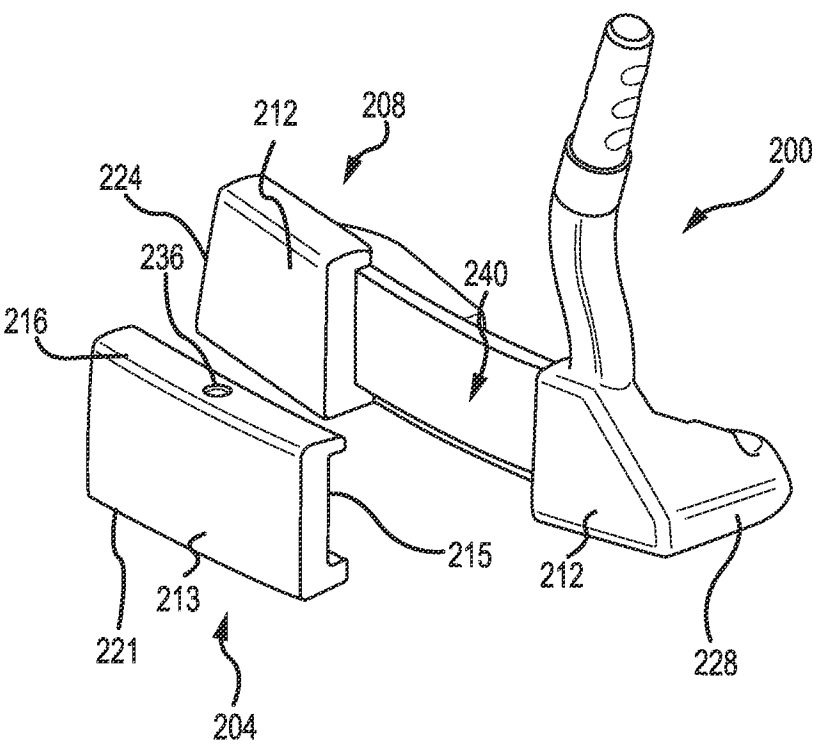
FIG. 2A illustrates an exploded view of a blade putter type golf club head.
Figure 2C:
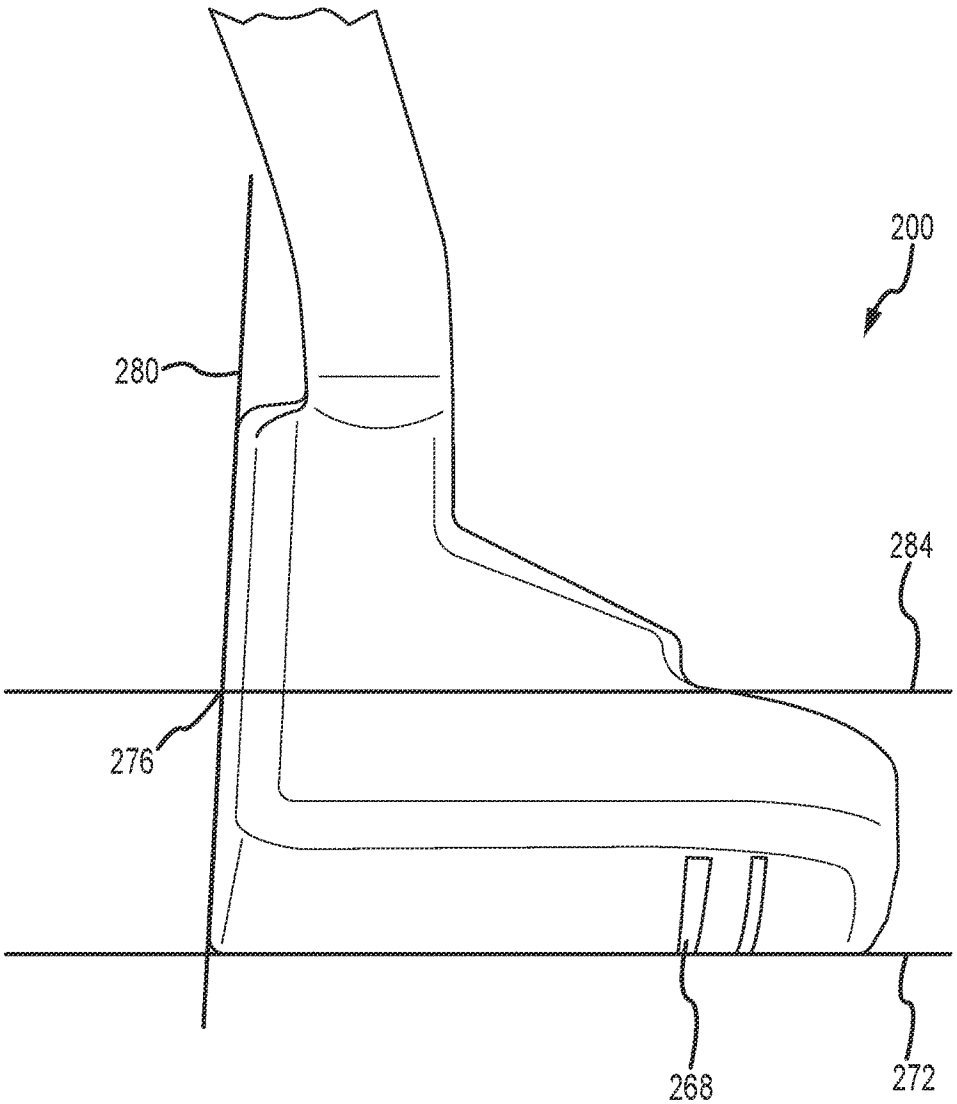
FIG. 2C illustrates a side view of the blade putter type golf club head of FIG. 2A.

The lower portion 108 of the blade type putter head 100 can further comprise an alignment feature 136. The alignment feature 136 can be any one or combination of the following: a line, a circle, a dashed line, a triangle, a channel, or any other desired alignment feature 136. Referring to FIGS. 2A-2C, in some embodiments, the blade type putter head 200 can comprise an alignment feature 236 on the upper portion 204, rather than the lower portion 208.

The upper portion 104 of the blade type putter 100 head comprises a hitting surface 113 and an adhesion surface 115. The hitting surface 113 comprises an upper edge 116 and a lower edge 121, wherein the upper edge 116 is further from a ground plane 172 than the lower edge 116. The ground plane 172 is tangent to the lower portion 108, when the putter head is at an address position to strike a golf ball. The upper edge 116 is adjacent the hitting surface 113 and the adhesion surface 115, while opposite the lower edge 121. In most embodiments, the hitting surface 113 and adhesion surface 115 are parallel, however in other embodiments, the hitting surface 113 and adhesion surface 115 are not parallel.

When the upper portion 104 and lower portion 108 are joined, the adhesion surface 115 is affixed to the recess 140 of the lower portion 108. The hitting surface 113 of the upper portion 104, and the front surface 112 of the lower surface, align to form a strike face 120, that will function to hit strike golf ball.

The lower edge 121 of the upper portion 104, and under surface of the lower portion 108 combine to create the sole 168. The sole 168 is perpendicular to the ground plane 172, wherein the ground plane 172 is tangent to the sole 168, when the putter 100 is at an address position to strike a golf ball. The sole 168 of the putter 100 extends from the toe end 124 of the putter head 100 to the heel end 128 of the putter head 100.

Figure 1C:
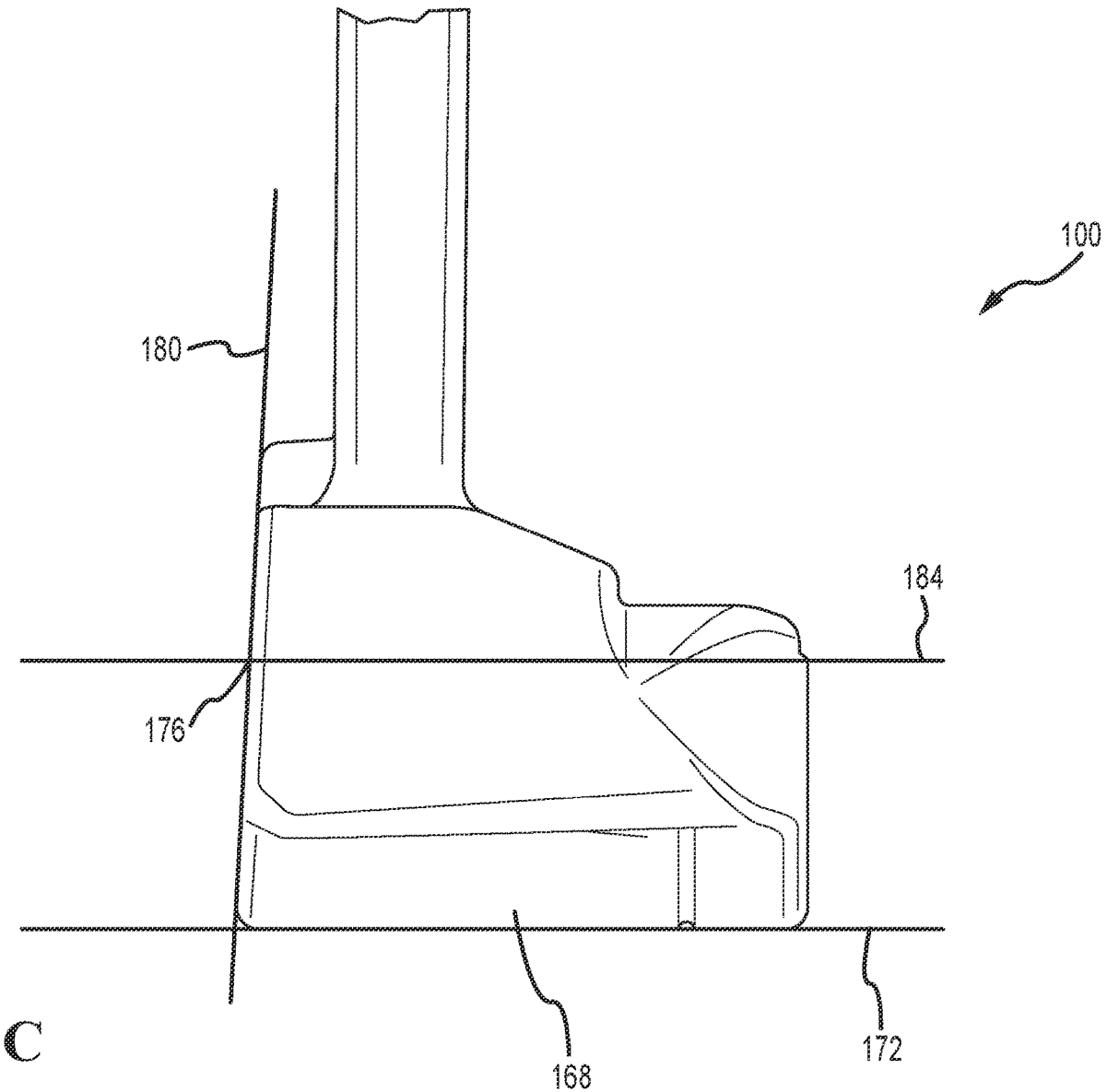
FIG. 1C illustrates a side view of the blade putter type golf club head of FIG. 1A.

Referring to FIG. 1C, in most embodiments, the sole 168 of the putter head 100 can be perfectly flat. In some embodiments, the sole 168 of the putter head 100 can have a slight arch in a heel 128 to toe 124 direction, wherein the slight arch can be linear, or a function of a polynomial. In some embodiments, the sole 168 of the putter head 100 can have a strong arch in the heel 128 to toe 124 direction, wherein the strong arch can be linear, or a function of a polynomial. The sole 168 functions to provide a surface to rest the putter head 100 on the ground plane 172.

The strike face 120 of the blade type putter head 100 comprises a strike face center point 176 and a loft plane 180. The strike face center point 176 is equidistant from the lower edge 120 and upper edge 116 of the strike face 120, as well as equidistant from the heel end 128 and toe end 124 of the blade type putter head 100. The loft plane 180 is tangent to the strike face 112 of the blade type putter head 100. Further, a midplane 184 intersects the strike face center point 176 and is perpendicular to the loft plane 180. Furthermore, a y-axis 188 intersects the strike face center point 176 and is perpendicular to the ground plane 172.

In some embodiments, when the lower portion 108 and the upper portion 104 are joined, the upper edge 116 of the upper portion 104 can protrude in a direction away from the strike face 120, overlaying at least a portion of the rear wall 132 of the lower portion 108. Further, the lower edge 121 of the upper portion 104 can protrude in a direction away from the strike face 120, towards at least a portion of the under surface of the lower portion 108, thereby making up a portion of the sole 168. In these embodiments, the rear wall 132 of the lower portion 108 does not make up a portion of the sole 168.

The combination of the low density first material upper portion 104 with the high density second material lower portion 108, increases the MOI of the putter 100, over a putter of unitary, solid block construction. The two part construction (upper portion 104 and lower portion 108) of the putter 100, moves denser material towards the heel 128 and toe 124, while placing lighter material (the upper portion 104) near the center, thereby increasing the MOI of the putter 100, since more mass is further from the center of gravity. The denser material of the lower portion helps increase the MOI of the putter-type golf club head by shifting the weight of the putter head 100 towards the outer portions of the putter-type golf club head. A single material putter fails to allocate high density material to the periphery. In some embodiments, the putter-type golf club head 100 with upper 104 and lower portions 108 of two different materials, increases the MOI about the y-axis center of gravity by at least 15% over a putter with the same volume, mass, and single material construction.

b. Crescent Embodiment

Figure 3B:
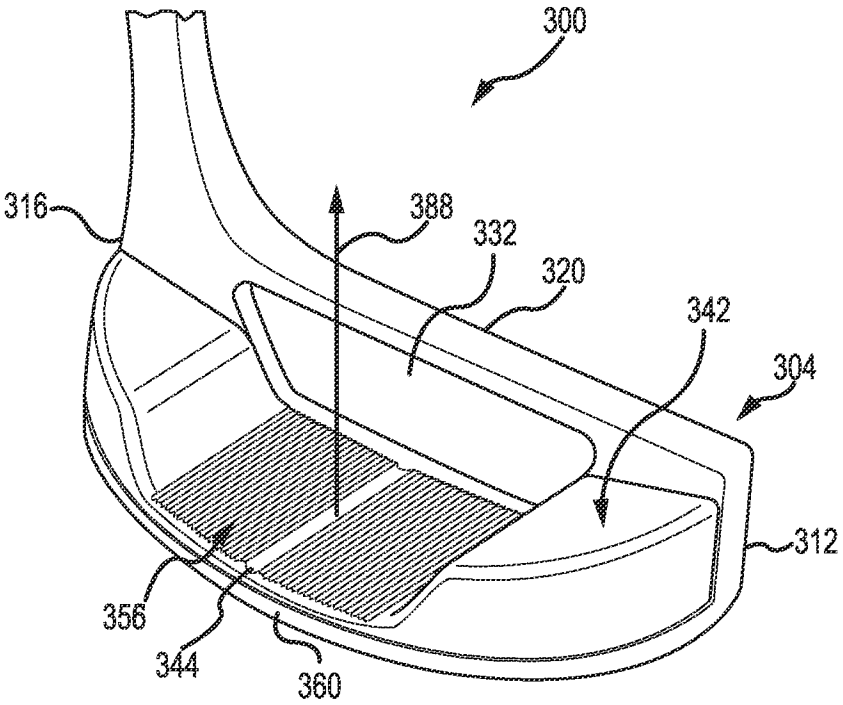
FIG. 3B illustrates an isometric view of the crescent putter type golf club head of FIG. 3A.
Figure 3A:
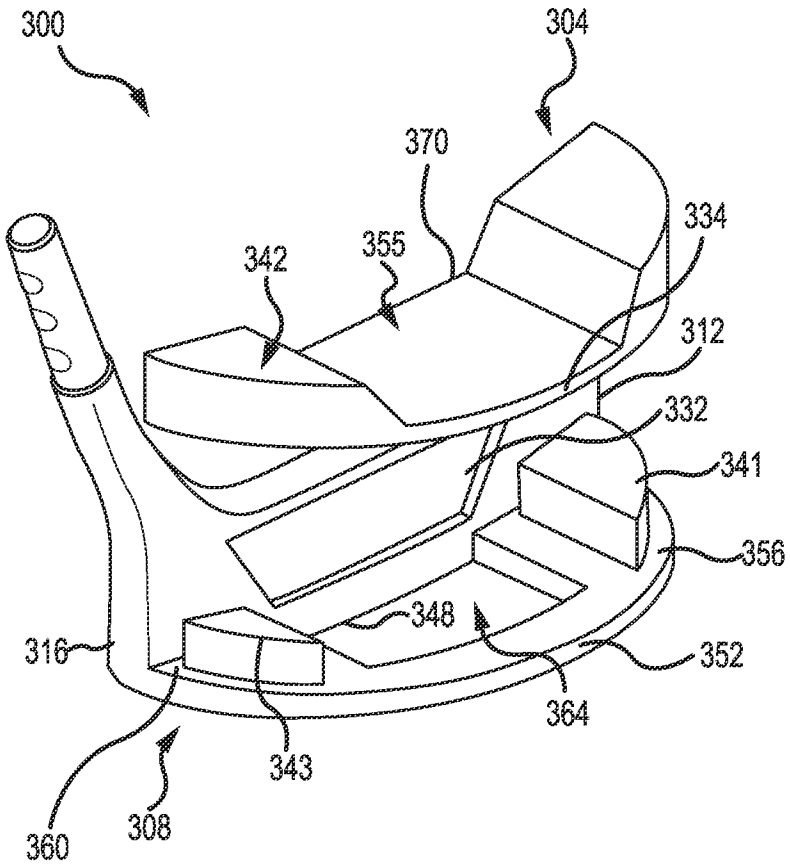
FIG. 3A illustrates an exploded view of a crescent putter type golf club head.
Figure 3C:
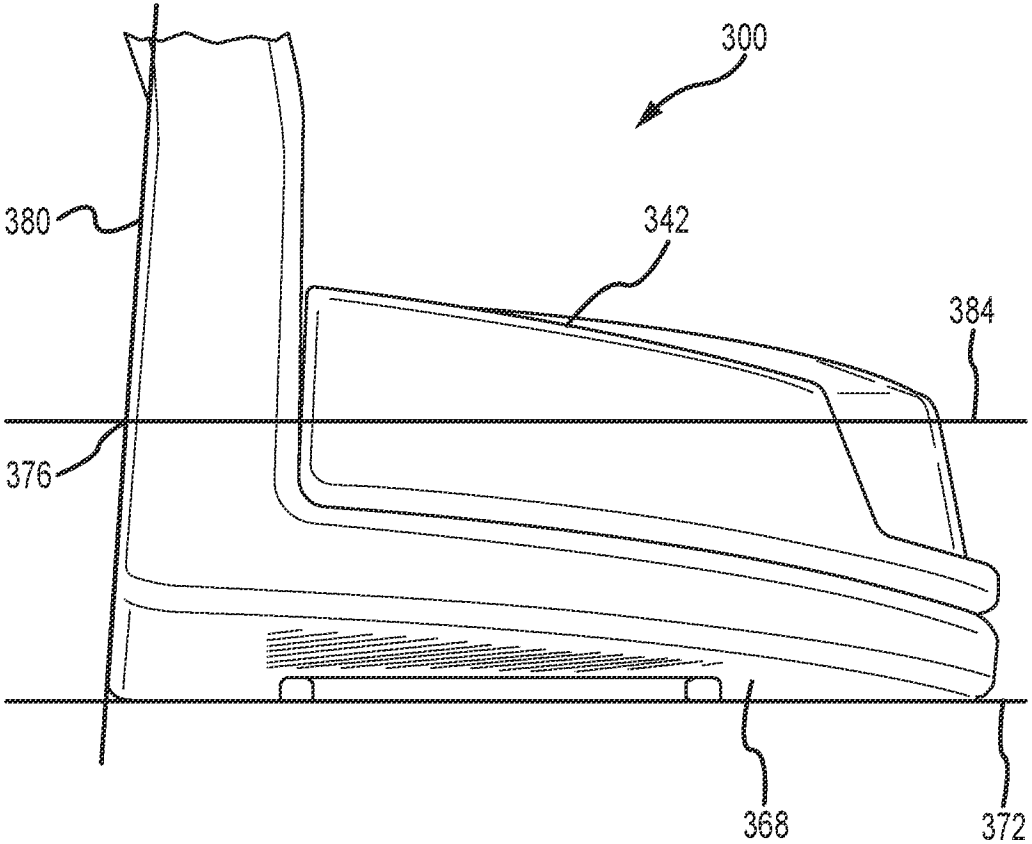
FIG. 3C illustrates a side view of the crescent putter type golf club head of FIG. 3A.

In one embodiment, the putter-type golf club head can be a crescent-shaped putter head 300. Referring to FIG. 3A-3C, the crescent-shaped putter head 300 has a upper portion 304 and a lower portion 308. The upper portion 304 is made from a first material have a first density and the lower portion 308 is made from a second material having a second density. The first density is less than the second density. The upper portion 304 and lower portion 308 combine to create a balanced putter head 300, while maintaining a desirable volume and mass. The high density lower portion 308 and low density upper portion 308, place more mass near the peripheries of the putter head 300, thus increasing the MOI and stability over a putter with the same volume, mass, and single material construction.

As discussed above, the lower portion 308 is comprised of a high-density material (i.e., the second material). The lower portion 308 comprises a rear periphery 352, a toe end 312, a heel end 316, a strike face 320, a rear wall 332, a back edge 334, a crown 342, and an under surface (not shown). The under surface and the upper portion 304 form a sole 368. The toe end 312 is opposite the heel end 316. The toe end 312 and the heel end 316 of the lower portion 308 respectively comprise a toe side periphery 356 and a heel side periphery 356. The strike face 320 spans from the toe end 312 to the heel end 316 and is opposite the rear wall 332. The rear wall 332 is opposite, and approximately parallel to, the strike face 320. The lower portion further comprises a heel side periphery 360, a toe side periphery 356, a front edge 316, and a upper edge 312.

The front edge 348 is adjacent to the toe side periphery 356 and the heel side periphery 360, and opposite to the rear periphery 352. The toe side periphery 356 is adjacent to the front edge 348 and the rear periphery 352, and opposite and to the heel side periphery 360. The heel side periphery 360 is also adjacent to the front edge 348 and the rear periphery 352, but opposite to the toe side periphery 356.

In most embodiments, the toe side periphery 356 extends perpendicularly from the front edge 348, towards the rear periphery 352, such that a right angle (90° angle) is formed at the junction of the toe side periphery 356 and the front edge 348. However, in other embodiments, the toe side periphery 356 can extend from the front edge 348 in any direction, such that any angle (0°-180°) can be formed at the junction of the toe side periphery 356 and the front edge 348. Further, in most embodiments, the heel side periphery 360 extends perpendicularly from the front edge 348, such that a right angle (90° angle) is formed at the junction of the heel side periphery 360 and the front edge 348. However, in other embodiments, the heel side periphery 360 can extend from the front edge 348 in any direction, such that any angle (0°-180°) can be formed at the junction of the heel side periphery 360 and the front edge 348.

The front edge 348, toe side periphery 356, and heel side periphery 360 form an aperture 364. The aperture 336 is bounded by the front edge 348 the toe side periphery 356, and the heel side periphery 360. The aperture 364 shifts a majority of the volume and mass of the putter to the extremities of the lower portion 308. The aperture 336 can comprise any shape, however in one embodiment the aperture 364 is approximately rectangular. In other embodiments, the aperture 364 can be circular, curvilinear, triangular, trapezoidal, parabolic, golf ball shaped, square, or any other desired geometric shape.

The upper portion 304 of the putter head 300 comprises a crown 342, a front edge 370, and a back edge 334. The crown 342 extends away from the front edge 370 to the back edge 364 of the upper portion 304. The under surface is opposite the crown 342, spanning from the front edge 348 to the back edge 334.

In some embodiments, the heel side periphery 360 and toe side periphery 356 can be parallel, while in some embodiments, the heel side periphery 360 and toe side periphery 356 are not parallel. In some embodiments, the rear periphery 352 and front edge 348 can be parallel, while in some embodiments, the rear periphery 352 and front edge 348 are not parallel. The rear periphery 352 of the crescent-shaped putter head 300 is approximately crescent-shaped, and therefore, the rear periphery 352 and front edge 348 are not parallel. The rear periphery 352 can be curvilinear spanning from the heel side periphery 360 to the toe side periphery 356. The rear periphery 352 comprises a curve length measured along the rear periphery 352 from the junction between the heel side periphery 360 and the rear periphery 352 to the junction between the toe side periphery 356 and the rear periphery 352. In some embodiments, the rear periphery 352 curve length can be between 4.5 inches and 6.5 inches. In some embodiments, the rear periphery curve length can be 4.5 inches-4.75 inches, 4.75 inches-5.0 inches, 5.0 inches-5.25 inches, 5.25 inches-5.5 inches, 5.5 inches-5.75 inches, 5.75 inches-6.0 inches, 6.0 inches-6.25 inches, or 6.25 inches-6.5 inches.

When the upper portion 304 and the lower portion 308 are joined, the crown 342 extends between the strike face 320 to the rear periphery 352. The crown 342, in most embodiments, spans approximately inward 25% of the total club head 300 width from the toe side periphery 356 and spans approximately inward 25% of the total club head 300 width from the heel side periphery 360. In other embodiments, the crown 342 can, continuously or discontinuously, span the entire width of the total club head 300, in a heel 316 to toe 312 direction. In some embodiments, the crown 342, can span less than 90% of the total width of the club head 300, less than 80% of the total width of the club head 300, less than 70% of the total width of the club head 300, less than 60% of the total width of the club head 300, less than 50% of the total width of the club head 300, less than 40% of the total width of the club head 300, or less than 30% of the total width of the club head 300. Further, in some embodiments, the crown 342 can be substantially flat from the strike face 320 to the back edge 334 or ascend from the strike face 320 to the back edge 334. In most embodiments, the ascent or descent of the crown 342 can be linear, curvilinear, parabolic, sinusoidal, or a function of polynomial.

The crown 342 further comprises an alignment trough 355, wherein the alignment trough 355 is equidistant from the heel end 316 and the toe end 312. The alignment trough 355 is adjacent the rear wall 328 and approximately perpendicular to the strike face. The alignment trough 356 is bounded by the back edge 334, the rear wall 332, and the crown 342 on the heel end 316 and the toe end 312. In most embodiments, the alignment trough is approximately the width of a golf ball (approximately 4.27 cm) to provide the viewer a visual alignment field that extends the width of the golf ball.

Furthermore, the upper portion 304 of the putter head 300 can comprise one or more alignment features 344 on the crown 342. The alignment feature 344 can be any one or combination of the following: a line, a series of lines, milling troughs, a circle, a dashed line, a triangle, a channel, or any other desired alignment feature 344. The alignment features 344 can be equally spaced on the entire crown 342, a portion of the crown 342, or the alignment trough 355. The alignment features 344, extending along the alignment trough 355, function to provide the viewer a visual alignment field that extends the width of the golf ball, from the rear wall 332 to the back edge 334 of the putter 300. The goal is to align the entire putter 300 with the golf ball using these alignment features 344 along the crown 342 and/or the alignment trough 355.

Referring to FIG. 3C, the upper portion 304 can be affixed to the lower portion 308 such that the upper portion 304 is further from a ground plane than the lower portion 308, wherein the ground plane 372 is tangent to the lower portion 304, when the putter head 300 is at an address position to strike a golf ball.

Referring to FIG. 3C, the strike face 320 of the putter head 300 comprises a strike face center point 376 and a loft plane 380. The strike face center point 376 is equidistant from the crown 342 and the under surface of the upper portion 304, as well as equidistant from the heel end 316 and toe end 312 of the putter head 300. The loft plane 380 is tangent to the strike face 320 of the putter head 300. Further, a midplane 316 intersects the strike face center point 376 and is perpendicular to the loft plane 380. Furthermore, referring to FIG. 3B, a y-axis 388 intersects the midplane 384, and is perpendicular to the ground plane 372.

When the upper portion 304 and lower portion 308 are joined such that the heel end 316 overlays at least a portion of the toe side periphery 356. Further, when the upper portion 304 and lower portion 308 are joined such that the toe end 312 overlays at least a portion of the heel side periphery 360. Further still, when the upper portion 304 and lower portion 308 are joined such that the strike face 320 overlays at least a portion of the front edge 316. Finally, the upper portion 304 and lower portion 308 are joined such that the back edge 364 overlays at least a portion of the rear periphery 332.

The front edge 316, rear periphery 332, toe side periphery 356, and heel side periphery 360 of the lower portion 308, combined with the upper portion 304, create the sole 368. The sole 368 is perpendicular to the ground plane 372, wherein the ground plane 372 is tangent to the sole 368, when the putter head 300 is at an address position to strike a golf ball. The sole 368 of the putter head 300 extends from the toe end 312 of the putter head 300 to the heel end 316 of the putter head 300.

In most embodiments, the sole 368 of the putter head 300 can be perfectly flat. In some embodiments, the sole 368 of the putter head 300 can have a slight arch in a heel 324 to toe 320 direction, wherein the slight arch can be linear, or a function of a polynomial. In some embodiments, the sole 368 of the putter head 300 can have a strong arch in the heel 324 to toe 320 direction, wherein the strong arch can be linear, or a function of a polynomial. The sole 368 functions to provide a surface to rest the putter head 300 on the ground plane 372.

Referring to FIG. 3A, in one embodiment, the lower portion 308 can further comprise a toe mass 341 and a heel mass 343. The toe mass 341 and heel mass 343 are integral to the lower portion 308 and are in contact with the toe side periphery 356 and heel side periphery 360, respectively. The toe mass 341 and heel mass 343 extend from the lower portion 308, in a direction away from the ground plane 372, and toward the upper portion 304. The toe mass 341 and heel mass 343 provide a means to position and align the upper portion 304 with the lower portion 308 of the putter head 300.

Furthermore, the toe mass 341 and heel mass 343 provide an additional means of adding weight to the perimeters for increasing the MOI of the crescent-shaped putter head 300 when compared with putters without these mass features. These mass features can have weights that range from 2-5 grams, 3-7 grams or 1-6 grams. The mass features can have all the same weight or be different weight within the ranges provided above. The weight of the mass features can be 1 gram, 2 grams, 3 grams, 4 grams, 5 grams, 6 grams, or 7 grams. The toe mass 341 and a heel mass 343 can respectively be any one or combination of the following shapes: rectangular, triangular, pyramidal, spherical, crescent-shaped, square, cylindrical, ovular, elliptical, trapezoidal, pentagonal, hexagonal, octagonal, or any other desired geometric or non-geometric shape.

Referring to FIG. 3A, the toe mass 341 and heel mass 343 can be positioned away from the rear periphery 352, wherein the toe mass 341 and heel mass 343 do not touch or intersect with the rear periphery 352. However, in other embodiments, the toe mass 341 and heel mass 343, can be positioned on the rear periphery 352, wherein the toe mass 341 and heel mass 343 are integral to and intersect the rear periphery 352.

In one embodiment, the toe mass 341 is positioned on the front edge 348, at the junction of the toe side periphery 356 and the front edge 348, however in other embodiments the toe mass 341 can be positioned anywhere along the toe side periphery 356. In one embodiment, the heel mass 343, is positioned on the front edge 348, at the junction of the heel side periphery 360 and the front edge 348, however in other embodiments the heel mass 343 can be positioned anywhere along the heel side periphery 360.

The toe mass 341 and heel mass 343 provide areas of concentrated mass, such that the toe mass 341 and heel mass 343 function to increase the moment of inertia of the putter head 300. The placement of the toe mass 341 and the heel mass 343 on or near the front edge 316 and on or near the toe side periphery 356 and heel side periphery 360, respectively, increases the MOI since the toe mass 341 and the heel mass 343 are farther from a center of gravity of the putter 300. The toe mass 341 and the heel mass 343 can be integrally formed from the second material, wherein the second material is denser than the first material.

The toe mass 341 and heel mass 343 offer dual functionalities, such that the toe mass 341 and heel mass 343 function not only to increase the MOI of the putter 300 but provide additional surfaces for the upper portion 304 to join to the lower portion 308. Therefore, the toe mass 341 can also be referred to as a front toe adhesion portion 341 and the heel mass 343 can also be referred to as a front heel adhesion portion 343.

In some embodiments, the under surface, crown 342, front edge 370, and back edge 334 of the upper portion 304, can form a first cavity (not shown). The first cavity extends inwards from the under surface, on the toe end 312, towards the crown 342 but does not reach the crown 342. The first cavity is bounded by the back edge 334, the crown 342, and the front edge 370. The first cavity functions to receive the toe mass 341 of the lower portion 308.

In some embodiments, the under surface, crown 342, front edge 370, and back edge 334 of the upper portion 304, can form a second cavity (not shown). The second cavity extends inwards from the under surface, on the heel end 316, towards the crown 342 but does not reach the crown 342. The second cavity is bounded by the back edge 334, the crown 342, and the front edge 370. The second cavity functions to receive the heel mass 343 of the lower portion 308.

The first and second cavities can comprise any desired geometry. However, in most embodiments, the first and second cavity comprise a geometry similar or identical to that of the corresponding toe mass 341 or the heel mass 343. Further, when the upper portion 304 is affixed to the lower portion 308, the first cavity is positioned such that the first cavity encompasses the toe mass 341, and the second cavity is positioned such that the second cavity encompasses the heel mass 343.

The combination of the low density first material upper portion 304 with the high density second material lower portion 308, creates a high MOI putter 300, without creating an extremely heavy putter. The large aperture 364 formed by the rear wall 332, the rear periphery 352, the toe side periphery 356, and the heel side periphery 360 of the lower portion 308 forms a dense, yet low volume portion that increases the MOI of the putter, in comparison to a putter milled from a single material. A single material putter fails to allocate high density material to the periphery, while maintaining a desirable volume (50 cc-75 cc) and mass (340 grams-385 grams).

The lower portion 308, in most embodiments, comprises less than 38% of a volume of the putter 300. In some embodiments, the lower portion 308 comprises less than 37% of the total volume of the putter 300, less than 36% of the total volume of the putter 300, less than 35% of the total volume of the putter 300, less than 34% of the total volume of the putter 300, less than 33% of the total volume of the putter 300, less than 32% of the total volume of the putter 300, less than 31% of the total volume of the putter 300, less than 30% of the total volume of the putter 300, less than 29% of the total volume of the putter 300, less than 28% of the total volume of the putter 300, or less than 27% of the total volume of the putter 300.

Although the lower portion 308 comprises less than half of the volume of the putter 300, the lower portion 308 comprises at least 45% of an overall mass of the putter 300. In some embodiments, the lower portion 308 comprises at least 46% of the mass of the putter 300, at least 46% of the mass of the putter 300, at least 47% of the mass of the putter 300, at least 48% of the mass of the putter 300, at least 49% of the mass of the putter 300, at least 50% of the mass of the putter 300, at least 51% of the mass of the putter 300, at least 52% of the mass of the putter 300, at least 53% of the mass of the putter 300, at least 54% of the mass of the putter 300, or at least 55% of the overall mass of the putter 300.

The beneficial shift of mass to the periphery of the putter head 300 increases the MOI of the putter 300, over a putter with the same volume, mass, and single material construction (i.e., a putter milled of a single stainless steel block, or a putter investment cast of a single material).

c. Semi-Circular Embodiment

Figure 4B:
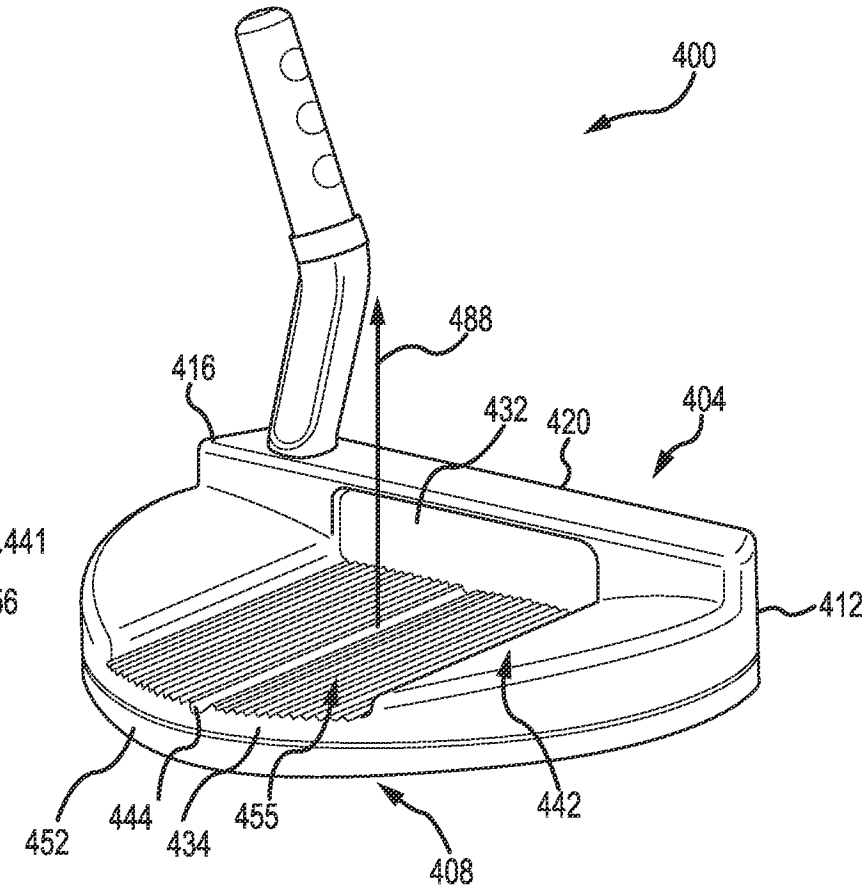
FIG. 4B illustrates an isometric view of the semi-circular putter type golf club head of FIG. 4A.
Figure 4A:
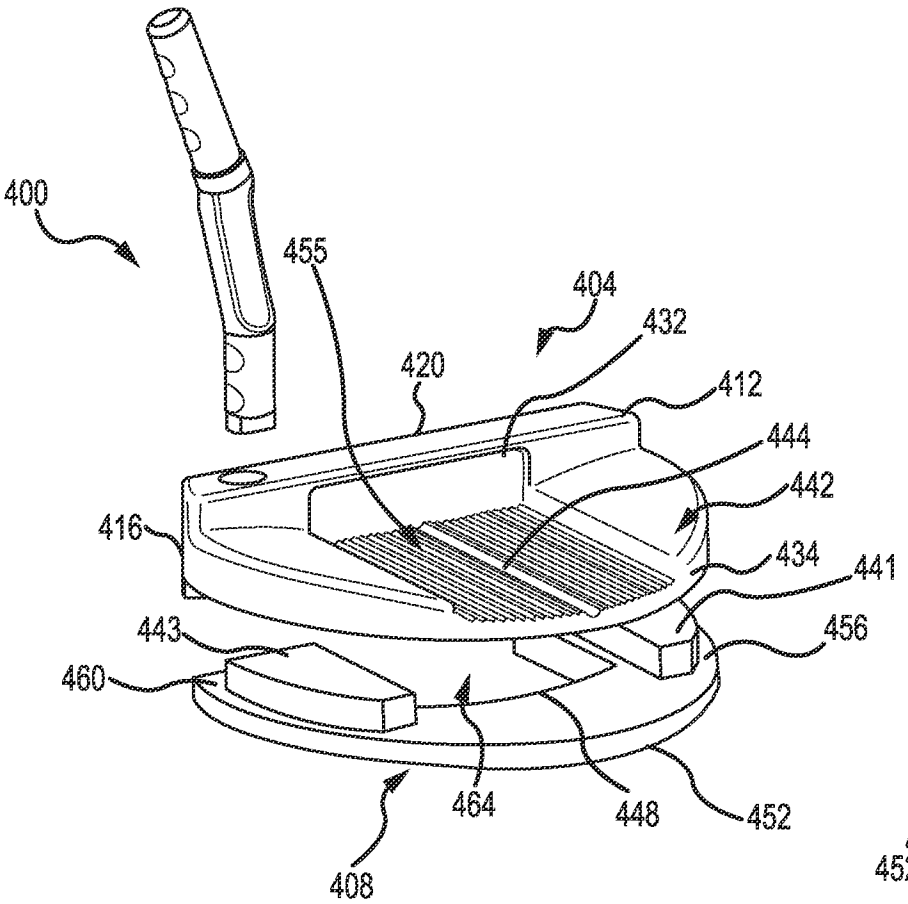
FIG. 4A illustrates an exploded view of a semi-circular putter type golf club head.
Figure 4C:
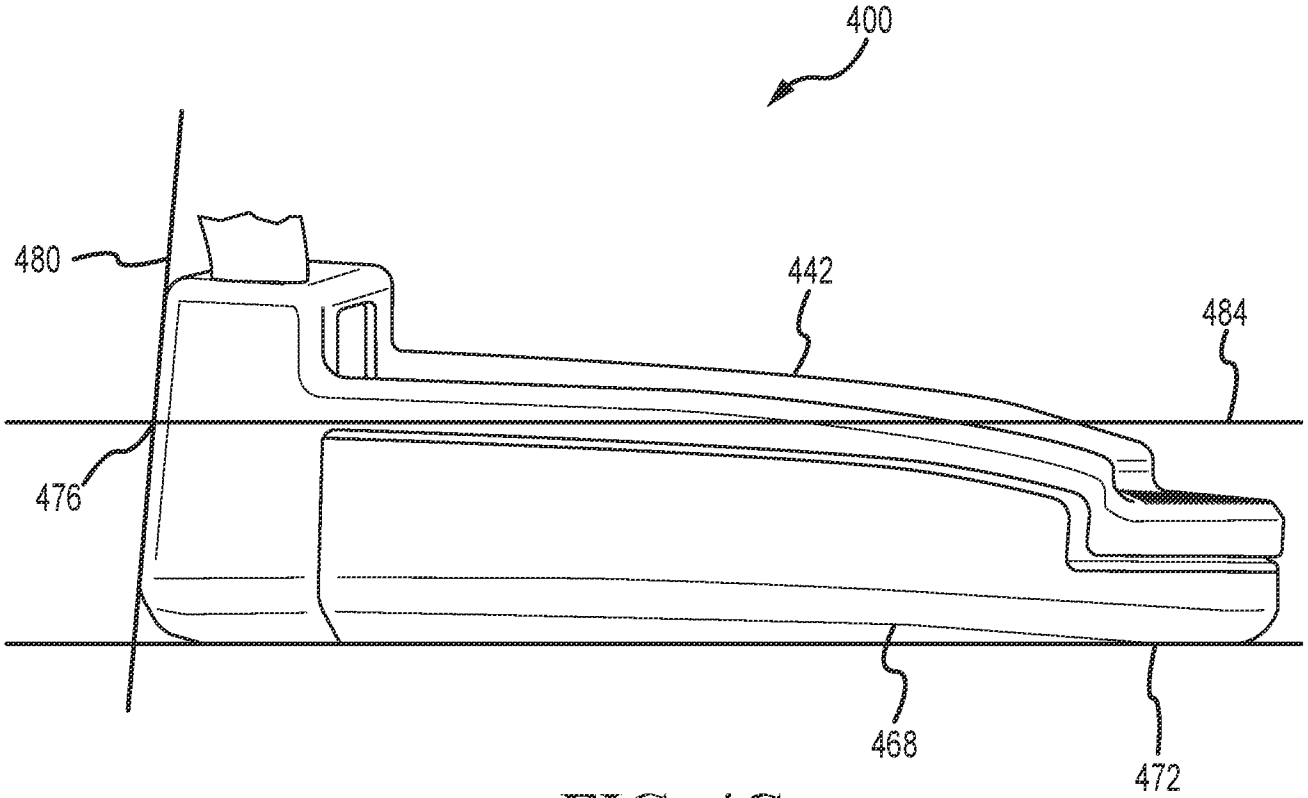
FIG. 4C illustrates a side view of the semi-circular putter type golf club head of FIG. 4A.
Figure 5B:
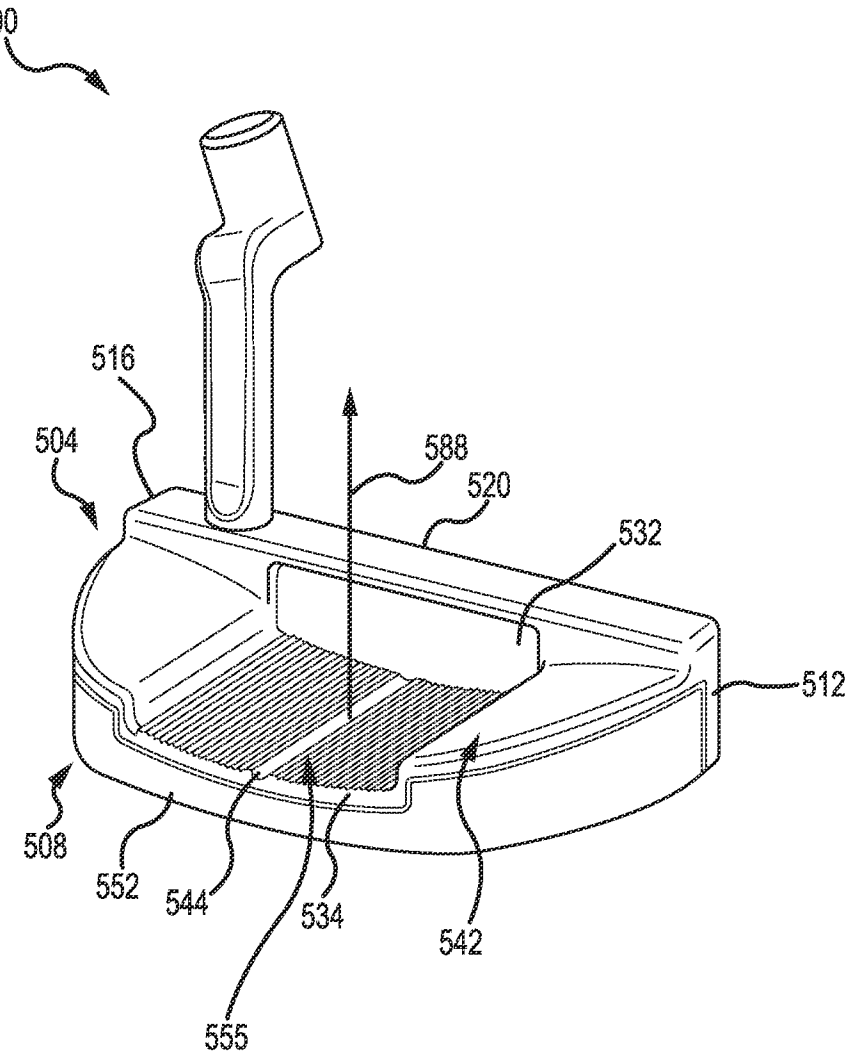
FIG. 5B illustrates an isometric view of the semi-circular putter type golf club head of FIG. 5A.
Figure 5A:
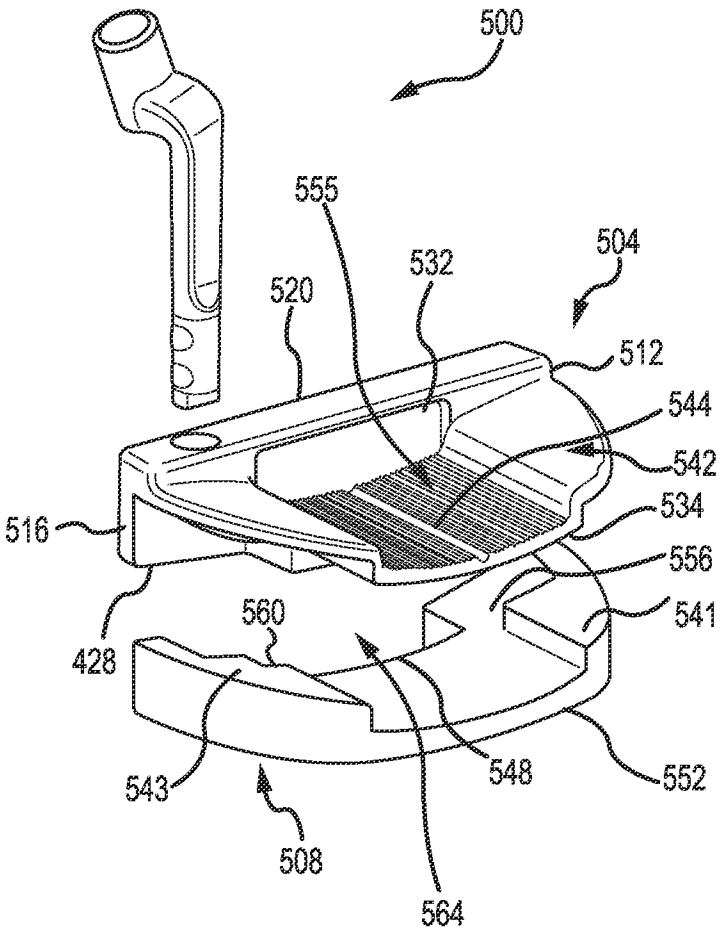
FIG. 5A illustrates an exploded view of another semi-circular putter type golf club head.
Figure 5C:
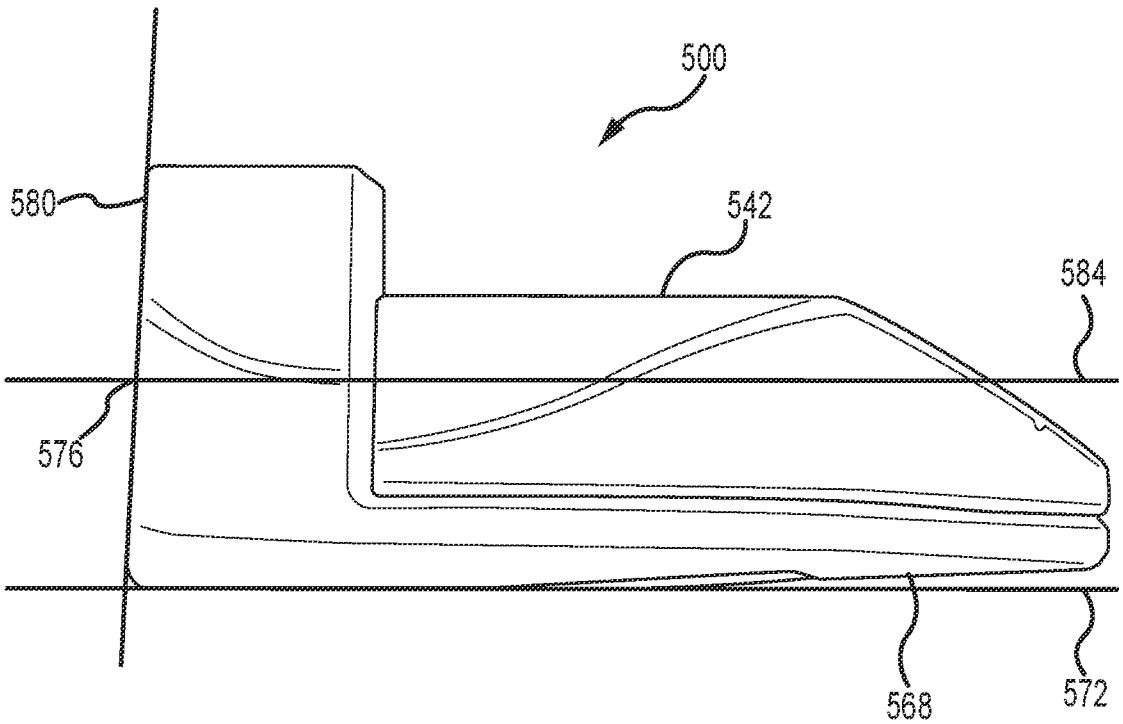
FIG. 5C illustrates a side view of the semi-circular putter type golf club head of FIG. 5A.

In one embodiment, the putter-type golf club head can be a semi-circular shaped putter head 400. Referring to FIG. 4A-4C, the semi-circular putter head 400 has an upper portion 404 and a lower portion 408. The upper portion 404 is made from a first material have a first density and the lower portion 408 is made from a second material having a second density. The first density is less than the second density. The upper portion 404 and lower portion 408 combine to create a high-MOI putter head 400 (5000 g-cm$^2$-6500 g·cm$^2$), while maintaining a desirable volume and mass.

As discussed above, the lower portion 408 is comprised of a high-density material (i.e., the second material). The lower portion 408 comprises a front edge 448, a rear periphery 452, a toe side span 456, and a heel side span 460. The lower portion 408 and an under surface of the top portion 404 combine to create a sole 468. The front edge 448 is adjacent to the toe side span 456 and the heel side span 460, and opposite to the rear periphery 452. The toe side span 456 is adjacent to the front edge 448 and the rear periphery 452, and opposite and to the heel side span 460. The heel side span 460 is also adjacent to the front edge 448 and the rear periphery 452, but opposite to the toe side span 456. The toe side span 456 and heel side span 460, extend beyond the rear periphery 448 of the upper portion 404. In some embodiments, the heel side span 460 and toe side span 456 can be parallel, while in some embodiments, the heel side span 460 and toe side span 456 are not parallel. In some embodiments, the rear periphery 452 and front edge 448 can be parallel, while in some embodiments, the rear periphery 452 and front edge 448 are not parallel. In this embodiment, the rear periphery 452 is approximately semi-circular, thus the rear periphery 452 and front edge 448 are not parallel.

In most embodiments, the toe side span 456 extends perpendicularly from the front edge 448, such that a right angle (90° angle) is formed at the junction of the toe side span 456 and the front edge 448. However, in other embodiments, the toe side span 456 can extend from the front edge 448 in any direction, such that any angle (0°-180°) can be formed at the junction of the toe side span 456 and the front edge 448. Further, in most embodiments, the heel side span 460 extends perpendicularly from the front edge 448, such that a right angle (90° angle) is formed at the junction of the heel side span 460 and the front edge 448. However, in other embodiments, the heel side span 460 can extend from the front edge 448 in any direction, such that any angle (0°-180°) can be formed at the junction of the heel side span 460 and the front edge 448.

The front edge 448, toe side span 456, and heel side span 460 form a gap 464. The gap 464 is bounded by the front edge 448, the toe side span 456, and the heel side span 460. The gap 464 formed by the front edge 448, the toe side span 456, and the heel side span 460 shifts a majority of the volume and mass of the putter to the extremities of the lower portion 408. The gap 464 can comprise any shape, however in one embodiment the gap is approximately rectangular. In other embodiments, the gap 464 can be circular, curvilinear, triangular, trapezoidal, parabolic, golf ball shaped, square, or any other desired geometric shape.

The upper portion 404 of the putter head 400 comprises a toe end 412, a heel end 416, a strike face 420, a rear wall 432, a back edge 434, a crown 442, and an under surface (not pictured). The toe end 412 is opposite the heel end 416. The strike face 420 spans from the toe end 412 to the heel end 416 and is opposite the rear wall 432. The rear wall 432 is opposite, and approximately parallel to the strike face 420. The crown 442 extends away from the strike face 420 to the back edge 434 of the upper portion 404. Furthermore, the under surface is opposite the crown 442, spanning from the strike face 420 to the back edge 434.

The crown 442 further descends from the strike face 420 to the back edge 434. Additionally, the crown 442 extends away from the strike face 420, over the front edge 448 of lower portion 408, and to the back edge 434 of the upper portion 404. The crown 442, in most embodiments, spans approximately inward 25% of the total club head 400 width from the toe side span 456 and spans approximately inward 25% of the total club head 400 width from the heel side span 460. In other embodiments, the crown 442 can, continuously or discontinuously, span the entire width of the total club head 400, in a heel to toe direction. In some embodiments, the crown 442, can span less than 90% of the total width of the club head 400, less than 90% of the total width of the club head 400, less than 80% of the total width of the club head 400, less than 70% of the total width of the club head 400, less than 60% of the total width of the club head 400, less than 50% of the total width of the club head 400, less than 40% of the total width of the club head 400, or less than 30% of the total width of the club head 400. Further, in some embodiments, the crown 442 can be substantially flat from the strike face 420 to the back edge 434 or ascend from the strike face 420 to the back edge 434. In most embodiments, the ascent or descent of the crown 442 can be linear, curvilinear, parabolic, sinusoidal, or a function of polynomial.

The crown 442 further comprises an alignment trough 455, wherein the alignment trough 455 is equidistant from the heel end 416 and the toe end 412. The alignment trough 455 is adjacent the rear wall 432 and approximately perpendicular to the strike face 420. The alignment trough 455 is bounded by the back edge 434, the rear wall 432, and the crown 442 on the heel end 416 and the toe end 412. In most embodiments, the alignment trough 455 is approximately the width of a golf ball (approximately 4.27 cm) to provide the viewer a visual alignment field that extends the width of the golf ball.

Furthermore, the upper portion 404 of the putter head 400 can comprise one or more alignment features 444 on the crown 442. The alignment feature 444 can be any one or combination of the following: a line, a series of lines, milling troughs, a circle, a dashed line, a triangle, a channel, or any other desired alignment feature 444. The alignment features 444 can be equally spaced on the entire crown 442, a portion of the crown 442, or the alignment trough 455. The alignment features 444, extending along the alignment trough 455, function to provide the viewer a visual alignment field that extends the width of the golf ball, from the rear wall 432 to the back edge 434 of the putter 400. The goal is to align the entire putter 400 with the golf ball using these alignment features 444 along the crown 442 and/or the alignment trough 455.

Referring to FIG. 4C, the upper portion 404 is affixed to the lower portion 408 such that the upper portion 404 is further from a ground plane 472 than the lower portion 408, wherein the ground plane 472 is tangent to the lower portion 404, when the putter head 400 is at an address position to strike a golf ball.

Further, the strike face 420 of the putter head 400 comprises a strike face center point 476 and a loft plane 480. The strike face center point 476 is equidistant from the crown 442 and the undersurface of the upper portion 404, as well as equidistant from the heel end 416 and toe end 412 of the putter head 400. The loft plane 480 is tangent to the strike face 420 of the putter head 400. Further, a midplane 484 intersects the strike face center point 476 and is perpendicular to the loft plane 480. Furthermore, a y-axis 488 intersects the midplane 484, and is perpendicular to the ground plane 472.

When the upper portion 404 and lower portion 408 are joined such that the heel end 416 overlays at least a portion of the toe side span 456. Further, when the upper portion 404 and lower portion 408 are joined such that the toe end 412 overlays at least a portion of the heel side span 460. Further still, when the upper portion 404 and lower portion 408 are joined such that the strike face 420 overlays at least a portion of the front edge 448. Finally, the upper portion 404 and lower portion 408 are joined such that the back edge 434 overlays at least a portion of the rear periphery 452.

The rear periphery 452 can be curvilinear spanning from the heel side 416 to the toe side 416. The rear periphery 452 comprises a curve length measured along the rear periphery 452 from the junction between the heel side 416 and the rear periphery 452 to the junction between the toe side 416 and the rear periphery 452. In some embodiments, the rear periphery 452 curve length can be between 4.5 inches and 8.0 inches. In some embodiments, the rear periphery 452 curve length can be 4.5 inches-4.75 inches, 4.75 inches-5.0 inches, 5.0 inches-5.25 inches, 5.25 inches-5.5 inches, 5.5 inches-5.75 inches, 5.75 inches-6.0 inches, 6.0 inches-6.25 inches, 6.25 inches-6.5 inches, 6.5 inches-6.75 inches, 6.75 inches-7.0 inches, 7.25 inches-7.50 inches, 7.50 inches-7.75 inches, or 7.75 inches-8.0 inches.

The front edge 448, rear periphery 452, toe side span 456, and heel side span 460 of the lower portion 408, combined with the upper portion 404, create the sole 468. The sole 468 is perpendicular to the ground plane 472, wherein the ground plane 472 is tangent to the sole 468, when the putter head 400 is at an address position to strike a golf ball. The sole 468 of the putter head 400 extends from the toe end 412 of the putter head 400 to the heel end 416 of the putter head 400.

In most embodiments, the sole 468 of the putter head 400 can be perfectly flat. In some embodiments, the sole 468 of the putter head 400 can have a slight arch in a heel 416 to toe 412 direction, wherein the slight arch can be linear, or a function of a polynomial. In some embodiments, the sole 468 of the putter head 400 can have a strong arch in the heel 416 to toe 412 direction, wherein the strong arch can be linear, or a function of a polynomial. The sole 468 functions to provide a surface to rest the putter head 400 on the ground plane 472.

Referring to FIG. 4A, in one embodiment, the lower portion 408 can further comprise a front toe mass 441 and a front heel mass 443. The front toe mass 441, front heel mass 443 are integral to the lower portion 408. The front toe mass 441 and front heel mass 443 extend from the lower portion 408, in a direction away from the ground plane 472, and toward the upper portion 404. These mass portions provide a means to position and align the upper portion 404 with the lower portion 408 of the putter head 400. Furthermore, these mass portions (i.e., the front toe mass 441 and front heel mass 443) provide an additional means of adding weight to the perimeters for increasing the MOI of the putter 400 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front toe mass 441 and a front heel mass 443 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In FIG. 4A, the front toe mass 441 and front heel mass 443 are positioned away from the rear periphery 452, wherein the front toe mass 441 and front heel mass 443 do not touch or intersect with the rear periphery 452. However, referring to FIG. 5A-5C, an alternate semi-circular shaped putter 500 is illustrated below. Putter 500 comprises the same features as putter 400, however the front toe mass 541 and front heel mass 543 of putter 500, are positioned on the rear periphery 552, wherein the front toe mass 541 and front heel mass 53 are integral to and intersect the rear periphery 452.

In one embodiment, the front toe mass 441 is positioned on the front edge 448, at the junction of the toe side span 456 and the front edge 448, however in other embodiments the front toe mass 441 can be positioned anywhere along the toe side span 456. In one embodiment, the front heel mass 443, is positioned on the front edge 448, at the junction of the heel side span 460 and the front edge 448, however in other embodiments the front heel mass 443 can be positioned anywhere along the heel side span 460.

The front toe mass 441 and front heel mass 443 provide areas of concentrated mass, such that each mass 441, 443 function to increase the moment of inertia of the putter head 400. The placement of each mass 441, 443 on the front edge 448 and spans 456, 460 increases the MOI since each mass 441, 443 since each mass is farther from a center of gravity of the putter 400. Each mass 441, 443 on the periphery 448 and spans 456, 460 is integrally formed from the second material, wherein the second material is denser than the first material.

The front toe mass 441 and front heel mass 443 offer dual functionalities, such that the front toe mass 441 and front heel mass 443 function not only to increase the MOI of the putter 400 but provide additional surfaces for the upper portion 404 to join to the lower portion 408. Therefore, the front toe mass 441 can also be referred to as a front toe adhesion portion 441 and the front heel mass 443 can also be referred to as a front heel adhesion portion 443.

In some embodiments, the under surface, strike face 420, and rear wall 432 of the upper portion 408, can form a first cavity (not shown). The first cavity extends inwards from the under surface, on the toe end 412, towards the crown 442 but does not reach the crown 442. The first cavity is bounded by the rear wall 432, the strike face 420, and the toe 412. The first cavity functions to receive the front toe mass 441 of the lower portion 408.

In some embodiments, the under surface, strike face 420, and rear wall 432 of the upper portion 408, can form a second cavity (not shown). The second cavity extends inwards from the under surface, on the heel end 416, towards the crown 442 but does not reach the crown 442. The second cavity is bounded by the rear wall 432, the strike face 420, and the heel 416. The second cavity functions to receive the front heel mass 443 of the lower portion 408.

The first and second cavity can comprise any desired geometry, however in most embodiments, the first and second cavity comprise a geometry similar or identical to that of the front toe mass 441 and the front heel mass 443. Further, when the upper portion 704 is affixed to the lower portion 408, the first cavity is positioned such that the first cavity encompasses the front toe mass 441, and the second cavity is positioned such that the second cavity encompasses the front heel mass 443.

The combination of the low density first material upper portion 404 with the high density second material lower portion 408, creates a high MOI putter 400, without creating an extremely heavy putter. The large gap 464 formed by the rear periphery 452 and the spans 456, 460 of the lower portion 408 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 408, in most embodiments, comprises less than 38% of a volume of the putter 400. In some embodiments, the lower portion 408 comprises less than 37% of the total volume of the putter 400, less than 36% of the total volume of the putter 400, less than 35% of the total volume of the putter 400, less than 34% of the total volume of the putter 400, less than 33% of the total volume of the putter 400, less than 32% of the total volume of the putter 400, less than 31% of the total volume of the putter 400, less than 30% of the total volume of the putter 400, less than 29% of the total volume of the putter 400, less than 28% of the total volume of the putter 400, or less than 27% of the total volume of the putter 400.

Although the lower portion 408 comprises less than half of the volume of the putter 400, the lower portion 408 comprises at least 45% of an overall mass of the putter 400. In some embodiments, the lower portion 408 comprises at least 46% of the mass of the putter 400, at least 46% of the mass of the putter 400, at least 47% of the mass of the putter 400, at least 48% of the mass of the putter 400, at least 49% of the mass of the putter 400, at least 50% of the mass of the putter 400, at least 51% of the mass of the putter 400, at least 52% of the mass of the putter 400, at least 53% of the mass of the putter 400, at least 54% of the mass of the putter 400, or at least 55% of the mass of the putter 400.

The beneficial shift of mass to the periphery of the putter head 400, through the use of a high density, low volume lower portion 408, increases the MOI of the putter 400, over a putter with the same volume, mass, and single material construction (i.e., a putter milled of a single stainless steel block, or a putter investment cast of a single material).

d. Winged Embodiment

Figure 6B:
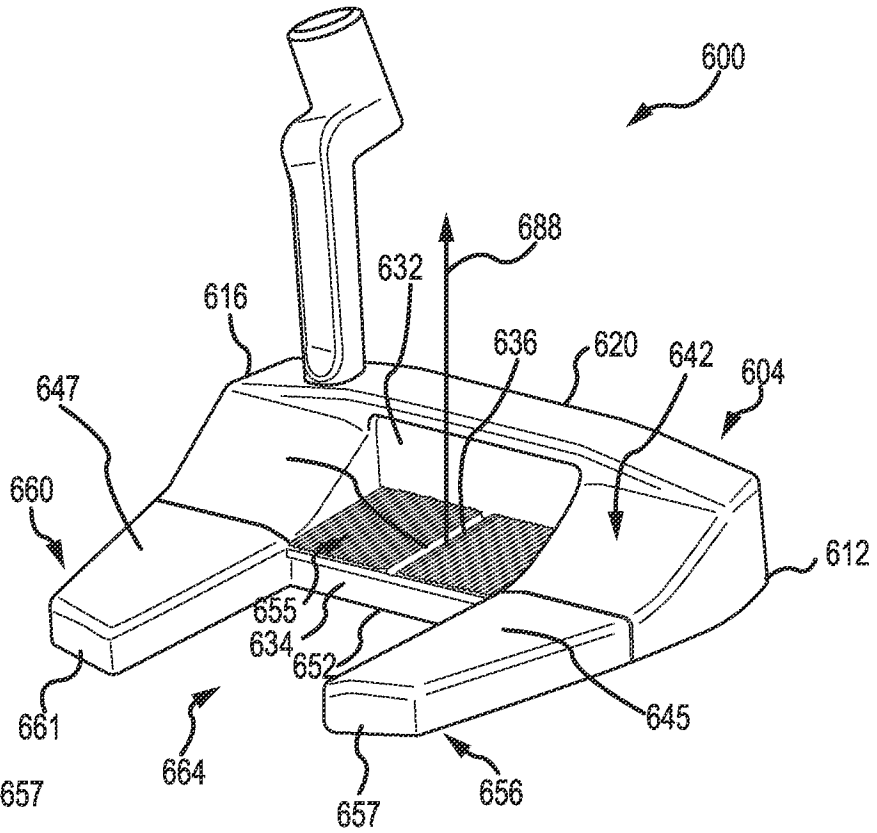
FIG. 6B illustrates an isometric view of the winged putter type golf club head of FIG. 6A.
Figure 6A:
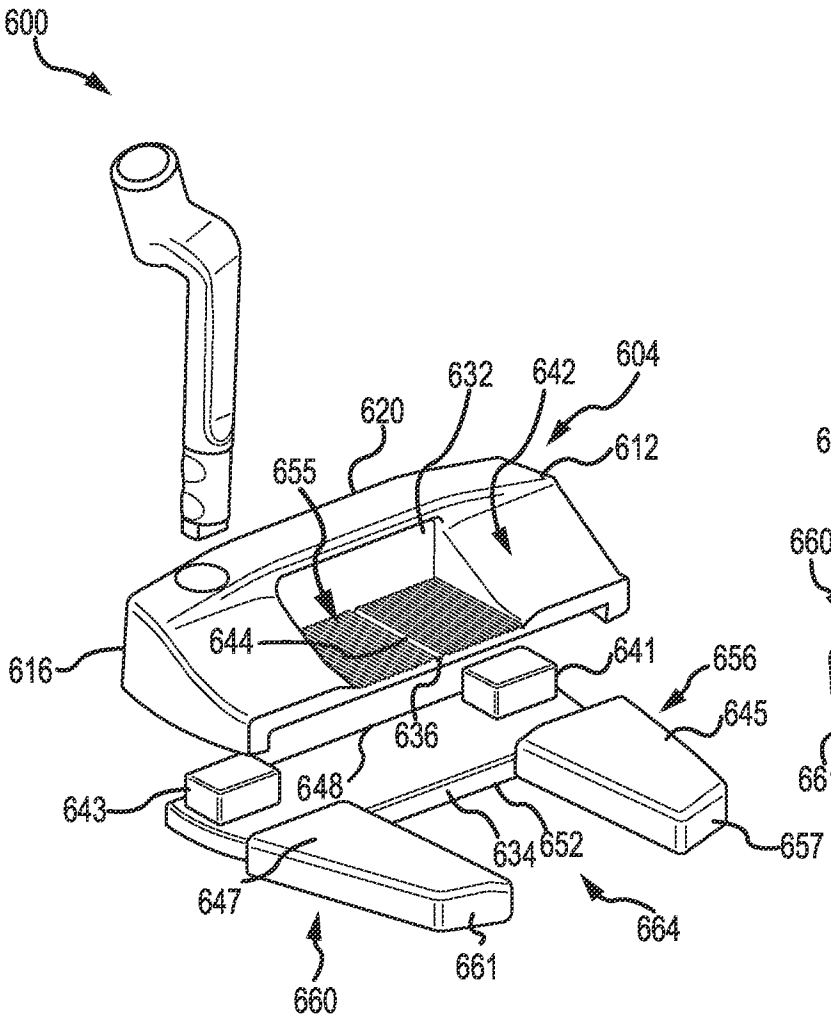
FIG. 6A illustrates an exploded view of a winged putter type golf club head.

In one embodiment, the putter-type golf club head can be a winged shaped putter head with periphery spans 600. Referring to FIGS. 6A and 6B, the winged shaped putter head 600 has a upper portion 604 and a lower portion 608. The upper portion 604 is made from a first material have a first density and the lower portion 608 is made from a second material having a second density. The first density is less than the second density. The upper portion 604 and lower portion 608 combine to create a high-MOI putter head 600 (5000 $g \cdot cm^2$-6500 $g \cdot cm^2$), while maintaining a desirable volume and mass.

As discussed above, the lower portion 608 is comprised of a high-density material (i.e., the second material). The lower portion 608 comprises a front periphery 648, a sole 668, a rear periphery 652, a toe side wing 656, and a heel side wing 660. As discussed below, FIG. 6C, the front periphery 648, rear periphery 652, toe side wing 656, and heel side wing 660 of the lower portion 608, combined with the upper portion 604, create a sole 668. The front periphery 648 is adjacent to the toe side periphery 656 and the heel side periphery 660, and opposite to the rear periphery 652. The toe side wing 656 is adjacent to the front periphery 648 and the rear periphery 652, and opposite to the heel side wing 660. The heel side wing 660 is also adjacent to the front periphery 648 and the rear periphery 652, but opposite to the toe side wing 656. The toe side wing 656 and heel side wing 660, extend beyond the rear periphery 648 of the upper portion 604. In some embodiments, the heel side wing 660 and toe side wing 656 can be parallel, while in some embodiments, the heel side wing 660 and toe side wing 656 are not parallel. In some embodiments, the rear periphery 652 and front periphery 648 can be parallel, while in some embodiments, the rear periphery 652 and front periphery 648 are not parallel.

In most embodiments, the toe side wing 656 extends perpendicularly from the rear periphery 652, such that a right angle (90° angle) is formed at the junction of the toe side wing 656 and the rear periphery 652. However, in other embodiments, the toe side wing 656 can extend from the rear periphery 652 in any direction, such that any angle (0°-180°) can be formed at the junction of the toe side wing 656 and the rear periphery 652. Further, in most embodiments, the heel side wing 660 extends perpendicularly from the rear periphery 652, such that a right angle (90° angle) is formed at the junction of the heel side wing 660 and the rear periphery 652. However, in other embodiments, the heel side wing 660 can extend from the rear periphery 652 in any direction, such that any angle (0°-180°) can be formed at the junction of the heel side wing 660 and the rear periphery 652.

The front periphery 648, of the lower portion 608, comprises a front width. The front width is measured from the junction of the toe side wing 656 and the front periphery 648, to the junction of the heel side wing 660 and the front periphery 648. Further, the lower portion 608, comprises a rear width. The rear width is measured from a tip 657 of the toe side wing 656 and a tip 661 of a toe side wing 660, wherein the tip 657 is the point of the toe side wing 656 furthest from the front periphery 648 and the tip 661 is the point of the heel side wing 660 furthest from the front periphery 648. In most embodiments, the front width is greater than the rear width, however in some embodiments, the front width can be equal to or less than the rear width.

The rear periphery 652, toe side wing 656, and heel side wing 660 form a gap 664. The gap 664 is bounded by the rear periphery 652, the toe side wing 656, and the heel side wing 660. The gap 664 formed by the rear periphery 652, the toe side wing 656, and the heel side wing 660 shifts a majority of the volume and mass of the putter to the extremities of the lower portion 608. The gap 664 can comprise any shape, however in one embodiment the gap is approximately rectangular. In other embodiments, the gap 664 can be circular, curvilinear, triangular, trapezoidal, parabolic, golf ball shaped, square, or any other desired geometric shape.

The upper portion 604 of the putter head 600 comprises a toe end 612, a heel end 616, a strike face 620, a rear wall 632, a back edge 634, a crown 642, and an under surface (not pictured). The toe end 612 is opposite the heel end 616. The strike face 620 spans from the toe end 612 to the heel end 616 and is opposite the rear wall 632. The rear wall 632 is opposite, and approximately parallel to the strike face 620. The crown 642 extends away from the strike face 620 and to the back edge 634 of the upper portion 604. Furthermore, the under surface is opposite the crown 642, spanning from the strike face 620 to the back edge 634.

The crown 642 further descends from the strike face 620 to the back edge 634. Additionally, the crown 642 extends away from the strike face 620, over the front periphery 648 of lower portion 608, and to the back edge 634 of the upper portion 604. The crown 642, in most embodiments, spans approximately inward 25% of the total club head 600 width from the toe side wing 656 and spans approximately inward 25% of the total club head 600 width from the heel side wing 660. In other embodiments, the crown 642 can, continuously or discontinuously, span the entire width of the total club head 600, in a heel to toe direction. In some embodiments, the crown 642, can span less than 90% of the total width of the club head 600, less than 90% of the total width of the club head 600, less than 80% of the total width of the club head 600, less than 70% of the total width of the club head 600, less than 60% of the total width of the club head 600, less than 50% of the total width of the club head 600, less than 40% of the total width of the club head 600, or less than 30% of the total width of the club head 600. Further, in some embodiments, the crown 642 can be substantially flat from the strike face 620 to the back edge 634 or ascend from the strike face 620 to the back edge 634. In most embodiments, the ascent or descent of the crown 642 can be linear, curvilinear, parabolic, sinusoidal, or a function of polynomial.

The crown 642 further comprises an alignment trough 655, wherein the alignment trough 655 is equidistant from the heel end 616 and the toe end 612. The alignment trough 655 is adjacent the rear wall 632 and approximately perpendicular to the strike face 620. The alignment trough 655 is bounded by the back edge 634, the rear wall 632, and the crown 642 on the heel end 616 and the toe end 612. In most embodiments, the alignment trough is approximately the width of a golf ball (approximately 4.27 cm) to provide the viewer a visual alignment field that extends the width of the golf ball.

Furthermore, the upper portion 604 of the putter head 600 can comprise one or more alignment features 644 on the crown 642. The alignment feature 644 can be any one or combination of the following: a line, a series of lines, milling troughs, a circle, a dashed line, a triangle, a channel, or any other desired alignment feature 644. The alignment features 644 can be equally spaced on the entire crown 642, a portion of the crown 642, or the alignment trough 655. The alignment features 644, extending along the alignment trough 655, function to provide the viewer a visual alignment field that extends the width of the golf ball, from the rear wall 632 to the back edge 634 of the putter 600. The goal is to align the entire putter 600 with the golf ball using these alignment features 644 along the crown 642 and/or the alignment trough 655.

The upper portion 604 is affixed to the lower portion 608 such that the upper portion 604 is further from a ground plane 672 than the lower portion 608, wherein the ground plane 672 is tangent to the lower portion 604, when the putter head 600 is at an address position to strike a golf ball.

Further, the strike face 620 of the putter head 600 comprises a strike face center point 676 and a loft plane 680. The strike face center point 676 is equidistant from the crown 642 and the undersurface of the upper portion 604, as well as equidistant from the heel end 616 and toe end 612 of the putter head 600. The loft plane 680 is tangent to the strike face 620 of the putter head 600. Further, a midplane 684 intersects the strike face center point 676 and is perpendicular to the loft plane 680. Furthermore, a y-axis 688 intersects the midplane 648, and is perpendicular to the ground plane 672.

When the upper portion 604 and lower portion 608 are joined such that the heel end 616 overlays at least a portion of the toe side wing 656. Further, when the upper portion 604 and lower portion 608 are joined such that the toe end 612 overlays at least a portion of the heel side wing 660. Further still, when the upper portion 604 and lower portion 608 are joined such that the strike face 620 overlays at least a portion of the front periphery 648. Finally, the upper portion 604 and lower portion 608 are joined such that the back edge 634 overlays at least a portion of the rear periphery 652.

Figure 6C:
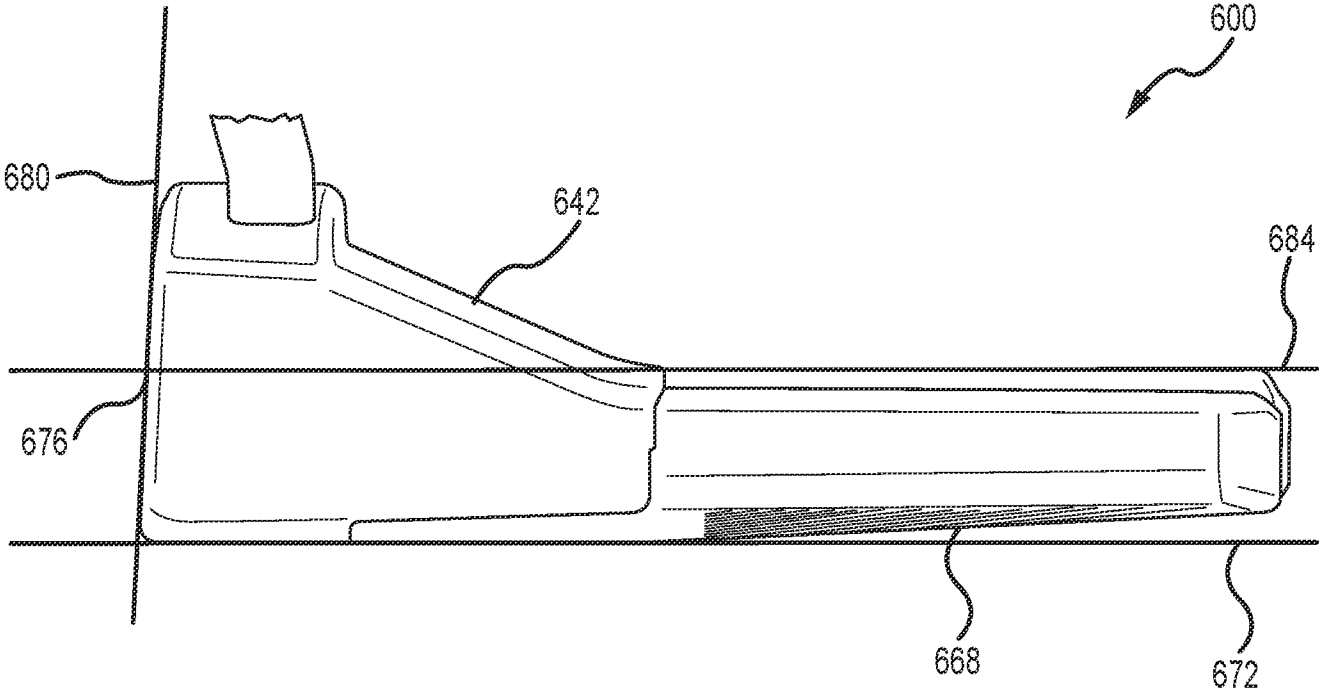
FIG. 6C illustrates a side view of the winged putter type golf club head of FIG. 6A.

Referring the FIG. 6C, the front periphery 648, rear periphery 652, toe side wing 656, and heel side wing 660 of the lower portion 608, combined with the upper portion 604, create a sole 668. The sole 668 is perpendicular to the ground plane 672, wherein the ground plane 672 is tangent to the sole 668, when the putter head 600 is at an address position to strike a golf ball. The sole 668 of the putter head 600 extends from the toe end 612 of the putter head 600 to the heel end 616 of the putter head 600.

In most embodiments, the sole 668 of the putter head 600 can be perfectly flat. In some embodiments, the sole 668 of the putter head 600 can have a slight arch in a heel 616 to toe 612 direction, wherein the slight arch can be linear, or a function of a polynomial. In some embodiments, the sole 668 of the putter head 600 can have a strong arch in the heel 616 to toe 612 direction, wherein the strong arch can be linear, or a function of a polynomial. The sole 668 functions to provide a surface to rest the putter head 600 on the ground plane 672.

Referring to FIG. 6A, in one embodiment, the lower portion 608 can further comprise a front toe mass 641, a front heel mass 643, a toe wing mass 645, and a heel wing mass 647. The front toe mass 641, front heel mass 743, toe wing mass 645, and heel wing mass 647 are integral to the lower portion 608. The front toe mass 641, front heel mass 643, toe wing mass 645, and heel wing mass 647 extend from the lower portion 608, in a direction away from the ground plane 672, and toward the upper portion 604. These mass portions provide a means to position to upper portion 604 and align with the lower portion 608 of the putter head 600. Furthermore, these mass portions (i.e., the front toe mass 641, front heel mass 643, toe wing mass 645, and heel wing mass 647) provide an additional means of adding weight to the perimeters for increasing the MOI of the putter 600 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front toe mass 641, a front heel mass 643, a toe wing mass 645, and a heel wing mass 647 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front toe mass 641 is positioned on the front periphery 648, at the junction of the toe wing 656 and the front periphery 648, however in other embodiments the front toe mass 641 can be positioned anywhere along the front periphery 648. In one embodiment, the front heel mass 643, is positioned on the front periphery 648, at the junction of the heel wing 660 and the front periphery 648, however in other embodiments the front heel mass 643 can be positioned anywhere along the front periphery 648. In one embodiment, the toe wing mass 645 can be positioned over a portion of toe side wing 656, however in other embodiments the toe wing mass 645 can be positioned anywhere along a portion of, or the entire, toe side wing 656. In one embodiment, the heel wing mass 647 can be positioned over a portion of the heel side wing 660, however in other embodiments the heel wing mass 647 can be positioned along a portion of, or the entire, heel side wing 660.

The front toe mass 641, front heel mass 643, toe wing mass 645, and heel wing mass 647, provide areas of concentrated mass, such that each mass 641, 643, 645, and 647 function to increase the moment of inertia of the putter head 600. The placement of each mass 641, 643, 645, and 647 on the periphery 648 and wings 656, 660, increases the MOI since each mass 641, 643, 645, and 647 since each mass is farther from a center of gravity of the putter 600. Each mass 641, 643, 645, 647 on the periphery 648 and wings 656, 660 is integrally formed from the second material, wherein the second material is denser than the first material.

The front toe mass 641 and front heel mass 643 offer dual functionalities, such that the front toe mass 641 and front heel mass 643 function not only to increase the MOI of the putter 600 but provide additional surfaces for the upper portion 604 to join to the lower portion 608. Therefore, the front toe mass 641 can also be referred to as a front toe adhesion portion 641 and the front heel mass 643 can also be referred to as a front heel adhesion portion 643.

In some embodiments, the under surface, strike face 620, and rear wall 632 of the upper portion 608, can form a first cavity (not shown). The first cavity extends inwards from the under surface, on the toe end 612, towards the crown 642 but does not reach the crown 642. The first cavity is bounded by the rear wall 632, the strike face 620, and the toe 612. The first cavity functions to receive the front toe mass 641 of the lower portion 608.

In some embodiments, the under surface, strike face 620, and rear wall 632 of the upper portion 608, can form a second cavity (not shown). The second cavity extends inwards from the under surface, on the heel end 616, towards the crown 642 but does not reach the crown 642. The second cavity is bounded by the rear wall 632, the strike face 620, and the heel 616. The second cavity functions to receive the front heel mass 643 of the lower portion 608.

The first and second cavity can comprise any desired geometry, however in most embodiments, the first and second cavity comprise a geometry similar or identical to that of the front toe mass 641 and the front heel mass 643. Further, when the upper portion 604 is affixed to the lower portion 608, the first cavity is positioned such that the first cavity encompasses the front toe mass 641, and the second cavity is positioned such that the second cavity encompasses the front heel mass 643.

The combination of the low density first material upper portion 604 with the high density second material lower portion 608, creates a high MOI putter 600, without creating an extremely heavy putter. The large gap 664 formed by the rear periphery 652 and the wings 656, 660 of the lower portion 608 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 608, in most embodiments, comprises less than 38% of a total volume of the putter 600. In some embodiments, the lower portion 608 comprises less than 37% of the total volume of the putter 600, less than 36% of the total volume of the putter 600, less than 35% of the total volume of the putter 600, less than 34% of the total volume of the putter 600, less than 33% of the total volume of the putter 600, less than 32% of the total volume of the putter 600, less than 31% of the total volume of the putter 600, less than 30% of the total volume of the putter 600, less than 29% of the total volume of the putter 600, less than 28% of the total volume of the putter 600, or less than 27% of the total volume of the putter 600.

Although the lower portion 608 comprises less than half of the volume of the putter 600, the lower portion 608 comprises at least 45% of an overall mass of the putter 600. In some embodiments, the lower portion 608 comprises at least 46% of the overall mass of the putter 600, at least 46% of the overall mass of the putter 600, at least 47% of the overall mass of the putter 600, at least 48% of the overall mass of the putter 600, at least 49% of the overall mass of the putter 600, at least 50% of the overall mass of the putter 600, at least 51% of the overall mass of the putter 600, at least 52% of the overall mass of the putter 600, at least 53% of the overall mass of the putter 600, at least 54% of the overall mass of the putter 600, or at least 55% of the overall mass of the putter 600.

The beneficial shift of mass to the periphery of the putter head 600, through the use of a high density, low volume lower portion 608, increases the MOI of the putter 600, over a putter with the same volume, mass, and single material construction (i.e., a putter milled of a single stainless steel block, or a putter investment cast of a single material).

e. Spade Embodiment

Figure 7B:
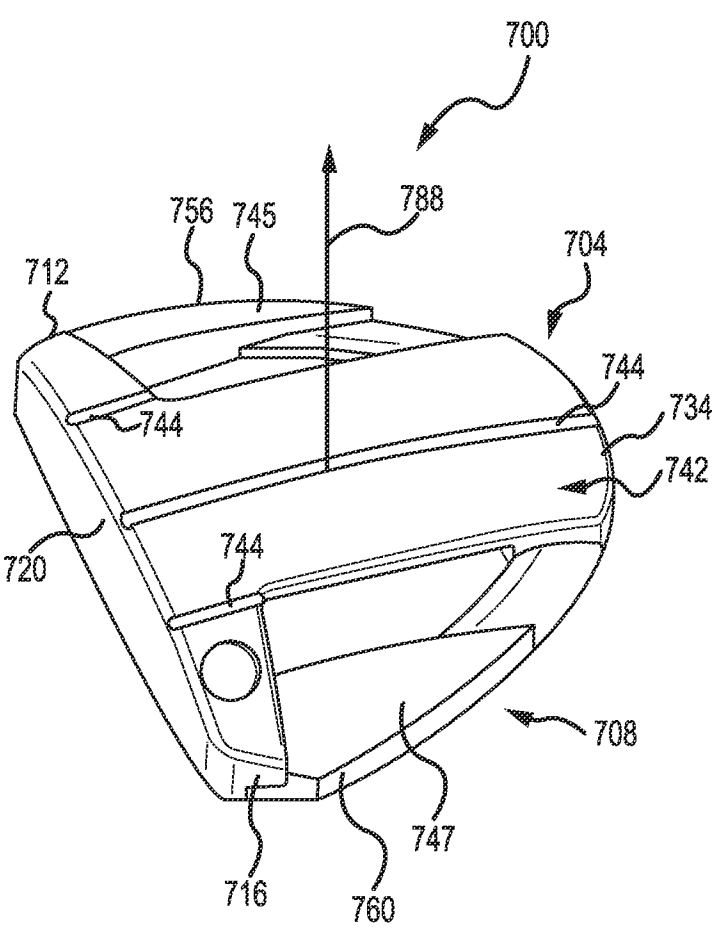
FIG. 7B illustrates an isometric view of the spade putter type golf club head of FIG. 7A.
Figure 7A:
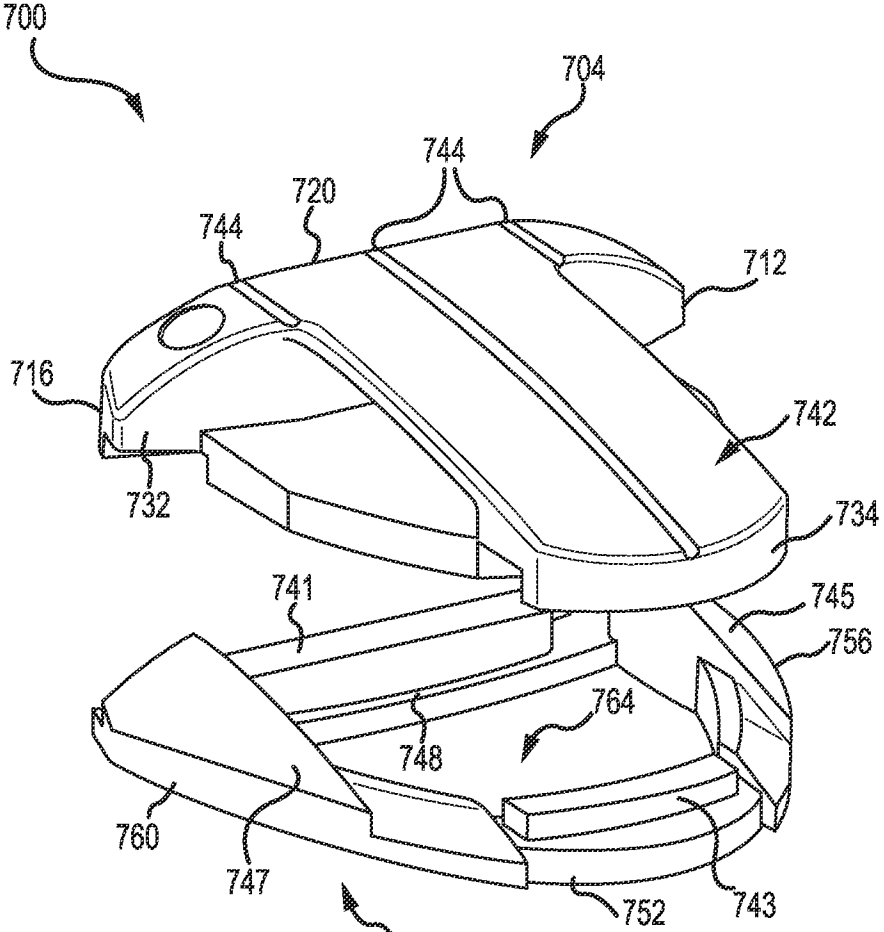
FIG. 7A illustrates an exploded view of a spade putter type golf club head.

In one embodiment, the putter-type golf club head can be a spade shaped putter head with periphery spans 700. Referring to FIGS. 7A and 7B, the spade shaped putter head 700 has a upper portion 704 and a lower portion 708. The upper portion 704 is made from a first material have a first density and the lower portion 708 is made from a second material having a second density. The first density is less than the second density. The upper portion 704 and lower portion 708 combine to create a high-MOI putter head 700 (5000 $g \cdot cm^2$-6500 $g \cdot cm^2$), while maintaining a desirable volume and mass.

As discussed above, the lower portion 708 is comprised of a high-density material (i.e., the first material), thereby lowering the mass below a midline 784. The lower portion 708 comprises a front periphery 748, a rear periphery 752, a toe side periphery 756, and a heel side periphery 760. The front periphery 748 is adjacent to the toe side periphery 756 and the heel side periphery 760, and opposite to the rear periphery 752. The toe side periphery 756 is adjacent to the front periphery 748 and the rear periphery 752, and opposite and to the heel side periphery 760. The heel side periphery 760 is also adjacent to the front periphery 748 and the rear periphery 752, but opposite to the toe side periphery 756. In some embodiments, the heel side periphery 760 and toe side periphery 756 can be parallel, while in some embodiments the heel side periphery 760 and toe side periphery 756 are not parallel. In some embodiments, the rear periphery 752 and front periphery 748 can be parallel, while in some embodiments the rear periphery 752 and front periphery 748 are not parallel.

The front periphery 748, of the lower portion 708, comprises a front width. The front width is measured from the junction of the toe side periphery 756 and the front periphery 748, to the junction of the heel side periphery 760 and the front periphery 748. Further, the rear periphery 752, of the lower portion 708, comprises a rear width. The rear width is measured from the junction of the toe side periphery 756 and the rear periphery 752, to the junction of the heel side periphery 760 and the rear periphery 752. In most embodiments, the front width is greater than the rear width, however in some embodiments, the front width can be equal to or less than the rear width.

The front periphery 748, rear periphery 752, toe side periphery 756, and heel side periphery 760, join to from an aperture 764, wherein the aperture 764 is bounded by the four peripheries (front 756, rear 752, toe side 756, and heel side 760). The four peripheries 756, 752, 756, 760, form a perimeter around the aperture 764. The central aperture 764, formed by the peripheries 756, 752, 756, 760 of the lower portion 708, shifts a majority of the volume and mass of the putter to the extremities of the lower portion 708.

The upper portion 704 of the putter head 700 comprises a toe end 712, a heel end 716, a strike face 720, a rear wall 732, a back edge 734, a crown 742, and an under surface (not pictured). The toe end 712 is opposite the heel end 716. The strike face 720 spans from the toe end 712 to the heel end 716 and is opposite the rear wall 732. The rear wall 732 is opposite, and approximately parallel to the strike face 720.

The crown 742 extends away from the strike face 720, over at least a portion of the rear wall 732, and to the back edge 734 of the upper portion 704. Furthermore, the under surface is opposite the crown 742, spanning from the strike face 720 to the back edge 734.

The crown 742 further descends from the strike face 720 to the back edge 734. Additionally, the crown 742 extends away from the strike face 720, over at least a portion of the rear wall 732, the aperture 764 of the lower portion 708, and to the back edge 734 of the upper portion 704. The crown 742, in most embodiments, is inward 25% of the total club head 700 width from the toe side periphery 756 and the heel side periphery 760. In this embodiment, the crown 742 spans approximately 50% of the width of the club head 700. In other embodiments, the crown 742, can span the entire width of the total club head 700, in a heel to toe direction. In some embodiments, the crown 742, can span less than 90% of the total width of the club head 700, less than 90% of the total width of the club head 700, less than 80% of the total width of the club head 700, less than 70% of the total width of the club head 700, less than 60% of the total width of the club head 700, less than 50% of the total width of the club head 700, less than 40% of the total width of the club head 700, or less than 30% of the total width of the club head 700. Further, in some embodiments, the crown 742 can be substantially flat from the strike face 720 to the back edge 734 or ascend from the strike face 720 to the back edge 734. In most embodiments, the ascent or descent of the crown 742 can be linear, curvilinear, parabolic, sinusoidal, or a function of polynomial.

Furthermore, the upper portion 704 of the putter head 700 can comprise one or more alignment features 744 on the crown 742. The alignment feature 744 can be any one or combination of the following: a line, a series of lines, milling troughs, a circle, a dashed line, a triangle, a channel, or any other desired alignment feature 744. The alignment features 744 are equally spaced on the entire crown 742, wherein the crown is configured to be the width of a golf ball (approximately 4.27 cm). The alignment features 744, extending along the crown 742, function to provide the viewer a visual alignment field that extends the width of the golf ball, from the strike face 720 to the back edge 734 of the putter 700. The goal is to align the entire putter 700 with the golf ball using these alignment features 744 along the crown 742.

Figure 7C:
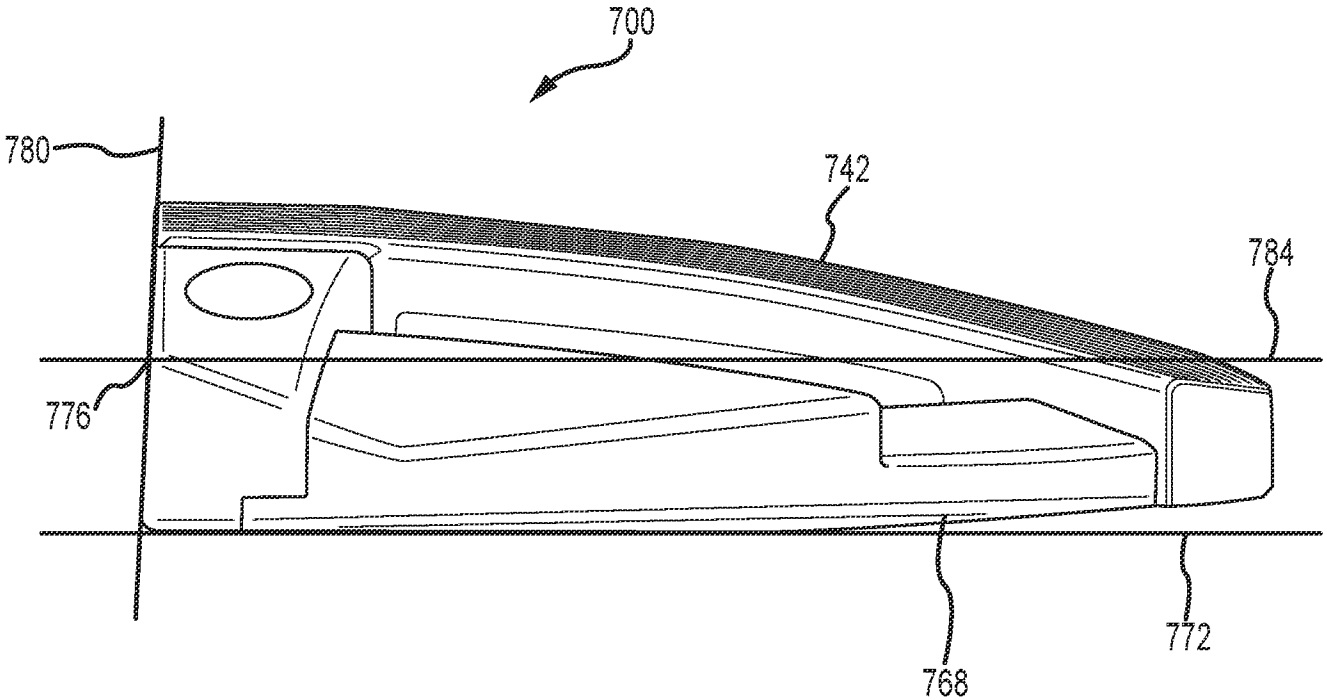
FIG. 7C illustrates a side view of the spade putter type golf club head of FIG. 7A.

Referring to FIG. 7C, the upper portion 704 is affixed to the lower portion 708 such that the upper portion 704 is further from a ground plane 772 than the lower portion 708, wherein the ground plane 772 is tangent to the lower portion 704, when the putter head 700 is at an address position to strike a golf ball.

Further, the strike face 720 of the putter head 700 comprises a strike face center point 776 and a loft plane 780. The strike face center point 776 is equidistant from the crown 742 and the undersurface of the upper portion 704, as well as equidistant from the heel end 716 and toe end 712 of the putter head 700. The loft plane 780 is tangent to the strike face 720 of the putter head 700. Further, a midplane 748 intersects the strike face center point 776 and is perpendicular to the loft plane 780. Furthermore, a y-axis 788 intersects the midplane 784, and is perpendicular to the ground plane 772.

When the upper portion 704 and lower portion 708 are joined such that the heel end 716 overlays at least a portion of the toe side periphery 756. Further, when the upper portion 704 and lower portion 708 are joined such that the toe end 712 overlays at least a portion of the heel side periphery 760. Further still, when the upper portion 704 and lower portion 708 are joined such that the strike face 720 overlays at least a portion of the front periphery 748. Finally, the upper portion 704 and lower portion 708 are joined such that the back edge 734 overlays at least a portion of the rear periphery 752.

The four peripheries (front 748, rear 752, toe side 756, and heel side 760) of the lower portion 708, combined with the upper portion 704, create a sole 768. The sole 768 is perpendicular to the ground plane 772, wherein the ground plane 772 is tangent to the sole 768, when the putter head 700 is at an address position to strike a golf ball. The sole 768 of the putter head 700 extends from the toe end 712 of the putter head 700 to the heel end 716 of the putter head 700.

In most embodiments, the sole 768 of the putter head 700 can be perfectly flat. In some embodiments, the sole 768 of the putter head 700 can have a slight arch in a heel 716 to toe 712 direction, wherein the slight arch can be linear, or a function of a polynomial. In some embodiments, the sole 768 of the putter head 700 can have a strong arch in the heel 716 to toe 712 direction, wherein the strong arch can be linear, or a function of a polynomial. The sole 768 functions to provide a surface to rest the putter head 700 on the ground plane 772.

Referring to FIG. 7A, in one embodiment, the lower portion 708 can further comprise a front mass 741, a rear mass 743, a toe mass 745, and a heel mass 747. The front mass 741, rear mass 743, toe mass 745, and heel mass 747 are integral to the lower portion 708. The front mass 741, rear mass 743, toe mass 745, and heel mass 747 extend from the lower portion 708, in a direction away from the ground plane 772, and toward the upper portion 704. These mass portions provide a means to position to upper portion 704 and align with the lower portion 708 of the putter head 700. Furthermore, these mass portions (i.e., the front mass 741, rear mass 743, toe mass 745, and heel mass 747) provide an additional means of adding weight to the perimeters for increasing the MOI of the putter 700 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front mass 741, a rear mass 743, a toe mass 745, and a heel mass 747 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front mass 741 is positioned on the front periphery 748, is equidistance from the toe side periphery 756 and the heel side periphery 760, however in other embodiments the front mass 741 can be positioned anywhere along the front periphery 748. In one embodiment, the rear mass 743, is positioned on the rear periphery 752, equidistance from the toe side periphery 756 and the heel side periphery 760, however in other embodiments the rear mass 743 can be positioned anywhere along the rear periphery 752. In one embodiment, the toe mass 745 can be positioned at the junction of the toe side periphery 756 and the rear periphery 752, however in other embodiments the toe mass 745 can be positioned anywhere along the toe side periphery 756. In one embodiment, the heel mass 747 can be positioned at the junction of the heel side periphery 760 and the rear periphery 752, however in other embodiments the heel mass 747 can be positioned anywhere along the heel side periphery 760.

The front mass 741, a rear mass 743, a toe mass 745, and a heel mass 747, provide areas of concentrated mass, such that each mass 741, 743, 745, and 747 function to increase the moment of inertia of the putter head 700. The placement of each mass 741, 743, 745, and 747 on the peripheries 748, 752, 756, 760, increases the MOI since each mass 741, 743, 745, and 747 since each mass is farther from a center of gravity of the putter 700. Each mass 741, 743, 745, 747 on the peripheries 748, 752, 756, 760 is integrally formed from the second material, wherein the second material is denser than the first material.

The front mass 741 and the rear mass 743 offer dual functionalities, such that the front mass 741 and rear mass 743 function not only to increase the MOI of the putter 700 but provide additional surfaces for the upper portion 704 to join to the lower portion 708. Therefore, the front mass 741 can also be referred to as a front adhesion portion 741 and the rear mass 743.

In some embodiments, the under surface, strike face 720, and rear wall 732 of the upper portion 708, can form a first cavity (not shown). The first cavity extends inwards from the under surface towards the crown 742 but does not reach the crown 742. The first cavity is bounded by the rear wall 732 and the strike face 720. The first cavity functions to receive the front mass 741 of the lower portion 708.

In some embodiments, the under surface, the back edge 734, and the crown 742 forms a second cavity (not shown). The second cavity extends inwards from the under surface, towards the crown 742, but does not reach the crown 742. The second cavity is bounded by the back edge 734, and the crown 732. In most embodiments, the second cavity is positioned equidistance between the toe side periphery 756 and the heel side periphery 760, when the lower portion 708 is joined to the upper portion 704. The second cavity functions to receive the rear mass 743 of the lower portion 708.

The first and second cavity can comprise any desired geometry, however in most embodiments, the first and second cavity comprise a geometry similar or identical to that of the front mass 741 and the rear mass 743. Further, when the upper portion 704 is affixed to the lower portion 708, the first cavity is positioned such that the first cavity encompasses the front mass 741, and the second cavity is positioned such that the second cavity encompasses the rear mass 743.

The combination of the low density first material upper portion 704 with the high density second material lower portion 708, creates a high MOI putter 700, without creating an extremely heavy putter. The large aperture 764 formed by the peripheries 748, 752, 756, 760 of the lower portion 708 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 708, in most embodiments, comprises less than 35% of a total volume of the putter 700. In some embodiments, the lower portion 708 comprises less than 34% of the total volume of the putter 700, less than 33% of the total volume of the putter 700, less than 32% of the total volume of the putter 700, less than 31% of the total volume of the putter 700, less than 30% of the total volume of the putter 700, less than 29% of the total volume of the putter 700, less than 28% of the total volume of the putter 700, or less than 27% of the total volume of the putter 700.

Although the lower portion 708 comprises less than half of the volume of the putter 700, the lower portion 708 comprises at least 45% of an overall mass of the putter 700. In some embodiments, the lower portion 708 comprises at least 46% of the mass of the putter 700, at least 47% of the mass of the putter 700, at least 48% of the mass of the putter 700, at least 49% of the mass of the putter 700, at least 50% of the mass of the putter 700, at least 51% of the mass of the putter 700, at least 52% of the mass of the putter 700, at least 53% of the mass of the putter 700, at least 54% of the mass of the putter 700, or at least 55% of the mass of the putter 700.

The beneficial shift of mass to the periphery of the putter head 700, through the use of a high density, low volume lower portion 708, increases the MOI of the putter 700, over a putter with the same volume, mass, and single material construction (i.e., a putter milled of a single stainless steel block, or a putter investment cast of a single material).

f. T-Shaped Embodiment with Periphery Spans

Figure 8B:
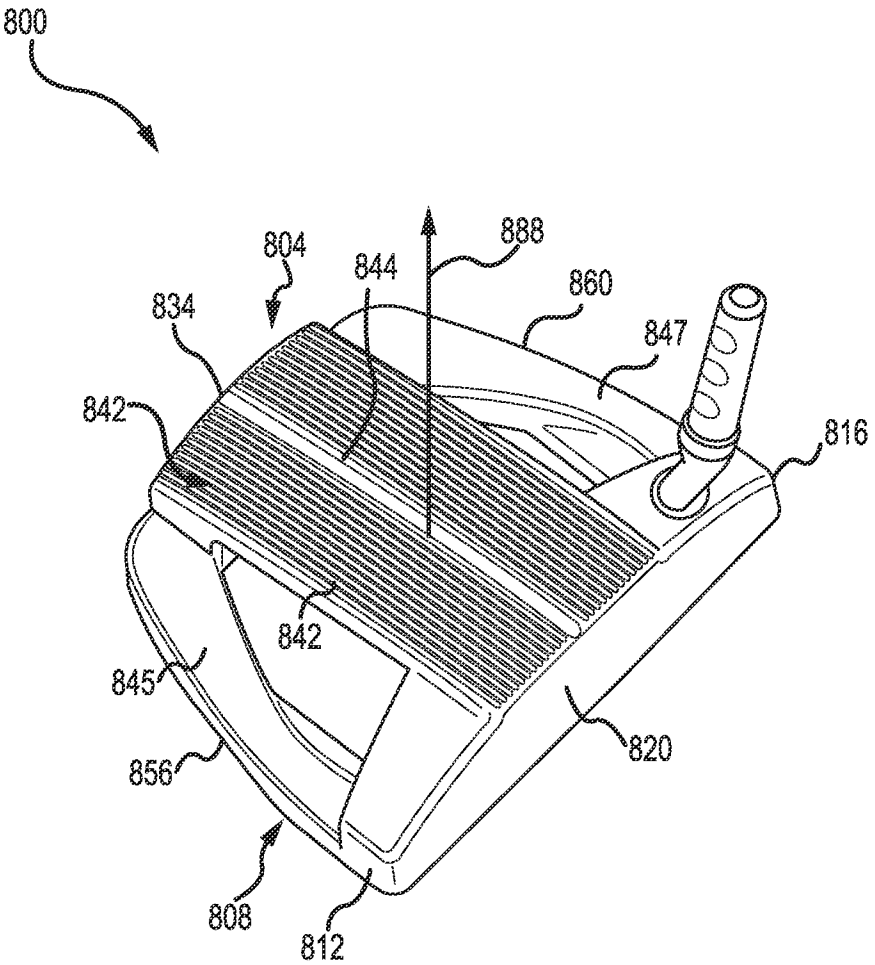
FIG. 8B illustrates an isometric view of the T-shaped putter type golf club head with periphery spans of FIG. 8A.
Figure 8A:
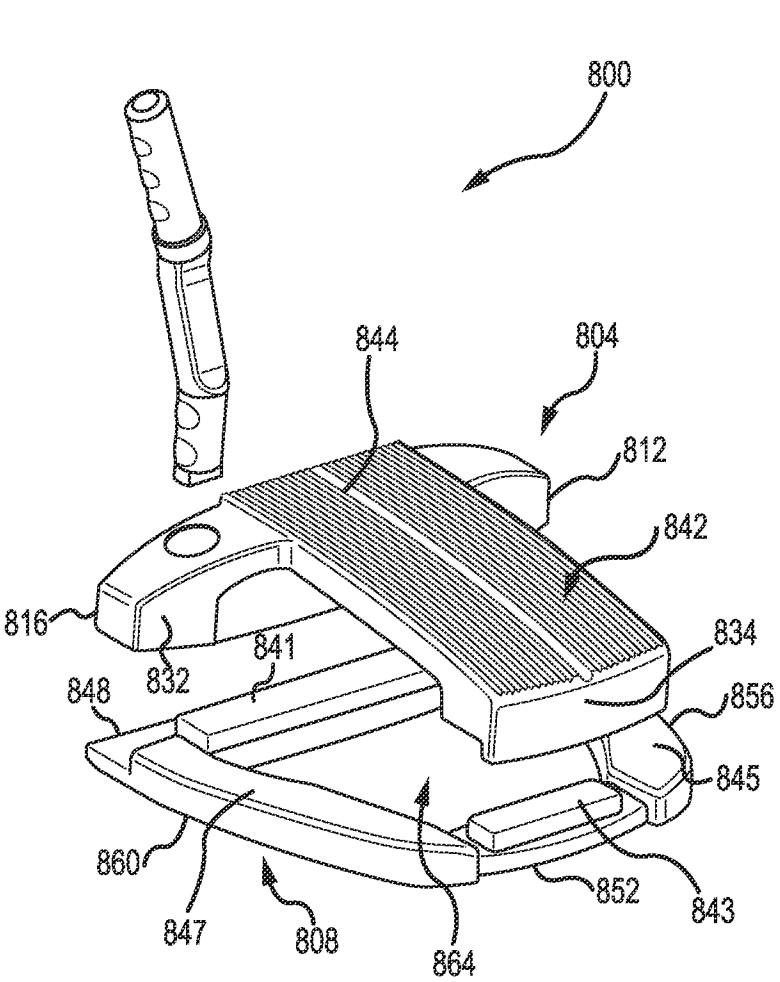
FIG. 8A illustrates an exploded view of a T-shaped putter type golf club head with periphery spans.

In one embodiment, the putter-type golf club head can be a T-shaped putter head with periphery spans 800. Referring to FIGS. 8A and 8B, the T-shaped putter head with periphery spans 800 has a upper portion 804 and a lower portion 808. The upper portion 804 is made from a first material have a first density and the lower portion 808 is made from a second material having a second density. The first density is less than the second density. The upper portion 804 and lower portion 808 combine to create a high-MOI putter head 800 (5000 $g \cdot cm^2$-6500 $g \cdot cm^2$), while maintaining a desirable volume and mass.

As discussed above, the lower portion 808 is comprised of a high-density material (i.e., the second material), thereby lowering the mass below a midline 884. The lower portion 808 comprises a front periphery 848, a rear periphery 852, a toe side periphery 856, and a heel side periphery 860. The front periphery 848 is adjacent to the toe side periphery 856 and the heel side periphery 860, and opposite to the rear periphery 852. The toe side periphery 856 is adjacent to the front periphery 848 and the rear periphery 852, and opposite and to the heel side periphery 860. The heel side periphery 860 is also adjacent to the front periphery 848 and the rear periphery 852, but opposite to the toe side periphery 856. In some embodiments, the heel side periphery 860 and toe side periphery 856 can be parallel, while in some embodiments the heel side periphery 860 and toe side periphery 856 are not parallel. In some embodiments, the rear periphery 852 and front periphery 848 can be parallel, while in some embodiments the rear periphery 852 and front periphery 848 are not parallel.

The front periphery 848, of the lower portion 808, comprises a front width. The front width is measured from the junction of the toe side periphery 856 and the front periphery 848, to the junction of the heel side periphery 860 and the front periphery 848. Further, the rear periphery 852, of the lower portion 808, comprises a rear width. The rear width is measured from the junction of the toe side periphery 856 and the rear periphery 852, to the junction of the heel side periphery 860 and the rear periphery 852. In most embodiments, the front width is greater than the rear width, however in some embodiments, the front width can be equal to or less than the rear width.

The front periphery 848, rear periphery 852, toe side periphery 856, and heel side periphery 860, join to from an aperture 864, wherein the aperture 864 is bounded by the four peripheries (front 856, rear 852, toe side 856, and heel side 860). The four peripheries 856, 852, 856, 860, form a perimeter around the aperture 864. The central aperture 864, formed by the peripheries 856, 852, 856, 860 of the lower portion 808, shifts a majority of the volume and mass of the putter to the extremities of the lower portion 808.

In some embodiments, the aperture 864, formed by the front periphery 848, rear periphery 852, toe side periphery 856, and heel side periphery 860 can be any one of the following shapes: rectangular, triangular, semi-circular, circular (golf ball sized), circular (larger than a golf ball), circular (smaller than a golf ball), square, ovular, elliptical, trapezoidal, pentagonal, hexagonal, octagonal, or any other desired geometric or non-geometric shape.

The upper portion 804 of the putter head 800 comprises a toe end 812, a heel end 816, a strike face 820, a rear wall 832, a back edge 834, a crown 842, and an under surface (not pictured). The toe end 812 is opposite the heel end 816. The strike face 820 spans from the toe end 812 to the heel end 816 and is opposite the rear wall 832. The rear wall 832 is opposite, and approximately parallel to the strike face 820. The crown 842 extends away from the strike face 820, over at least a portion of the rear wall 832, and to the back edge 834 of the upper portion 804. Furthermore, the under surface is opposite the crown 842, spanning from the strike face 820 to the back edge 834.

The crown 842 further descends from the strike face 820 to the back edge 834. Additionally, the crown 842 extends away from the strike face 820, over at least a portion of the rear wall 832, the aperture 864 of the lower portion 808, and to the back edge 834 of the upper portion 804. The crown 842, in most embodiments, is inward 25% of the total club head 800 width from the toe side periphery 856 and the heel side periphery 860. In this embodiment, the crown 842 spans approximately 50% of the width of the club head 800, thus forming a "T-Shape" with the strike face. In other embodiments, the crown 842, can span the entire width of the total club head 800, in a heel to toe direction. In some embodiments, the crown 842, can span less than 90% of the total width of the club head 800, less than 90% of the total width of the club head 800, less than 80% of the total width of the club head 800, less than 70% of the total width of the club head 800, less than 60% of the total width of the club head 800, less than 50% of the total width of the club head 800, less than 40% of the total width of the club head 800, or less than 30% of the total width of the club head 800. Further, in some embodiments, the crown 842 can be substantially flat from the strike face 820 to the back edge 834 or ascend from the strike face 820 to the back edge 834. In most embodiments, the ascent or descent of the crown 842 can be linear, curvilinear, parabolic, sinusoidal, or a function of polynomial.

Furthermore, the upper portion 804 of the putter head 800 can comprise one or more alignment features 844 on the crown 842. The alignment feature 844 can be any one or combination of the following: a line, a series of lines, milling troughs, a circle, a dashed line, a triangle, a channel, or any other desired alignment feature 844. The alignment features 844 are equally spaced on the entire crown 842, wherein the crown is configured to be the width of a golf ball (approximately 4.27 cm). The alignment features 844, extending along the crown 842, function to provide the viewer a visual alignment field that extends the width of the golf ball, from the strike face 820 to the back edge 834 of the putter 800. The goal is to align the entire putter 800 with the golf ball using these alignment features 844 along the crown 842.

Figure 8C:
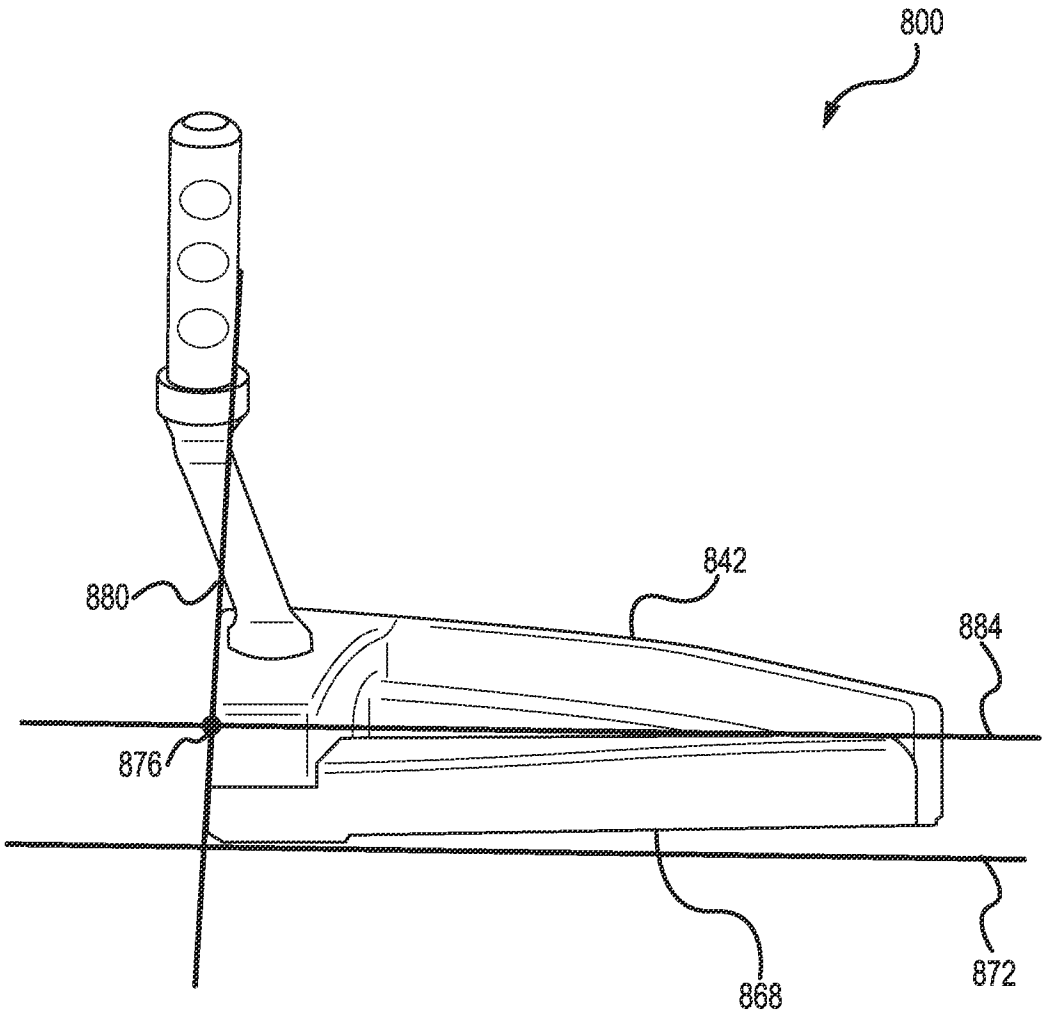
FIG. 8C illustrates a side view of the T-shaped putter type golf club head with periphery spans of FIG. 8A.

Referring to FIG. 8C, the upper portion 804 is affixed to the lower portion 808 such that the upper portion 804 is further from a ground plane 872 than the lower portion 808, wherein the ground plane 872 is tangent to the lower portion 804, when the putter head 800 is at an address position to strike a golf ball.

Further, the strike face 820 of the putter head 800 comprises a strike face center point 876 and a loft plane 880. The strike face center point 876 is equidistant from the crown 842 and the undersurface of the upper portion 804, as well as equidistant from the heel end 816 and toe end 812 of the putter head 800. The loft plane 880 is tangent to the strike face 820 of the putter head 800. Further, a midplane 884 intersects the strike face center point 876 and is perpendicular to the loft plane 880. Furthermore, a y-axis 888 intersects the midplane 884, and is perpendicular to the ground plane 872.

When the upper portion 804 and lower portion 808 are joined such that the heel end 816 overlays at least a portion of the toe side periphery 856. Further, when the upper portion 804 and lower portion 808 are joined such that the toe end 812 overlays at least a portion of the heel side periphery 860. Further still, when the upper portion 804 and lower portion 808 are joined such that the strike face 820 overlays at least a portion of the front periphery 848. Finally, the upper portion 804 and lower portion 808 are joined such that the back edge 834 overlays at least a portion of the rear periphery 852.

The four peripheries (front 848, rear 852, toe side 856, and heel side 860) of the lower portion 808, combined with the upper portion 804, create a sole 868. The sole 868 is perpendicular to the ground plane 872, wherein the ground plane 872 is tangent to the sole 868, when the putter head 800 is at an address position to strike a golf ball. The sole 868 of the putter head 800 extends from the toe end 812 of the putter head 800 to the heel end 816 of the putter head 800.

In most embodiments, the sole 868 of the putter head 800 can be perfectly flat. In some embodiments, the sole 868 of the putter head 800 can have a slight arch in a heel 816 to toe 812 direction, wherein the slight arch can be linear, or a function of a polynomial. In some embodiments, the sole 868 of the putter head 800 can have a strong arch in the heel 816 to toe 812 direction, wherein the strong arch can be linear, or a function of a polynomial. The sole 868 functions to provide a surface to rest the putter head 800 on the ground plane 872.

Referring to FIG. 8A, in one embodiment, the lower portion 808 can further comprise a front mass 841, a rear mass 843, a toe mass 845, and a heel mass 847. The front mass 841, rear mass 843, toe mass 845, and heel mass 847 are integral to the lower portion 808. The front mass 841, rear mass 843, toe mass 845, and heel mass 847 extend from the lower portion 808, in a direction away from the ground plane 872, and toward the upper portion 804. These mass portions provide a means to position to upper portion 804 and align with the lower portion 808 of the putter head 800. Furthermore, these mass portions (i.e., the front mass 841, rear mass 843, toe mass 845, and heel mass 847) provide an additional means of adding weight to the perimeters for increasing the MOI of the putter 800 over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front mass 841, a rear mass 843, a toe mass 845, and a heel mass 847 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front mass 841 is positioned on the front periphery 848, is equidistance from the toe side periphery 856 and the heel side periphery 860, however in other embodiments the front mass 841 can be positioned anywhere along the front periphery 848. In one embodiment, the rear mass 843, is positioned on the rear periphery 852, equidistance from the toe side periphery 856 and the heel side periphery 860, however in other embodiments the rear mass 843 can be positioned anywhere along the rear periphery 852. In one embodiment, the toe mass 845 can be positioned at the junction of the toe side periphery 856 and the rear periphery 852, however in other embodiments the toe mass 845 can be positioned anywhere along the toe side periphery 856. In one embodiment, the heel mass 847 can be positioned at the junction of the heel side periphery 860 and the rear periphery 852, however in other embodiments the heel mass 847 can be positioned anywhere along the heel side periphery 860.

The front mass 841, a rear mass 843, a toe mass 845, and a heel mass 847, provide areas of concentrated mass, such that each mass 841, 843, 845, and 847 function to increase the moment of inertia of the putter head 800. The placement of each mass 841, 843, 845, and 847 on the peripheries 848, 852, 856, 860, increases the MOI since each mass 841, 843, 845, and 847 since each mass is farther from a center of gravity of the putter 800. Each mass 841, 843, 845, 847 on the peripheries 848, 852, 856, 860 is integrally formed from the second material, wherein the second material is denser than the first material.

The front mass 841 and the rear mass 843 offer dual functionalities, such that the front mass 841 and rear mass 843 function not only to increase the MOI of the putter 800 but provide additional surfaces for the upper portion 804 to join to the lower portion 808. Therefore, the front mass 841 can also be referred to as a front adhesion portion 841 and the rear mass 843.

In some embodiments, the under surface, strike face 820, and rear wall 832 of the upper portion 808, can form a first cavity (not shown). The first cavity extends inwards from the under surface towards the crown 842 but does not reach the crown 842. The first cavity is bounded by the rear wall 832 and the strike face 820. The first cavity functions to receive the front mass 841 of the lower portion 808.

In some embodiments, the under surface, the back edge 834, and the crown 842 forms a second cavity (not shown). The second cavity extends inwards from the under surface, towards the crown 842, but does not reach the crown 842. The second cavity is bounded by the back edge 834, and the crown 832. In most embodiments, the second cavity is positioned equidistance between the toe side periphery 856 and the heel side periphery 860, when the lower portion 808 is joined to the upper portion 804. The second cavity functions to receive the rear mass 843 of the lower portion 808.

The first and second cavity can comprise any desired geometry, however in most embodiments, the first and second cavity comprise a geometry similar or identical to that of the front mass 841 and the rear mass 843. Further, when the upper portion 804 is affixed to the lower portion 808, the first cavity is positioned such that the first cavity encompasses the front mass 841, and the second cavity is positioned such that the second cavity encompasses the rear mass 843.

The combination of the low density first material upper portion 804 with the high density second material lower portion 808, creates a high MOI putter 800, without creating an extremely heavy putter. The large aperture 864 formed by the peripheries 848, 852, 856, 860 of the lower portion 808 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 808, in most embodiments, comprises less than 35% of a total volume of the putter 800. In some embodiments, the lower portion 908 comprises less than 34% of the total volume of the putter 800, less than 33% of the total volume of the putter 800, less than 32% of the total volume of the putter 800, less than 31% of the total volume of the putter 800, less than 30% of the total volume of the putter 800, less than 29% of the total volume of the putter 800, less than 28% of the total volume of the putter 800, or less than 27% of the total volume of the putter 800.

Although the lower portion 808 comprises less than half of the volume of the putter 800, the lower portion 808 comprises at least 45% of an overall mass of the putter 800. In some embodiments, the lower portion 808 comprises at least 46% of the mass of the putter 800, at least 46% of the mass of the putter 800, at least 46% of the mass of the putter 800, at least 47% of the mass of the putter 800, at least 48% of the mass of the putter 800, at least 49% of the mass of the putter 800, at least 50% of the mass of the putter 800, at least 51% of the mass of the putter 800, at least 52% of the mass of the putter 800, at least 53% of the mass of the putter 800, at least 54% of the mass of the putter 800, or at least 55% of the mass of the putter 800.

The beneficial shift of mass to the periphery of the putter head 800, through the use of a high density, low volume lower portion 808, increases the MOI of the putter 800, over a putter with the same volume, mass, and single material construction (i.e., a putter milled of a single stainless steel block, or a putter investment cast of a single material).

g. Dual-Rail Embodiment

Figure 9B:
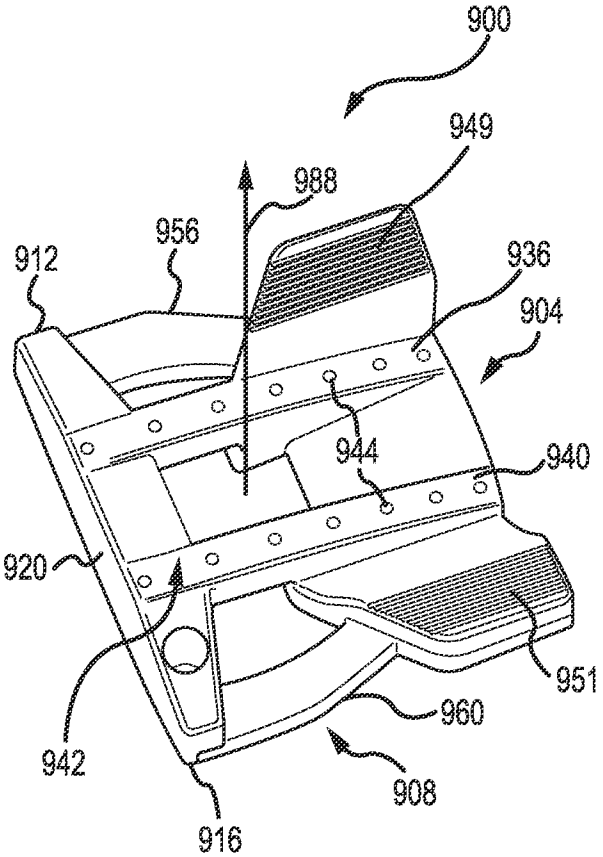
FIG. 9B illustrates an isometric view of the dual rail putter type golf club head of FIG. 9A.
Figure 9A:
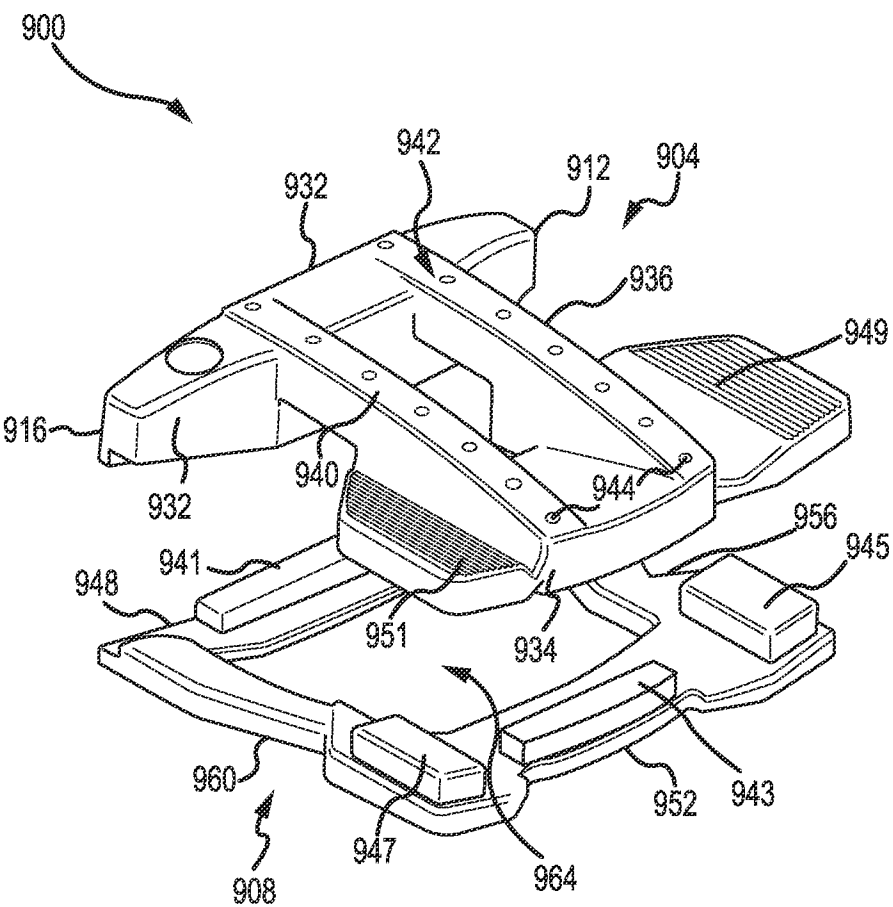
FIG. 9A illustrates an exploded view of a dual rail putter type golf club head.

In another embodiment, the putter-type golf club head can be a dual-rail putter head 900. Referring to FIGS. 9A and 9B, the dual-rail putter head 900 has a upper portion 904 and a lower portion 908. The upper portion 904 is made from a first material have a first density and the lower portion 908 is made from a second material having a second density. The first density is less than the second density. The upper portion 904 and lower portion 908 combine to create a high-MOI putter head 900 (5000 $g \cdot cm^2$-6500 $g \cdot cm^2$), while maintaining a desirable volume and mass.

As discussed above, the lower portion 908 is comprised of a high-density material (i.e., the second material), thereby lowering the mass below a midline 984. The lower portion 908 comprises a front periphery 948, a rear periphery 952, a toe side periphery 956, and a heel side periphery 960. The front periphery 948 is adjacent to the toe side periphery 956 and the heel side periphery 960, and opposite to the rear periphery 952. The toe side periphery 956 is adjacent to the front periphery 948 and the rear periphery 952, and opposite and to the heel side periphery 960. The heel side periphery 956 is also adjacent to the front periphery 948 and the rear periphery 952, but opposite to the toe side periphery 956. In some embodiments, the heel side periphery 960 and toe side periphery 956 can be parallel, while in some embodiments the heel side periphery 960 and toe side periphery 956 are not parallel. In some embodiments, the rear periphery 952 and front periphery 948 can be parallel, while in some embodiments the rear periphery 952 and front periphery 948 are not parallel.

The front periphery 948, of the lower portion 908, comprises a front width. The front width is measured from the junction of the toe side periphery 956 and the front periphery 948, to the junction of the heel side periphery 960 and the front periphery 948. Further, the rear periphery 952, of the lower portion 908, comprises a rear width. The rear width is measured from the junction of the toe side periphery 956 and the rear periphery 952, to the junction of the heel side periphery 960 and the rear periphery 952. In most embodiments, the front width is greater than the rear width, however in some embodiments, the front width can be equal to or less than the rear width.

The front periphery 948, rear periphery 952, toe side periphery 956, and heel side periphery 960, join to from an aperture 964, wherein the aperture 964 is bounded by the four peripheries (front 948, rear 952, toe side 956, and heel side 960). The four peripheries 948, 952, 956, 960, form a perimeter around the aperture 964. The central aperture 964, formed by the peripheries 948, 952, 956, 960 of the lower portion 908, shifts a majority of the volume and mass of the putter to the extremities of the lower portion 908.

In some embodiments, the aperture 964, formed by the front periphery 948, rear periphery 952, toe side periphery 956, and heel side periphery 960 can be any one of the following shapes: rectangular, triangular, semi-circular, circular (golf ball sized), circular (larger than a golf ball), circular (smaller than a golf ball), square, ovular, elliptical, trapezoidal, pentagonal, hexagonal, octagonal, or any other desired geometric or non-geometric shape.

The upper portion 904 of the dual-rail putter head 900 comprises a toe end 912, a heel end 916, a strike face 920, a rear wall 932, a back edge 934, a crown 942, and an under surface (not pictured). The toe end 912 is opposite the heel end 916. The strike face 920 spans from the toe end 912 to the heel end 916 and is opposite the rear wall 932. The rear wall 932 is opposite, and approximately parallel to the strike face 920. The crown 942 extends away from the strike face 920, over at least a portion of the rear wall 932, and to the back edge 934 of the upper portion 904. Furthermore, the under surface is opposite the crown 942, spanning from the strike face 920 to the back edge 934.

The crown 942 of the upper portion 904 further comprises a toe end mid-rail 936 and a heel end mid-rail 940. In most embodiments, the toe end mid-rail 936 and heel end mid-rail 940 are approximately parallel, while perpendicular to the strike face 920. Further, the toe end mid-rail 936 and heel end mid-rail 940 do not contact the toe side periphery 956 or the heel side periphery 960. The toe end mid-rail 936 and the heel end mid-rail 940 are approximately ⅓ inward of the total club head width from the outer periphery of the toe side periphery 956 and heel side periphery 960 respectively. However, in other embodiments, the toe end mid-rail 936 and the heel end mid-rail 940 can be more or less than ⅓ inward of the total club head width from the outer periphery of the toe-side periphery and heel-side periphery respectively. The toe end mid-rail 936 and heel end mid-rail 940 descend from the strike face 920 to the back edge 934. In some embodiments, the toe end mid-rail 936 and heel end mid-rail 940 are not parallel and not perpendicular to the strike face 920. In some embodiments, the toe end mid-rail 936 and heel end mid-rail 940 can be substantially flat from the strike face 920 to the back edge 934 or ascend from the strike face 920 to the back edge 934. In most embodiments, the ascent or descent of the mid-rails 936, 940 can be linear, curvilinear, parabolic, sinusoidal, or a function of polynomial.

Furthermore, the upper portion 904 of the dual-rail putter head 900 can comprise one or more alignment features 944 on toe end mid-rail 936 and heel end mid-rail 940. The alignment feature 944 can be any one or combination of the following: a line, a circle, a dashed line, a triangle, a channel, or any other desired alignment feature 944. The alignment features 944 are spaced such on the rails 936, 940 to be the width of a golf ball (approximately 4.27 cm). The alignment features 944 extend along the rails to provide the viewer a visual alignment field that extends from the golf ball, strike face 920 to the entire putter 900. The goal is to align the entire putter 900 with the golf ball using these alignment features 944 along the toe end mid-rail 936 and heel end mid-rail 940.

The upper portion 904 is affixed to the lower portion 908 such that the upper portion 904 is further from a ground plane 972 than the lower portion 908, wherein the ground plane 972 is tangent to the lower portion 904, when the dual-rail putter head 900 is at an address position to strike a golf ball.

Further, the strike face 920 of the dual-rail putter head 900 comprises a strike face center point 976 and a loft plane 980. The strike face center point 976 is equidistant from the crown 942 and the undersurface of the upper portion 904, as well as equidistant from the heel end 916 and toe end 912 of the dual-rail putter head 900. The loft plane 980 is tangent to the strike face 920 of the dual-rail putter head 900. Further, a midplane 984 intersects the strike face center point 976 and is perpendicular to the loft plane 980. Furthermore, a y-axis 988 intersects the midplane 984, and is perpendicular to the ground plane 972.

When the upper portion 904 and lower portion 908 are joined such that the heel end 916 overlays at least a portion of the toe side periphery 956. Further, when the upper portion 904 and lower portion 908 are joined such that the toe end 912 overlays at least a portion of the heel side periphery 960. Further still, when the upper portion 904 and lower portion 908 are joined such that the strike face 920 overlays at least a portion of the front periphery 948. Finally, when the upper portion 904 and lower portion 908 are joined such that the back edge 934 overlays at least a portion of the rear periphery 952.

Figure 9C:
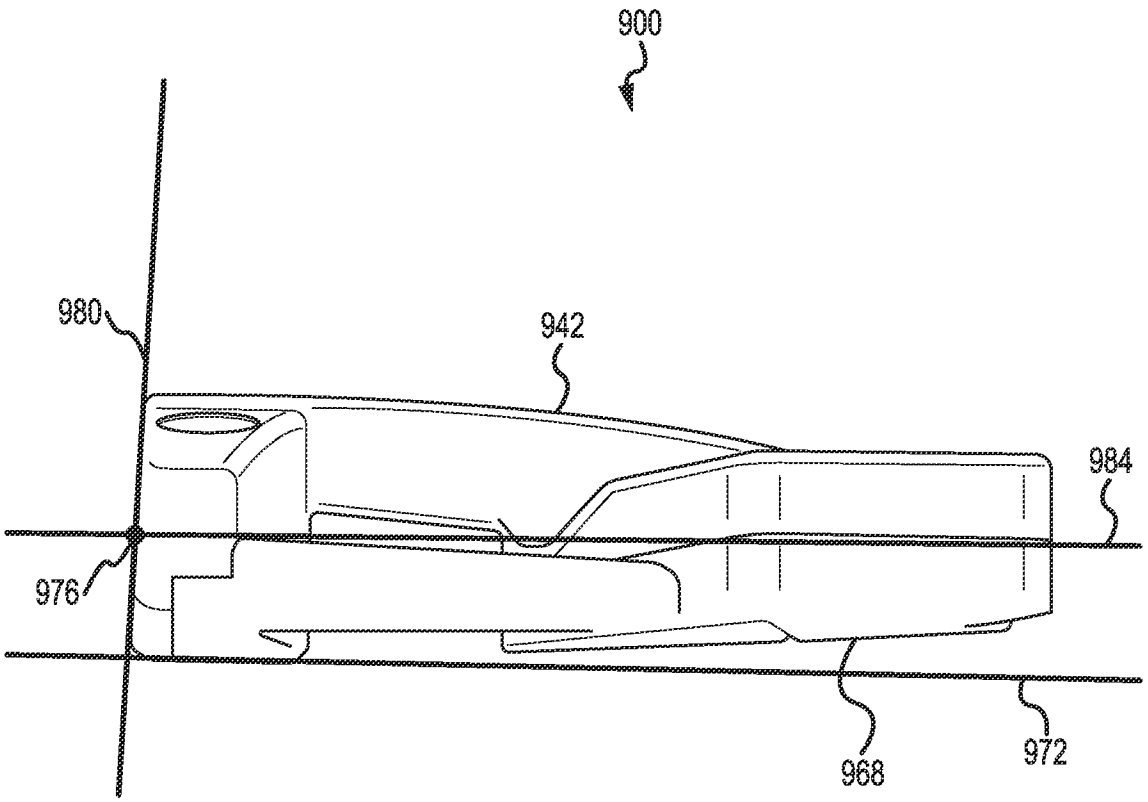
FIG. 9C illustrates a side view of the dual rail putter type golf club head of FIG. 9A.

Referring to FIG. 9C, the four peripheries (front 948, rear 952, toe side 956, and heel side 960) of the lower portion 908, combined with the upper portion 904, create a sole 968. The sole 968 is perpendicular to the ground plane 972, wherein the ground plane 972 is tangent to the sole 968, when the dual-rail putter head 900 is at an address position to strike a golf ball. The sole 968 of the dual-rail putter head 900 extends from the toe end 912 of the dual-rail putter head 900 to the heel end 916 of the dual-rail putter head 900.

In most embodiments, the sole 968 of the dual-rail putter head 900 can be perfectly flat. In some embodiments, the sole 968 of the putter head 900 can have a slight arch in a heel to toe direction, wherein the slight arch can be linear, or a function of a polynomial. In some embodiments, the sole 968 of the putter head 900 can have a strong arch in the heel to toe direction, wherein the strong arch can be linear, or a function of a polynomial. The sole 968 functions to provide a surface to rest the dual-rail putter head 900 on the ground plane 972.

Figure 10B:
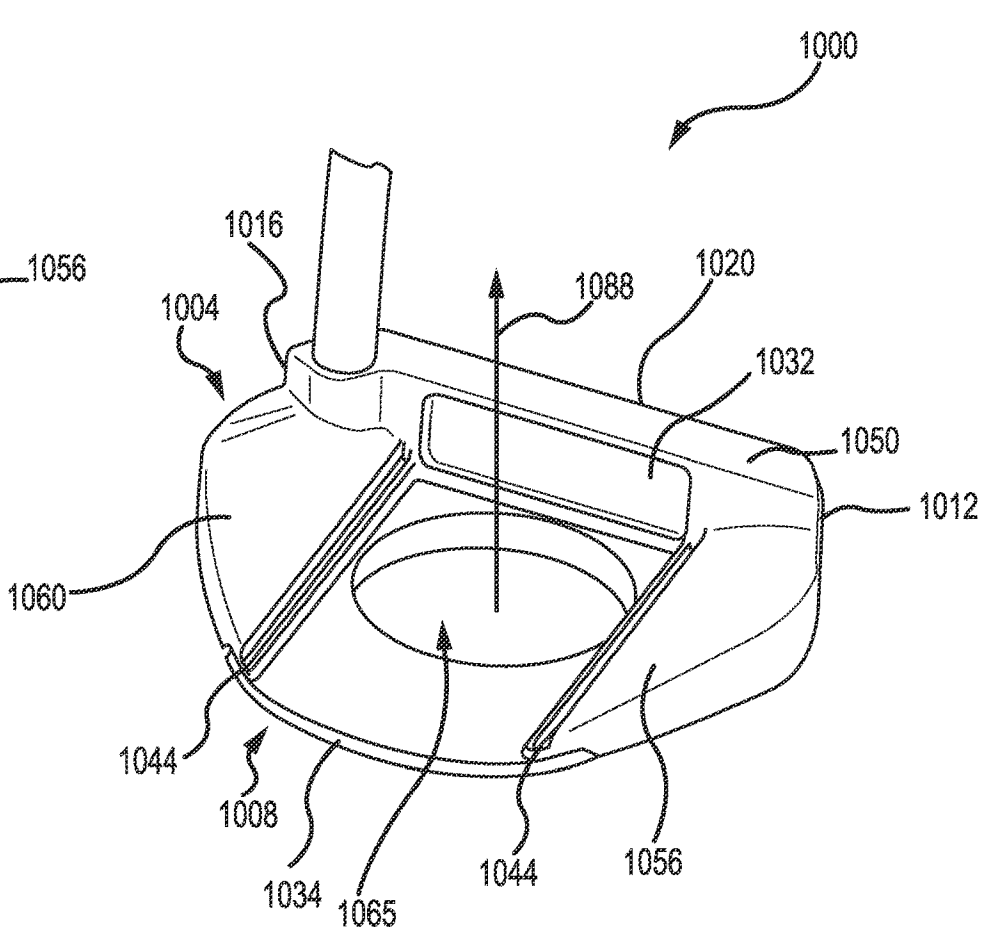
FIG. 10B illustrates an isometric view of the circular putter type golf club head of FIG. 10A.
Figure 10A:
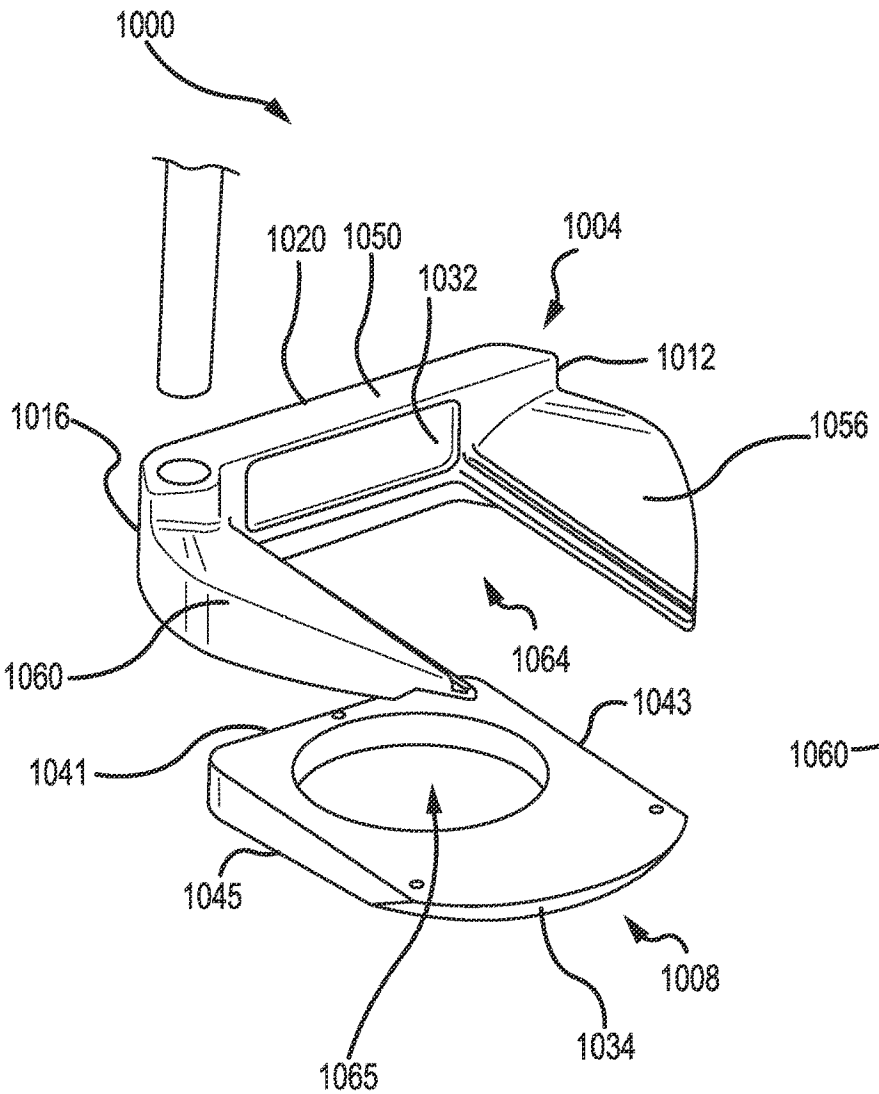
FIG. 10A illustrates an exploded view of a circular putter type golf club head.

Referring to FIG. 10A, in one embodiment, the lower portion 908 can further comprise a front mass 941, a rear mass 943, a toe mass 945, and a heel mass 947. The front mass 941, rear mass 943, toe mass 945, and heel mass 947 are integral to the lower portion 908. The front mass 941, rear mass 943, toe mass 945, and heel mass 947 extend from the lower portion 908, in a direction away from the ground plane 972, and toward the upper portion 904. These mass portions provide a means to position to upper portion and align with the lower portion of the dual-rail putter head 900. Furthermore, these mass portions (i.e., the front mass 941, rear mass 943, toe mass 945, and heel mass 947) provide an additional means of adding weight to the perimeters for increasing the MOI of the putter over putters without these mass features. These mass features can have weight that range from 2-5 grams, 3-7 grams or 1-6 grams. The mass features can have all the same weight or be different weight within the ranges provided above. The mass features can be 1 gram, 2 grams, 3 grams, 4 grams, 5 grams, 6 grams, or 7 grams. The front mass 941, a rear mass 943, a toe mass 945, and a heel mass 947 can respectively be any one or combination of the following shapes: rectangular, triangular, pyramidal, spherical, semi-circular, square, cylindrical, ovular, elliptical, trapezoidal, pentagonal, hexagonal, octagonal, or any other desired geometric or non-geometric shape.

In one embodiment, the front mass 941 is positioned on the front periphery 948, is equidistance from the toe side periphery 956 and the heel side periphery 960, however in other embodiments the front mass 941 can be positioned anywhere along the front periphery 948. In one embodiment, the rear mass 943, is positioned on the rear periphery 952, equidistance from the toe side periphery 956 and the heel side periphery 960, however in other embodiments the rear mass 943 can be positioned anywhere along the rear periphery 952. In one embodiment, the toe mass 945 can be positioned at the junction of the toe side periphery 956 and the rear periphery 952, however in other embodiments the toe mass 945 can be positioned anywhere along the toe side periphery 956. In one embodiment, the heel mass 947 can be positioned at the junction of the heel side periphery 960 and the rear periphery 952, however in other embodiments the heel mass 947 can be positioned anywhere along the heel side periphery 960.

The front mass 941, a rear mass 943, a toe mass 945, and a heel mass 947, provide areas of concentrated mass, such that each mass 941, 943, 945, and 947 function to increase the moment of inertia of the putter head 900. The placement of each mass 941, 943, 945, and 947 on the peripheries 948, 952, 956, 960, increases the MOI since each mass 941, 943, 945, and 947 since each mass is farther from a center of gravity of the putter 900. Each mass 941, 943, 945, 947 on the peripheries 948, 952, 956, 960 is integrally formed from the second material, wherein the second material is denser than the first material.

The front mass 941, a rear mass 943, a toe mass 945, and a heel mass 947 offer dual functionalities, such that each mass 941, 943, 945, and 947 functions not only to increase the MOI of the putter 900, but provide additional surface for the upper portion 904 to join to the lower portion 908. Therefore, the front mass 941 can also be referred to as a front adhesion portion 941, the rear mass 943 can also be referred to as rear adhesion portion 943, the toe mass 945 can also be referred to as a toe adhesion portion 945, and the heel mass 947 can also be referred to as a heel adhesion portion 947.

Further, the crown 942 of the upper portion 942 comprises a toe end cap 949, and a heel end cap 951, such that the toe end cap 949 and heel end cap 951 function to mate to the toe mass 945 and the heel mass 947, respectively. The toe end cap 949 is adjacent the toe end mid-rail 936 and the back edge 934. The heel end cap 951 is adjacent the heel end mid-rail 940 and the back edge 934. In most embodiments, the toe end cap 949 and heel end cap 951 comprise identical geometries, however in some embodiments, the toe end cap 949 and heel end cap 951 can comprise different geometries.

In most embodiments, the toe end cap 949 and heel end cap 951, of the crown 942, are larger than the toe mass 945 and heel mass 947, respectively, so that the toe end cap 949 and heel end cap 951 encompass the toe mass 945 and heel mass 947, when the upper portion 904 is affixed to the lower portion 908. Further, when the upper portion 904 is affixed to the lower portion 908, the toe end cap 949 is positioned such that the toe end cap 949 overlays at least a portion of the toe side periphery 956 and the toe mass 945. Further still, when the upper portion 904 is affixed to the lower portion 908, the heel end cap 951 is positioned such that the heel end cap 951 overlays at least a portion of the heel side periphery 960 and the heel mass 960.

In some embodiments, the under surface, strike face 920, and rear wall 932 of the upper portion 908, can form a first cavity (not shown). The first cavity extends inwards from the under surface towards the crown 942 but does not reach the crown 942. The first cavity is bounded by the rear wall 932 and the strike face 920. The first cavity functions to receive the front mass 941 of the lower portion 908.

In some embodiments, the under surface, the back edge 934, and the crown 942 forms a second cavity (not shown). The second cavity extends inwards from the under surface, towards the crown 942, but does not reach the crown 942. The second cavity is bounded by the back edge 934, the toe cap 949, and the heel end cap 951. In most embodiments, the second cavity is positioned equidistance between the toe end cap 949 and the heel end cap 951. The second cavity functions to receive the rear mass 943 of the lower portion 908.

The first and second cavity can comprise any desired geometry, however in most embodiments, the first and second cavity comprise a geometry similar or identical to that of the front mass 941 and the rear mass 943. Further, when the upper portion 904 is affixed to the lower portion 908, the first cavity is positioned such that the first cavity encompasses the front mass 941, and the second cavity is positioned such that the second cavity encompasses the rear mass 943.

The combination of the low density first material upper portion 904 with the high density second material lower portion 908, creates a high MOI putter 900, without creating an extremely heavy putter. The large aperture 964 formed by the peripheries 948, 952, 956, 960 of the lower portion 908 forms a dense, yet low volume portion that increases the MOI of the putter, in comparison to a putter milled from a single material. A single material putter fails to allocate high density material to the periphery, while maintaining a desirable volume (75 cc-100 cc) and mass (340 grams-385 grams).

The lower portion 908, in most embodiments, comprises less than 35% of a total volume of the putter 900. In some embodiments, the lower portion 908 comprises less than 34% of the total volume of the putter 900, less than 33% of the total volume of the putter 900, less than 32% of the total volume of the putter 900, less than 31% of the total volume of the putter 900, less than 30% of the total volume of the putter 900, less than 29% of the total volume of the putter 900, less than 28% of the total volume of the putter 900, or less than 27% of the total volume of the putter 900.

Although the lower portion 908 comprises less than half of the volume of the putter 900, the lower portion 908 comprises at least 45% of an overall mass of the putter 900. In some embodiments, the lower portion 908 comprises at least 46% of the mass of the putter 900, at least 46% of the mass of the putter 900, at least 46% of the mass of the putter 900, at least 47% of the mass of the putter 900, at least 48% of the mass of the putter 900, at least 49% of the mass of the putter 900, at least 50% of the mass of the putter 900, at least 51% of the mass of the putter 900, at least 52% of the mass of the putter 900, at least 53% of the mass of the putter 900, at least 54% of the mass of the putter 900, or at least 55% of the mass of the putter 900.

The beneficial shift of mass to the periphery of the putter head 900, through the use of a high density, low volume lower portion 908, increases the MOI of the putter 900, over a putter with the same volume, mass, and single material construction (i.e., a putter milled of a single stainless steel block, or a putter investment cast of a single material).

h. Circular Embodiment

Figure 10C:
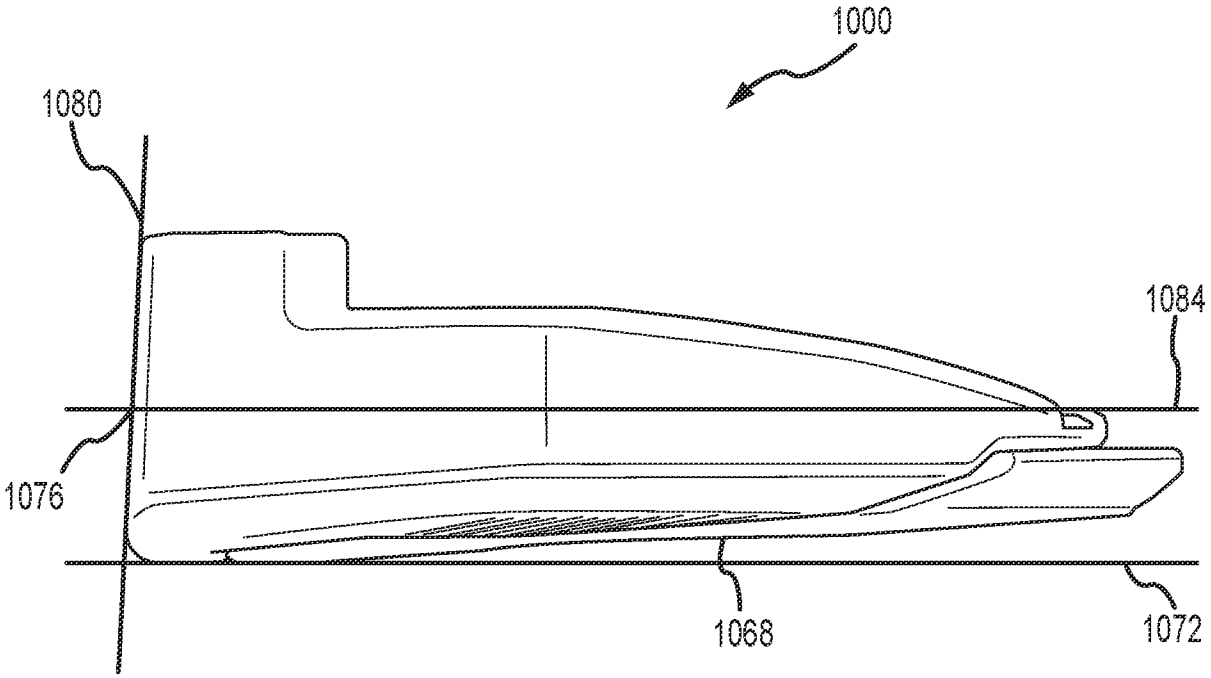
FIG. 10C illustrates a side view of the circular putter type golf club head of FIG. 10A.

In another embodiment, the putter-type golf club head 1000 can be a circular shaped putter head 1000. Referring to FIG. 10A-10C, the circular putter head 1000 has an upper portion 1004 and a lower portion 1008. The lower portion 1008 is made from a first material have a first density and the upper portion 1004 is made from a second material having a second density. The first density is less than the second density. The upper portion 1004 and lower portion 1008 combine to create a high-MOI putter head 1000 (5000 $g \cdot cm^2$-6500 $g \cdot cm^2$), while maintaining a desirable volume and mass.

As discussed above, the upper portion 1004 is comprised of a high-density material (i.e., the second material). The upper portion 1004 comprises a toe end 1012, a heel end 1016, a strike face 1020, a rear wall 1032, and an under surface (not pictured). The toe end 1012 is opposite the heel end 1016. The strike face 1020 spans from the toe end 1012 to the heel end 1016 and is opposite the rear wall 1032. The rear wall 1032 is opposite, and approximately parallel to the strike face 1020.

The upper portion 1004 further comprises a toe side span 1056, and a heel side span 1060. The toe side span 1056 is adjacent to the toe end 1012 and opposite and to the heel side span 1060. The heel side span 1060 is also adjacent to the heel end 1016 and opposite to the toe side span 1056. In some embodiments, the heel side span 1060 and toe side span 1056 can be parallel, while in some embodiments, the heel side span 1060 and toe side span 1056 are not parallel. The toe side span 1056 and heel side span 1060, extend perpendicularly away from the rear wall 1032, in a direction away from the rear wall 1032, and strike face 1020.

In most embodiments, the toe side span 1056 extends perpendicularly from rear wall 1032 such that a right angle (90° angle) is formed at the junction of the toe side span 1056 and the rear wall 1032. However, in other embodiments, the toe side span 1056 can extend from the rear wall 1032 in any direction, such that any angle (0°-180°) can be formed at the junction of the toe side span 1056 and the rear wall 1032. Further, in most embodiments, the heel side span 1060 extends perpendicularly from the rear wall 1032, such that a right angle (90° angle) is formed at the junction of the heel side span 1060 and the rear wall 1032. However, in other embodiments, the heel side span 1060 can extend from the rear wall 1032 in any direction, such that any angle (0°-180°) can be formed at the junction of the heel side span 1060 and the rear wall 1032.

The rear wall 1032, toe side span 1056, and heel side span 1060 form a gap 1064. The gap 1064 is bounded by the rear wall 1032, the toe side span 1056, and the heel side span 1060. The gap 1064 formed by the rear wall 1032, the toe side span 1056, and the heel side span 1060 shifts a majority of the volume and mass of the putter to the extremities of the upper portion 1008. The gap 1064 can comprise any shape, however in one embodiment the gap is approximately rectangular. In other embodiments, the gap 1064 can be circular, curvilinear, triangular, trapezoidal, parabolic, golf ball shaped, square, or any other desired geometric shape.

The lower portion 1008 of the putter head 1000 comprises a front edge 1041, a rear edge 1034, a toe edge 1043, and a heel edge 1045. The front edge 1041 is adjacent to the toe edge 1043 and the heel edge 1045, and opposite to the rear edge 1034. The toe edge 1034 is adjacent to the front edge 1041 and rear edge 1034, and opposite to the heel edge 1045. The heel edge 1045 is also adjacent to the front edge 1041 and the rear edge 1034, and opposite to the toe edge 1043. In some embodiments, the toe edge 1043 and heel edge 1045 can be parallel, while in some embodiments, the toe edge 1043 and heel edge 1045 are not parallel. In some embodiments, the front edge 1041 and rear edge 1034 can be parallel, while in some embodiments, the front edge 1041 and rear edge 1034 are not parallel.

The front edge 1041, rear edge 1034, toe edge 1043, and heel edge 1045 join to form an aperture 1065, wherein the aperture 1065 is bounded by the four edges (front 1041, rear 1034, toe 1043, heel 1045). The four edges 1041, 1034, 1043, 1045, form a perimeter around the aperture 1065.

In some embodiments, the aperture 1065, formed by the front edge 1041, rear edge 1034, toe edge 1043, and heel edge 1045 can be any one of the following shapes: rectangular, triangular, semi-circular, circular (golf ball sized), circular (larger than a golf ball), circular (smaller than a golf ball), square, ovular, elliptical, trapezoidal, pentagonal, hexagonal, octagonal, or any other desired geometric or non-geometric shape.

Referring to FIG. 10C, the lower portion 1008 is affixed to the upper portion 1004 such that a portion of the upper portion 1004 and the lower portion 1008 intersect a ground plane 1072. The ground plane 1072 is tangent to the lower portion 1004, when the putter head 1000 is at an address position to strike a golf ball.

Further, the strike face 1020 of the putter head 1000 comprises a strike face center point 1076 and a loft plane 1080. The strike face center point 1076 is equidistant from a top rail 1050 and the ground plane 1072 of the upper portion 1004, wherein the top rail 1050 is adjacent the strike face 1020 and the rear wall 1032, while opposite the ground plane 1072. The strike face center point 1076 is also equidistant from the heel end 1016 and toe end 1012 of the putter head 1000. The loft plane 1080 is tangent to the strike face 1020 of the putter head 1000. Further, a midplane 1084 intersects the strike face center point 1076 and is perpendicular to the loft plane 1080. Furthermore, a y-axis 1088 intersects the midplane 1084, and is perpendicular to the ground plane 1072.

When the upper portion 1004 and lower portion 1008 are joined such that the toe side span 1056 overlays at least a portion of the toe edge 1043. Further, when the upper portion 1004 and lower portion 1008 are joined such that the heel side span 1060 overlays at least a portion of the heel edge 1045. Further still, when the upper portion 1004 and lower portion 1008 are joined such that the strike face 1020 overlays at least a portion of the front edge 1048. Finally, when the upper portion 1004 and lower portion 1008 are joined such that the lower portion 1008 is affixed to a portion of the strike face 1020, toe side span 1056, and heel side span 1060, thereby filling at least a portion of the gap 1064 formed by the rear wall 1032, toe side span 1056, and heel side span 1060

The lower portion 1008, and the toe side span 1056 and heel side span 1060 of the upper portion 1004, when combined create a sole 1068. The sole 1068 is perpendicular to the ground plane 1072, wherein the ground plane 1072 is tangent to the sole 1068, when the putter head 1000 is at an address position to strike a golf ball. The sole 1068 of the putter head 1000 extends from the toe end 1012 of the putter head 1000 to the heel end 1016 of the putter head 1000.

In most embodiments, the sole 1068 of the putter head 1000 can be perfectly flat. In some embodiments, the sole 1068 of the putter head 1000 can have a slight arch in a heel 1016 to toe 1012 direction, wherein the slight arch can be linear, or a function of a polynomial. In some embodiments, the sole 1068 of the putter head 1000 can have a strong arch in the heel 1016 to toe 1012 direction, wherein the strong arch can be linear, or a function of a polynomial. The sole 1068 functions to provide a surface to rest the putter head 1000 on the ground plane 1072.

In some embodiments, the upper portion 1004 can further comprise a crown (not shown). The crown extends away from the strike face 1020 to the back edge 1034 of the lower portion 1008. Furthermore, the crown, spans from the strike face 1020 to the back edge 1034, at least over a portion of the aperture 1065 of the lower portion and at least over a portion of the rear wall 1032.

The crown can further descend from the strike face 1020 to the back edge 1034. The crown, in most embodiments, spans approximately inward 25% of the total club head 1000 width from the toe side span 1056 and spans approximately inward 25% of the total club head 1000 width from the heel side span 1060. In other embodiments, the crown can, continuously or discontinuously, span the entire width of the total club head 1000, in a heel to toe direction. In some embodiments, the crown, can span less than 90% of the total width of the club head 1000, less than 90% of the total width of the club head 1000, less than 80% of the total width of the club head 1000, less than 70% of the total width of the club head 1000, less than 60% of the total width of the club head 1000, less than 50% of the total width of the club head 1000, less than 40% of the total width of the club head 1000, or less than 30% of the total width of the club head 1000. Further, in some embodiments, the crown can be substantially flat from the strike face 1020 to the back edge 1034 or ascend from the strike face 1020 to the back edge 1034. In most embodiments, the ascent or descent of the crown can be linear, curvilinear, parabolic, sinusoidal, or a function of polynomial.

Furthermore, the upper portion 1004 of the putter head 1000 can comprise one or more alignment features 1044 on the toe side span 1065 and the heel side span 1060. The alignment feature 1044 can be any one or combination of the following: a line, a series of lines, milling troughs, a circle, a dashed line, a triangle, a channel, or any other desired alignment feature 1044. The alignment features 1044 can be equally spaced on the entire toe side span 1065 and the heel side span 1060, a portion of the crown, or the entire crown. The alignment features 1044, extending along the toe side span 1056 and the heel side span 1060, function to provide the viewer a visual alignment field that extends the width of the golf ball, from the rear wall 1032 to the back edge 1034 of the putter 1000. The goal is to align the entire putter 1000 with the golf ball using these alignment features 1044 along the toe side span 1056 and the heel side span 1060 and/or the crown.

The combination of the high density first material upper portion 1004 with the low density second material lower portion 1008, creates a high MOI putter 1000, without creating an extremely heavy putter. The large gap 1064 formed by the rear wall 1032 and the spans 1056, 1060 of the upper portion 1004 forms a dense, yet low wide periphery that increases the MOI of the putter, in comparison to a putter milled from a single material. A single material putter fails to allocate high density material to the periphery, while maintaining a desirable volume (75 cc-100 cc) and mass (340 grams-385 grams).

The beneficial shift of mass to the periphery of the putter head 1000, through the use of a high density, upper portion 1008, and low volume low mass lower portion 100, increases the MOI of the putter 1000, over a putter with the same volume, mass, and single material construction (i.e., a putter milled of a single stainless steel block, or a putter investment cast of a single material).

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

The above examples may be described in connection with a putter-type golf club, the apparatus, methods, and articles of manufacture described herein. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Clause 1: A putter type golf club head comprising: an upper portion and a lower portion; wherein the upper portion is made from a first material having a first density and the lower portion is made from a second material having a second density; wherein the first density is less than the second density; the lower portion comprises a front periphery, a toe side periphery, a heel side periphery, and a rear periphery; wherein the lower portion further comprises an aperture bounded by the front periphery, toe side periphery, heel side periphery, and rear periphery; the upper portion comprises a heel end, a toe end, a strike face, a rear wall, a back edge, a crown, and an under surface; wherein the toe end is opposite the heel end, the back edge is opposite the strike face; the crown extends away from the strike face, over at least a portion of the rear wall, and to the back edge; the under surface is opposite the crown spanning from the strike face to the back edge; the upper portion is affixed to the lower portion, and is farther from a ground plane than the lower portion, wherein the heel end overlays at least a portion of the heel side periphery, the toe end overlays at least a portion of the toe side periphery, the strike face overlays at least a portion of the front periphery, and the crown spans from the strike face to the rear periphery; the lower portion and upper portion combine to create a sole; wherein the sole is tangent to the ground plane, when the golf club head is at an address position; the strike face is tangent to a loft plane, wherein a loft angle formed between the loft plane and the ground plane; a volume and a mass; wherein the lower portion comprises less than 30% of the volume of the golf club head; and wherein the lower portion comprises greater than 50% of the mass of the golf club head.

Clause 2: The putter type golf club head of clause 1, wherein the lower portion further comprises: a toe mass at the junction of the toe side periphery and the rear periphery; a heel mass at the junction of the heel side periphery and the rear periphery; a rear mass positioned on the rear periphery, equidistance from the toe side periphery and the heel side periphery; and a front mass positioned on the front periphery, equidistance from the toe side periphery and the heel side periphery.

Clause 3: The putter type golf club head of clause 2, wherein the toe mass, heel mass, rear mass, and front mass are integral and extend away from the lower portion, in a direction away from the ground plane and toward the upper portion.

Clause 4: The putter type golf club head of clause 1, wherein the crown, of the upper portion, further comprises a toe end mid-rail, a heel end mid-rail, a toe end cap, and a heel end cap.

Clause 5: The putter type golf club head of clause 4, wherein the toe end cap is configured to mate with the toe mass and the heel end cap is configured to mate with the heel mass.

Clause 6: The putter type golf club head of clause 5, wherein the upper portion further comprises a first cavity, wherein the first cavity is formed in the under surface, between the strike face and the rear wall, and extends in a direction towards the crown; and a second cavity, wherein the rear aperture is formed in the under surface, adjacent the back edge, and equidistant between the toe end cap and the heel end cap.

Clause 7: The putter type golf club head of clause 6, wherein the first cavity is configured to mate with the front mass, and the second cavity is configured to mate with the rear mass.

Clause 8: The putter type golf club head of clause 4, wherein the toe end mid-rail and heel end mid-rail descend from the strike face to the rear periphery.

Clause 9: The putter type golf club head of clause 4, wherein the heel end mid-rail and the toe end mid-rail comprise one or more alignment features on the heel end mid-rail and the toe end mid-rail.

Clause 10: The putter type golf club head of clause 9, wherein the one or more alignment features can be unequally or equally spaced apart from the strike face to the rear periphery.

Clause 11: The putter type golf club head of clause 1, wherein the front periphery, of the lower portion, comprises a front width measured from the junction of the toe side periphery and the front periphery, to the junction of the heel side periphery and the front periphery;

Clause 12: The putter type golf club head of clause 11, wherein the rear periphery, of the lower portion, comprises a rear width measured from the junction of the toe side periphery and the rear periphery, to the junction of the heel side periphery and the rear periphery.

Clause 13: The putter type golf club head of clause 12, wherein the front width is greater than the rear width.

Clause 14: The putter type golf club head of clause 1, wherein one or more alignment feature is positioned on the crown.

Clause 15: The putter type golf club head of clause 1, wherein the first density of the first material is less than 6.0 g/cc.

Clause 16: The putter type golf club head of clause 1, wherein the second density of the second material is greater than 7.0 g/cc.

Clause 17: The putter type golf club head of clause 1, wherein the second density of the second material is at least 2 times greater than the first density of the first material.

Clause 18: The putter type golf club head of clause 1, wherein the first material can comprise any one or combination of the following: 8620 alloy steel, S25C steel, carbon steel, maraging steel, 17-4 stainless steel, 303 stainless steel, 304 stainless steel, stainless steel alloy, tungsten, aluminum, aluminum alloy, ADC-12, or any metal suitable for creating a golf club head.

Clause 19: The putter golf club head of clause 1, wherein the second material can comprise any one or combination of the following: 8620 alloy steel, S25C steel, carbon steel, maraging steel, 17-4 stainless steel, 303 stainless steel, 304 stainless steel, stainless steel alloy, tungsten, aluminum, aluminum alloy, ADC-12, or any metal suitable for creating a golf club head.

Clause 20: The putter golf club head of clause 1, wherein the first material is ADC-12 and the second material is 304 stainless steel.

What is claimed is:

1. A putter type golf club head comprising:

an upper portion and a lower portion;

wherein the upper portion is made from a first material having a first density and the lower portion is made from a second material having a second density;

wherein the first density is less than the second density;

the upper portion of the putter type golf club head comprises a toe end, a heel end, a strike face, a rear wall, a back edge, a crown, and an under surface;

the lower portion comprises a front periphery, a rear periphery, a sole, a toe side wing, and a heel side wing, wherein the toe side wing and the heel side wing extend beyond the rear wall of the upper portion;

wherein the rear periphery, toe side wing, and heel side wing form a gap, wherein the gap is bounded by the rear periphery, toe side wing, and heel side wing;

the lower portion further comprises a front toe mass and a front heel mass, wherein both the front toe mass and the front heel mass extend upwardly from the lower portion to the upper portion;

wherein the under surface, strike face, and rear wall of the upper portion form a first cavity proximate the toe end and a second cavity proximate the heel end, wherein the first and second cavities extend inward from the under surface towards the crown, but do not reach the crown; and wherein the front toe mass and the front heel mass are configured to mate with the first and second cavities, respectively.

2. The putter type golf club head of claim 1, wherein the toe side wing and heel side wing extend perpendicularly from the rear periphery such that a first right angle is formed at a junction of the toe side wing and the rear periphery and a second right angle is formed at a junction of the heel side wing and the rear periphery.

3. The putter type golf club head of claim 1, wherein the crown extends away from the strike face, over the front periphery of the lower portion, and to the back edge of the upper portion.

4. The putter type golf club head of claim 1, wherein the crown further comprises an alignment trough adjacent the rear wall and approximately perpendicular to the strike face;

wherein the alignment trough is bounded by the back edge, the rear wall, and the crown.

5. The putter type golf club head of claim 4, wherein the alignment trough comprises a width of approximately 4.27 cm.

6. The putter type golf club head of claim 1, wherein the club head further comprises a mass and a volume;

wherein the lower portion comprises less than 40% of the volume of the club head and at least 45% of the mass of the club head.

7. The putter type golf club head of claim 1, wherein the club head comprises a heel-to-toe moment of inertia between 5000 $g \cdot cm^2$-6500 $g \cdot cm^2$.

8. The putter type golf club head of claim 1, wherein the front toe mass and front heel mass are integral with the lower portion.

9. The putter type golf club head of claim 1, wherein the first material comprises any one or combination of the following: 8620 alloy steel, S25C steel, carbon steel, maraging steel, 17-4 stainless steel, 303 stainless steel, 304 stainless steel, stainless steel alloy, tungsten, aluminum, aluminum alloy, or ADC-12.

10. The putter type golf club head of claim 1, wherein the second material comprises any one or combination of the following: 8620 alloy steel, S25C steel, carbon steel, maraging steel, 17-4 stainless steel, 303 stainless steel, 304 stainless steel, stainless steel alloy, tungsten, aluminum, aluminum alloy, and ADC-12.

11. The putter type golf club head of claim 1, wherein the first density of the first material is less than 6.0 g/cc.

12. The putter type golf club head of claim 1, wherein the second density of the second material is greater than 7.0 g/cc.

13. The putter type golf club head of claim 1, wherein the upper portion and lower portion are joined in any one or combination of the following methods: welding, soldering, brazing, swedging, adhesion, epoxy, or mechanical fastening.

14. The putter type golf club head of claim 1, further comprising a toe wing mass and a heel wing mass;

wherein the toe wing mass extends upwardly from the lower portion toward the upper portion and is positioned along at least a portion of the toe side wing; and wherein the heel wing mass extends upwardly from the lower portion toward the upper portion and is positioned along at least a portion of the heel side wing.

15. A putter type golf club head comprising:

an upper portion and a lower portion;

wherein the upper portion is made from a first material having a first density and the lower portion is made from a second material having a second density;

wherein the first density is less than the second density;

the upper portion of the putter type golf club head comprises a toe end, a heel end, a strike face, a rear wall, a back edge, a crown, and an under surface;

the lower portion comprises a front periphery, a rear periphery, a sole, a toe side wing, and a heel side wing, wherein the toe side wing and the heel side wing extend beyond the rear wall of the upper portion;

the lower portion further comprises at least one front adhesion portion extending upwardly from the lower portion to the upper portion;

wherein the under surface forms at least one cavity extending inward from the under surface towards the crown; and wherein the at least one cavity and the at least one front adhesion portion comprise geometries configured to mate with one another to join the upper portion and lower portion.

16. The putter type golf club head of claim 15, wherein the toe side wing and heel side wing extend perpendicularly from the rear periphery such that a first right angle is formed at a junction of the toe side wing and the rear periphery and a second right angle is formed at a junction of the heel side wing and the rear periphery.

17. The putter type golf club head of claim 15, wherein the club head further comprises a mass and a volume;

wherein the lower portion comprises less than 40% of the volume of the club head and at least 45% of the mass of the club head.

18. The putter type golf club head of claim 15, wherein the club head comprises a heel-to-toe moment of inertia between 5000 $g \cdot cm^2$-6500 $g \cdot cm^2$.

* * * * *